US006027872A

United States Patent [19]

Suzuki et al.

[11] Patent Number: 6,027,872

[45] Date of Patent: Feb. 22, 2000

[54] THERMOGRAPHIC PHOTOGRAPHIC ELEMENT

[75] Inventors: Ryo Suzuki; Tsutomu Arai; Katsuyuki Watanabe; Shigeo Hirano; Minoru Sakai, all of Kanagawa, Japan

[73] Assignee: Fuji Photo Film Co., Ltd., Kanagawa, Japan

[21] Appl. No.: 09/081,589

[22] Filed: May 20, 1998

[30] Foreign Application Priority Data

| | | | |
|---|---|---|---|
| May 23, 1997 | [JP] | Japan | 9-150107 |
| May 23, 1997 | [JP] | Japan | 9-150108 |
| Jul. 16, 1997 | [JP] | Japan | 9-207235 |

[51] Int. Cl.[7] ..... G03C 1/498; G03C 1/34

[52] U.S. Cl. ..... 430/619; 430/600; 430/603; 430/617; 430/629

[58] Field of Search ..... 430/619, 617, 430/603, 600, 629

[56] References Cited

U.S. PATENT DOCUMENTS

| | | | |
|---|---|---|---|
| 2,385,762 | 9/1945 | Mueller | 430/611 |
| 4,521,508 | 6/1985 | Sugimoto et al. | 430/567 |
| 5,496,695 | 3/1996 | Simpson et al. | 430/619 |
| 5,656,419 | 8/1997 | Toya et al. | 430/619 |

*Primary Examiner*—Thorl Chea

*Attorney, Agent, or Firm*—Birch, Stewart, Kolasch & Birch, LLP

[57] ABSTRACT

A photothermographic element comprising a photosensitive silver halide, an organic silver salt, a reducing agent, and a compound of formula (I) on a support has a high sensitivity and storage stability.

$$Z^1—(W^1)_{m1}—L^1—S—S—L^2—(W^2)_{m2}—Z^2 \quad (I)$$

$L^1$ and $L^2$ are divalent aliphatic hydrocarbon groups, $W^1$ and $W^2$ are divalent linking groups containing 0, S or N, $Z^1$ is hydrogen, halogen, aliphatic hydrocarbon, aromatic or heterocyclic group, $Z^2$ is an aromatic or heterocyclic group, $m_1$=0, 1, 2 or 3, and $m_2$=0, 1, 2 or 3.

15 Claims, No Drawings

THERMOGRAPHIC PHOTOGRAPHIC ELEMENT

BACKGROUND OF THE INVENTION

1. Field of the Invention

This invention relates to a thermographic photographic element and more particularly, to a photothermographic element having a high sensitivity and which experiences a minimal change of sensitivity under varying conditions during storage.

2. Prior Art

From the contemporary standpoints of environmental protection and space saving, it is strongly desired in the medical imaging field to reduce the quantity of spent solution. Needed in this regard is a technology relating to thermographic photosensitive materials for use in medical diagnosis and general photography which can be effectively exposed by means of laser image setters and laser imagers and produce clear black images having a high resolution and sharpness. These thermographic photosensitive materials offer to the customer a simple thermographic system which eliminates the need for solution type chemical agents and is not detrimental to the environment.

On the other hand, the recent rapid progress of semiconductor laser technology has made it possible to reduce the size of medical image output devices. As a matter of course, there were developed techniques relating to infrared-sensitive photothermal silver halide photographic material which can utilize a laser diode as a light source. The spectral sensitization technique is disclosed, for example, in JP-B 10391/1991 and 52387/1994, JP-A 341432/1993, 194781/1994, and 301141/1994. The antihalation technique is disclosed, for example, in JP-A 13295/1995 and U.S. Pat. No. 5,380,635. Since the infrared exposure system permits the visible light absorption of sensitizing dyes and antihalation dyes to be considerably reduced, a substantially colorless photosensitive material can be readily produced.

A combination of the thermographic technology with the infrared exposure technology enables a photosensitive material which eliminates a need for liquid.

Since spectral sensitizing dyes capable of absorbing infrared radiation, however, generally have a high reducing power due to a high HOMO (highest occupied molecular orbital), they tend to reduce silver ions in photosensitive materials exacerbating the fog thereof. In particular, these photosensitive materials experience a substantial change of performance during storage under hot humid conditions or long-term storage. If dyes having a low HOMO are used for preventing the photosensitive material from deteriorating during storage, spectral sensitization efficiency and sensitivity become low because their LUMO (lowest unoccupied molecular orbital) is relatively low. These problems relating to sensitivity, storage stability, and performance change arise not only with wet photographic photosensitive materials, but more outstandingly with photothermographic materials.

The supersensitization technique has been developed for overcoming such infrared sensitization problems. Known infrared supersensitizers for use in thermographic systems include aminopolycarboxylic acid derivatives as disclosed in JP-A 4241/1990, and heteroaromatic mercapto compounds and heteroaromatic disulfide compounds as disclosed in JP-A 182639/1992 and 341432/1993. The aminopolycarboxylic acid derivatives provide weak supersensitization effect and low sensitivity whereas the heteroaromatic mercapto and disulfide compounds allow the sensitivity to vary during storage under hot humid conditions.

In the printing field, image forming systems exhibiting photographic characteristics including ultrahigh contrast (especially gamma values of 10 or higher) are available in order to improve the reproduction of continuous tone images or halftone images or the reproduction of line images. From the standpoints of environmental protection and space saving, it is strongly desired to reduce the amount of waste solution. Recent research efforts achieved noticeable reduction of waste solution. In systems using processing solutions of chemicals, it is impossible to eliminate the waste solution. Accordingly, the printing field waits for the practical implement of the thermographic system which is simple and ecologically safe since it eliminates the use of processing solutions of chemicals.

There have been proposed image forming processes using photothermographic materials entailing a developing step by heat treatment. Such materials are disclosed, for example, in JP-B 4924/1968 and 6582/1969, JP-A 6074/1971, 97523/1973, and 2781/1995, and U.S. Pat. No. 5,468,603. These photothermographic materials, however, are not suited for the manufacture of printing plates because of low gamma or soft gradation.

In the printing field, photographic characteristics ensuring ultrahigh contrast are desired as described above. The desired ultrahigh contrast is accomplished using hydrazine derivatives as disclosed in U.S. Pat. No. 5,496,695. Where hydrazine derivatives are used, however, stable images are not obtainable since the sensitivity largely changes with changes of temperature and time of heat development. An improvement in this regard is desired.

Fog by heat development is also a crucial problem. A number of proposals have been made for reducing the fog of thermographic silver halide photosensitive materials. For example, U.S. Pat. No. 3,589,903 discloses mercury salts. There are also known carboxylic acids such as benzoic acid and phthalic acid from U.S. Pat. No. 4,152,160; benzoylbenzene acid compounds from U.S. Pat. No. 4,784,939; indane and tetralin carboxylic acids from U.S. Pat. No. 4,569,906; dicarboxylic acids from U.S. Pat. No. 4,820,617; heteroaromatic carboxylic acids from U.S. Pat. No. 4,626,500; halogenated compounds from U.S. Pat. Nos. 4,546,075, 4,756,999, 4,452,885, 3,874,946 and 3,955,982; halogen molecules or heterocycles associated with halogen atoms from U.S. Pat. No. 5,028,523; palladium compounds from U.S. Pat. No. 4,103,312 and GB 1,502,670; iron group metals from U.S. Pat. No. 4,128,428; substituted triazoles from U.S. Pat. Nos. 4,123,374, 4,129,557 and 4,125,430; sulfur compounds from U.S. Pat. Nos. 4,213,784, 4,245,033 and JP-A 26019/1976; thiouracils from U.S. Pat. No. 4,002,479; sulfinic acids from JP-A 123331/1975; metal salts of thiosulfonic acid from U.S. Pat. Nos. 4,125,403, 4,152,160 and 4,307,187; combinations of metal salts of thiosulfonic acid with sulfinic acid from JP-A 20923/1978 and 19825/1978; and thiosulfonates from JP-B 50810/1987, JP-A 209797/1995 and 43760/1997. Also, JP-A 42529/1976 and JP-B 37368/1988 discloses disulfide compounds. None of these patents describe whether or not these compounds are effective for suppressing changes under different heat development conditions of the sensitivity of ultrahigh contrast photosensitive material systems using ultrahigh contrast enhancers.

JP-B 21925/1994 discloses the use of hydrazine derivatives and disulfides in photographic silver halide materials which are developed with developer solutions. This patent describes that the addition of disulfides is effective for improving the stability of photographic properties during storage of the material, but refers nowhere to the effect of such compounds in thermographic systems, for example, whether such compounds are effective for improving the heat development stability.

SUMMARY OF THE INVENTION

An object of the invention is to provide a photothermographic element which has high sensitivity in the red to infrared region, especially in the practically advantageous infrared region and undergoes a minimal change of sensitivity during storage.

Another object of the invention is to provide a photothermographic element having a ultrahigh contrast.

A further object of the invention is to provide a thermographic photographic element, as typified by a thermographic ultrahigh contrast photosensitive element, which exhibits a ultrahigh contrast, has an improved heat development stability in that it undergoes a minimal change of photographic properties and a minimal fog under varying temperature and time conditions during heat development, and is suitable for the manufacture of graphic printing plates.

In a first aspect, the invention provides a photothermographic (or heat-developable photosensitive) element comprising a photosensitive silver halide, an organic silver salt, a reducing agent, and at least one compound of the general formula (I) on a support.

$$Z^1—(W^1)_{m1}—L^1—S—S—L^2—(W^2)_{m2}—Z^2 \quad (I)$$

Each of $L^1$ and $L^2$ is a divalent linking group composed of an aliphatic hydrocarbon group, each of $W^1$ and $W^2$ is a divalent linking group containing at least one of oxygen, sulfur and nitrogen atoms, $Z^1$ is a hydrogen, halogen, aliphatic hydrocarbon, aromatic or heterocyclic group, $Z^2$ is an aromatic or heterocyclic group, letter $m_1$ is equal to 0, 1, 2 or 3, and $m_2$ is equal to 0, 1, 2 or 3.

The photothermographic element may further contain at least one contrast enhancer. Preferably, the silver halide has been spectrally sensitized in the wavelength range of 750 to 1400 nm.

In a second aspect, the invention provides a thermographic (or heat-developable) photographic element comprising (a) a reducible silver salt, (b) a reducing agent, (c) a contrast enhancer, (d) a binder, and (e) a disulfide compound. In one embodiment, the disulfide compound (e) is at least one compound of the general formula (1):

$$Z_1—S—S—Z_2 \quad (1)$$

wherein $Z_1$ is an aliphatic hydrocarbon or aryl group and $Z_2$ is an aryl group.

In another embodiment, the disulfide compound (e) is at least one compound of the general formula (2):

$$Z_1—S—S—Z_2 \quad (2)$$

wherein $Z_1$ is an aliphatic hydrocarbon, aryl or heterocyclic group and $Z_2$ is a heterocyclic group.

The thermographic photographic element of the second aspect may further contain (f) a photosensitive silver halide as a photocatalyst, providing a photothermographic (or heat-developable photosensitive) element.

DESCRIPTION OF THE PREFERRED EMBODIMENTS

Disulfide

According to the first aspect of the invention, the photothermographic (or heat-developable, photosensitive) element comprising at least a photosensitive silver halide, an organic silver salt, and a reducing agent on a support contains at least one compound of the general formula (I). The inclusion of this disulfide compound ensures sufficient supersensitization effect in the red to infrared region, especially in the practically advantageous infrared region and suppresses a change of sensitivity during storage. When the element further contains a contrast enhancer, ultrahigh contrast images are obtained.

The compounds of the general formula (I) are described in detail.

$L^1$ and $L^2$ are divalent linking groups each composed of an aliphatic hydrocarbon group, including normal, branched or cyclic alkylene groups preferably having 1 to 20 carbon atoms, more preferably 1 to 16 carbon atoms, most preferably 1 to 12 carbon atoms, alkenylene groups preferably having 2 to 20 carbon atoms, more preferably 2 to 16 carbon atoms, most preferably 2 to 12 carbon atoms, and alkynylene groups preferably having 2 to 20 carbon atoms, more preferably 2 to 16 carbon atoms, most preferably 2 to 12 carbon atoms, which may have substituents.

Alternatively, $L^1$ and $L^2$, taken together, form a ring, for example, 4- to 7-membered rings. Exemplary rings are shown below.

(1)

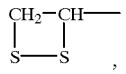

(2)

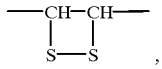

(3)

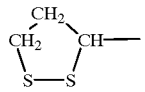

(4)

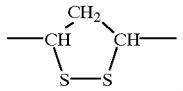

(5)

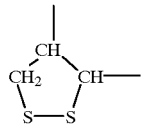

(6)

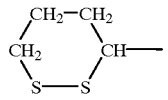

(7)

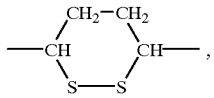

(8)

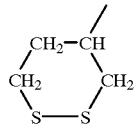

Among the foregoing examples, rings (1), (3), (6) and (8) are expressed in the form having incorporated therein the $Z^1—(W^1)_{m1}—$ portion in formula (I) wherein $Z^1$=H and $m_1$=0.

The divalent linking groups composed of an aliphatic hydrocarbon group represented by $L^1$ and $L^2$ are preferably alkylene groups, more preferably chain alkylene groups.

The linking groups represented by $L^1$ and $L^2$ may have substituents. Exemplary substituents include alkyl groups inclusive of cycloalkyl and aralkyl groups, preferably having 1 to 20 carbon atoms, more preferably 1 to 12 carbon atoms, most preferably 1 to 8 carbon atoms, for example, methyl, ethyl, n-propyl, iso-propyl, n-butyl, tert-butyl, n-heptyl, n-octyl, n-decyl, n-undecyl, n-hexadecyl, cyclopropyl, cyclopentyl, cyclohexyl, benzyl, and phenethyl; alkenyl groups, preferably having 2 to 20 carbon atoms, more preferably 2 to 12 carbon atoms, most preferably 2 to 8 carbon atoms, for example, vinyl, allyl, 2-butenyl, and 3-pentenyl; alkynyl groups, preferably having 2 to 20 carbon atoms, more preferably 2 to 12 carbon atoms, most preferably 2 to 8 carbon atoms, for example, propargyl and 3-pentynyl; aryl groups, preferably having 6 to 30 carbon atoms, more preferably 6 to 20 carbon atoms, most preferably 6 to 12 carbon atoms, for example, phenyl, p-methylphenyl, and naphthyl; amino groups, preferably having 0 to 20 carbon atoms, more preferably 0 to 10 carbon atoms, most preferably 0 to 6 carbon atoms, for example, amino, methylamino, dimethylamino, diethylamino, diphenylamino, and dibenzylamino; imino groups, preferably having 1 to 20 carbon atoms, more preferably 1 to 18 carbon atoms, most preferably 1 to 12 carbon atoms, for example, ethylimino, propylimino and phenylimino; alkoxy groups, preferably having 1 to 20 carbon atoms, more preferably 1 to 12 carbon atoms, most preferably 1 to 8 carbon atoms, for example, methoxy, ethoxy, and butoxy; aryloxy groups, preferably having 6 to 20 carbon atoms, more preferably 6 to 16 carbon atoms, most preferably 6 to 12 carbon atoms, for example, phenyloxy and 2-naphthyloxy; acyl groups, preferably having 1 to 20 carbon atoms, more preferably 1 to 16 carbon atoms, most preferably 1 to 12 carbon atoms, for example, acetyl, benzoyl, formyl, and pivaloyl; alkoxycarbonyl groups, preferably having 2 to 20 carbon atoms, more preferably 2 to 16 carbon atoms, most preferably 2 to 12 carbon atoms, for example, methoxycarbonyl and ethoxycarbonyl; aryloxycarbonyl groups, preferably having 7 to 20 carbon atoms, more preferably 7 to 16 carbon atoms, most preferably 7 to 10 carbon atoms, for example, phenyloxycarbonyl; acyloxy groups, preferably having 1 to 20 carbon atoms, more preferably 1 to 16 carbon atoms, most preferably 1 to 10 carbon atoms, for example, acetoxy and benzoyloxy; acylamino groups, preferably having 1 to 20 carbon atoms, more preferably 1 to 16 carbon atoms, most preferably 1 to 10 carbon atoms, for example, acetylamino and benzoylamino; alkoxycarbonylamino groups, preferably having 2 to 20 carbon atoms, more preferably 2 to 16 carbon atoms, most preferably 2 to 12 carbon atoms, for example, methoxycarbonylamino; aryloxycarbonylamino groups, preferably having 7 to 20 carbon atoms, more preferably 7 to 16 carbon atoms, most preferably 7 to 12 carbon atoms, for example, phenyloxycarbonylamino; sulfonylamino groups, preferably having 1 to 20 carbon atoms, more preferably 1 to 16 carbon atoms, most preferably 1 to 12 carbon atoms, for example, methanesulfonylamino and benzenesulfonylamino; sulfamoyl groups, preferably having 0 to 20 carbon atoms, more preferably 0 to 16 carbon atoms, most preferably 0 to 12 carbon atoms, for example, sulfamoyl, methylsulfamoyl, dimethylsulfamoyl, and phenylsulfamoyl; carbamoyl groups, preferably having 1 to 20 carbon atoms, more preferably 1 to 16 carbon atoms, most preferably 1 to 12 carbon atoms, for example, carbamoyl, methylcarbamoyl, diethylcarbamoyl, and phenylcarbamoyl; alkylthio groups, preferably having 1 to 20 carbon atoms, more preferably 1 to 16 carbon atoms, most preferably 1 to 12 carbon atoms, for example, methylthio and ethylthio; arylthio groups, preferably having 6 to 20 carbon atoms, more preferably 6 to 16 carbon atoms, most preferably 6 to 12 carbon atoms, for example, phenylthio; sulfonyl groups, preferably having 1 to 20 carbon atoms, more preferably 1 to 16 carbon atoms, most preferably 1 to 12 carbon atoms, for example, mesyl and tosyl; sulfinyl groups, preferably having 1 to 20 carbon atoms, more preferably 1 to 16 carbon atoms, most preferably 1 to 12 carbon atoms, for example, methanesulfinyl and benzenesulfinyl; ureido groups, preferably having 1 to 20 carbon atoms, more preferably 1 to 16 carbon atoms, most preferably 1 to 12 carbon atoms, for example, ureido, methylureido, and phenylureido; phosphoramide groups, preferably having 1 to 20 carbon atoms, more preferably 1 to 16 carbon atoms, most preferably 1 to 12 carbon atoms, for example, diethylphosphoramide and phenylphosphoramide; hydroxy groups; mercapto groups; halogen atoms such as fluorine, chlorine, bromine and iodine atoms; cyano groups; sulfo groups; sulfino groups; carboxyl groups; phosphono groups; phosphino groups; nitro groups; hydroxamic acid groups; hydrazino groups; and heterocyclic groups such as imidazolyl, benzimidazolyl, thiazolyl, benzthiazolyl, carbazolyl, pyridyl, furyl, piperidyl, and morpholino. Among the foregoing groups, those groups capable of forming a salt such as hydroxy, mercapto, sulfo, sulfino, carboxyl, phosphono, and phosphino groups may take the form of a salt. These substituents may be further substituted. Where there are two or more substituents, they may be identical or different.

Preferred substituents are alkyl, aralkyl, alkoxy, aryl, alkylthio, acetyl, acylamino, imino, sulfamoyl, sulfonyl, sulfonylamino, ureido, amino, halogen, carboxyl, nitro and heterocyclic groups. More preferred substituents are alkyl, alkoxy, aryl, alkylthio, acetyl, acylamino, imino, sulfamoyl, sulfonylamino, ureido, amino, and heterocyclic groups. Further preferred substituents are alkyl, alkoxy, aryl, alkylthio, acetyl, acylamino, imino, ureido, amino, and heterocyclic groups.

$W^1$ and $W^2$ are divalent linking groups each containing at least one of oxygen, sulfur and nitrogen atoms, examples of the divalent linking groups being shown below. Combinations of these groups are also included. The divalent linking group may partially form a heterocycle, and further the divalent linking group may form a heterocycle with $Z^1$ or $Z^2$.

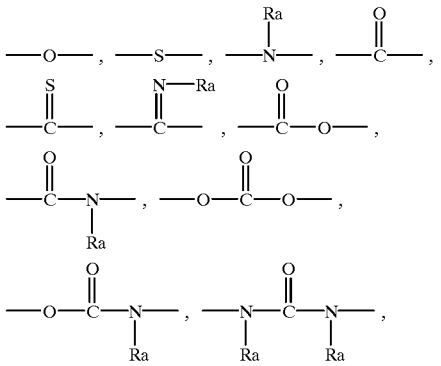

-continued

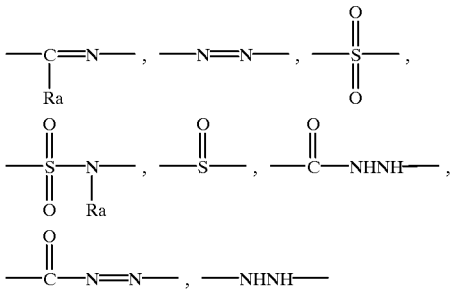

Herein, Ra is hydrogen or a monovalent substituent. Examples of the monovalent substituent are the same as the substituents on $L^1$ and $L^2$. Ra is preferably hydrogen, alkyl or aryl groups.

$Z^1$ is a hydrogen, halogen, aliphatic hydrocarbon, aromatic or heterocyclic group, and $Z^2$ is an aromatic or heterocyclic group.

The halogen atoms represented by $Z^1$ include fluorine, bromine and iodine atoms.

The aliphatic hydrocarbon groups represented by $Z^1$ include normal, branched or cyclic alkyl groups, preferably having 1 to 20 carbon atoms, more preferably 1 to 16 carbon atoms, most preferably 1 to 12 carbon atoms, alkenyl groups, preferably having 2 to 20 carbon atoms, more preferably 2 to 16 carbon atoms, most preferably 2 to 12 carbon atoms, for example, and alkynyl groups, preferably having 2 to 20 carbon atoms, more preferably 2 to 16 carbon atoms, most preferably 2 to 12 carbon atoms, which may have substituents.

The preferred aliphatic hydrocarbon groups represented by $Z^1$ are alkyl groups, more preferably chain alkyl groups.

The aromatic groups represented by $Z^1$ and $Z^2$ are preferably those of 6 to 30 carbon atoms, more preferably monocyclic or fused ring aryl groups of 6 to 20 carbon atoms, for example, phenyl and naphthyl, with the phenyl being especially preferred.

The heterocyclic groups represented by $Z^1$ and $Z^2$ are 3- to 10-membered, saturated or unsaturated, heterocyclic groups each containing at least one atom selected from nitrogen (N), oxygen (O) and sulfur (S). The heterocycle in these groups may be monocyclic or may form a fused ring with another ring.

The heterocycles in these heterocyclic groups are preferably 5- or 6-membered aromatic heterocycles and benzo-fused rings thereof, more preferably 5- or 6-membered nitrogenous aromatic heterocycles and benzo-fused rings thereof, further preferably 5- or 6-membered aromatic heterocycles containing one or two nitrogen atoms and benzo-fused rings thereof.

Illustrative examples of the heterocyclic group include monovalent groups derived from pyrrolidine, piperidine, piperazine, morpholine, thiophene, furan, pyrrole, imidazole, pyrazole, pyridine, pyrazine, pyridazine, triazole, triazine, indole, indazole, purine, thiadiazole, oxadiazole, quinoline, phthalazine, naphthyridine, quinoxaline, quinazoline, cinnoline, pteridine, acridine, phenanthroline, phenazine, tetrazole, thiazole, oxazole, benzimidazole, benzoxazole, benzothiazole, benzothiazoline, benzotriazole, tetraazaindene, and carbazole. Preferred heterocyclic groups are monovalent groups derived from pyrrole, imidazole, pyrazole, pyridine, pyrazine, pyridazine, triazole, triazine, indole, indazole, thiadiazole, oxadiazole, quinoline, phthalazine, quinoxaline, quinazoline, cinnoline, acridine, tetrazole, thiazole, oxazole, benzimidazole, benzoxazole, benzothiazole, benzothiazoline, benzotriazole, tetraazaindene, and carbazole. More preferred are monovalent groups derived from imidazole, pyrazole, pyridine, pyrazine, indole, indazole, thiadiazole, oxadiazole, quinoline, thiazole, oxazole, benzimidazole, benzoxazole, benzothiazole, benzothiazoline, benzotriazole, tetraazaindene, and carbazole. Further preferred are monovalent groups derived from imidazole, pyridine, pyrazine, quinoline, thiazole, oxazole, benzimidazole, benzoxazole, benzothiazole, benzothiazoline, benzotriazole, and carbazole.

The aliphatic hydrocarbon, aromatic and heterocyclic groups represented by $Z^1$ and the aromatic and heterocyclic groups represented by $Z^2$ may have substituents which are as exemplified for the substituents on $L^1$ and $L^2$, with the preferred range being also the same. These substituents may be further substituted. Where there are two or more substituents, they may be identical or different.

$Z^1$ preferably represents aromatic or heterocyclic groups, and more preferably heterocyclic groups. $Z^2$ preferably represents heterocyclic groups.

Letter $m_1$ is an integer of 0 to 3, and $m_2$ is an integer of 0 to 3. When $m_1$ is equal to 2 or 3, the $W^1$ groups may be the same or different. When $m_2$ is equal to 2 or 3, the $W^2$ groups may be the same or different.

Preferred among the compounds of formula (I) are compounds of the following general formula (I-a).

$$Z^2—(W^2)_{m2}—L^2—S—S—L^2—(W^2)_{m2}—Z^2 \quad \text{(I-a)}$$

In formula (I-a), $L^2$, $Z^2$ and $m_2$ are as defined in formula (I), with the preferred ranges being also the same.

Preferred among the compounds of formula (I-a) are compounds of the following general formula (I-b).

(I-b)

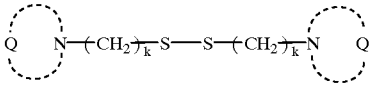

In formula (I-b), Q is a group of non-metallic atoms necessary to form a 5- to 7-membered heterocyclic ring with the nitrogen atom. This heterocyclic ring may be a fused heterocyclic ring. Letter k is equal to 1, 2, 3 or 4.

In formula (I-b), the heterocyclic ring formed by Q and the nitrogen atom may have a substituent, examples of which may be the same as the substituents on $L^1$ and $L^2$ in formula (I).

Preferred among the compounds of formula (I-b) are compounds of the following general formula (I-c).

(I-c)

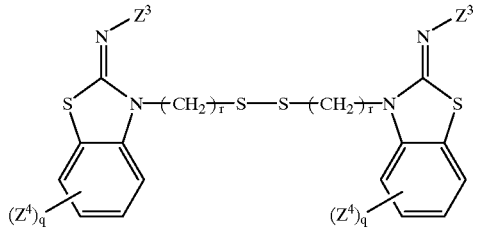

In formula (I-c), $Z^3$ is as defined for $Z^1$ in formula (I), $Z^4$ is as defined for the substituents on $L^1$ and $L^2$, q is an integer of 0 to 4, and r is an integer of 1 to 4.

Preferred examples of $Z^3$ and $Z^4$ in formula (I-c) are the same as the preferred examples described in the event where $Z^1$ represents aliphatic hydrocarbon, aromatic or heterocyclic groups, and the substituents thereon. $Z^3$ preferably represents aliphatic hydrocarbon and aromatic groups. Preferably q is equal to 0. When q is equal to or greater than 1, $Z^4$ represents alkoxy, alkylthio and amino groups.

$Z^3$ in formula (I-c) may have substituents, examples of which are the same as the substituents on $L^1$ and $L^2$ in formula (I).

Illustrative, non-limiting, examples of the compound of the general formula (I) are given below.

D-1

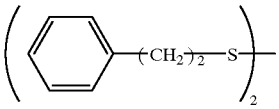

D-2

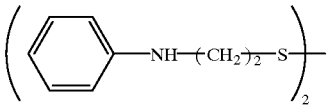

D-3

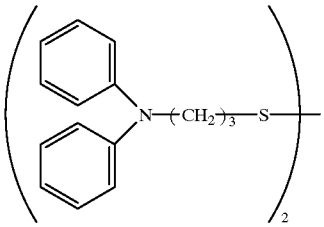

D-4

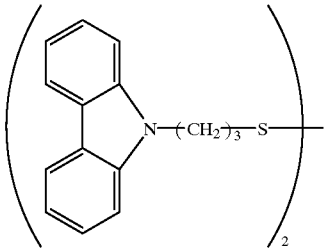

D-5

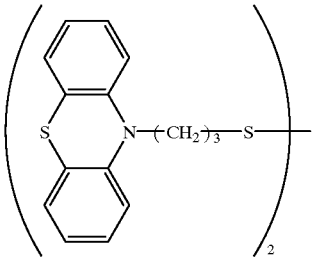

D-6

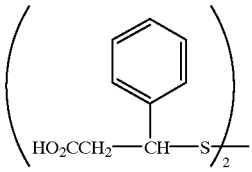

D-7

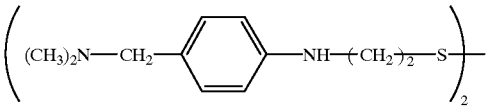

D-8

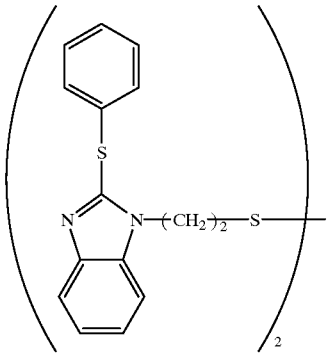

D-9

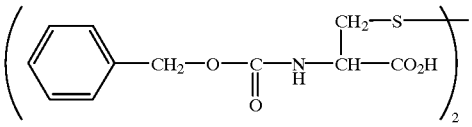

D-10

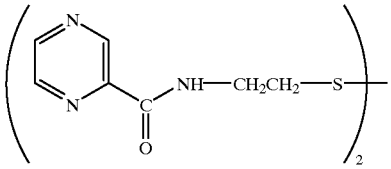

D-11

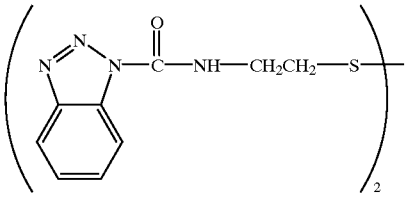

D-12

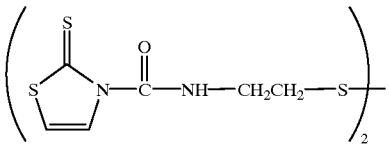

-continued
D-13
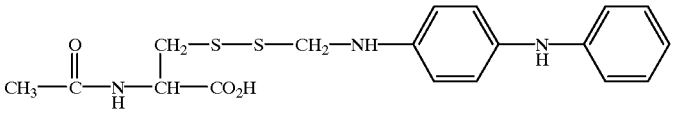
D-14
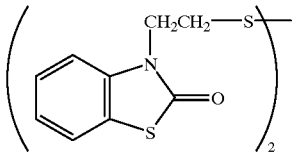
D-15
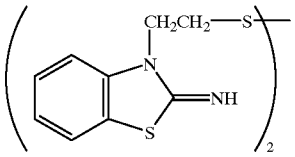
D-16
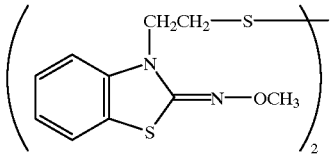
D-17
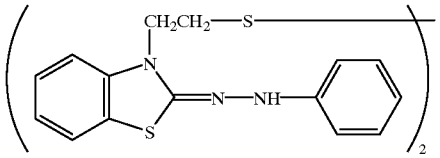
D-18
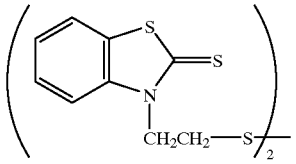
D-19
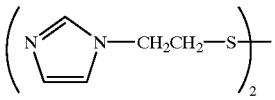
D-20
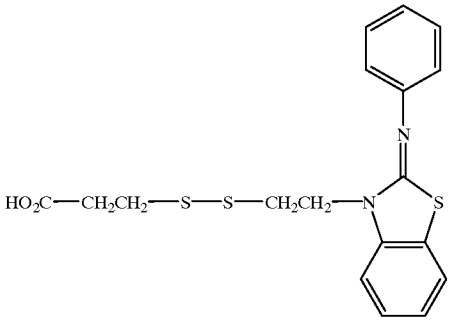
D-21
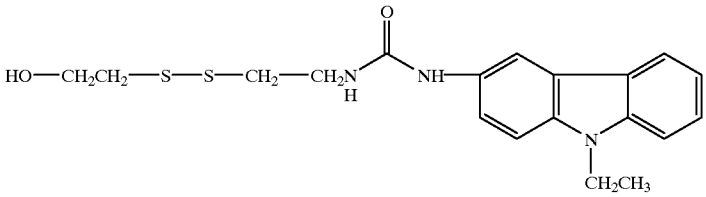
D-22
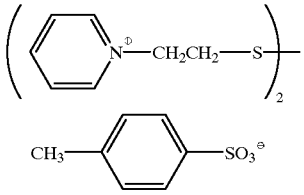
D-23
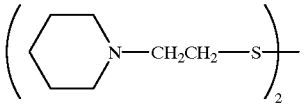
2HCl
D-24
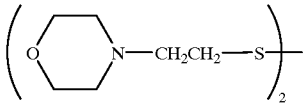
2HCl
D-25
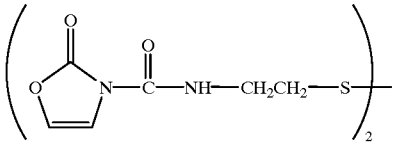

-continued
D-26
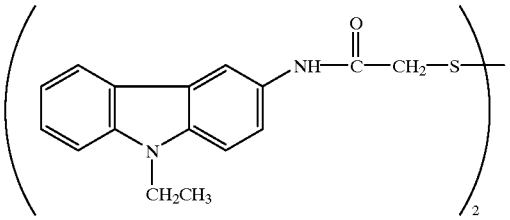
D-27
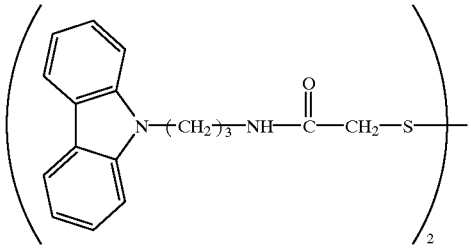
D-28
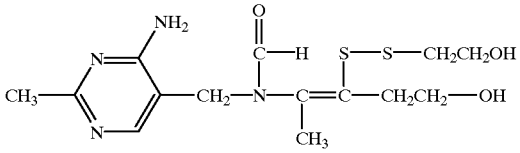
D-29
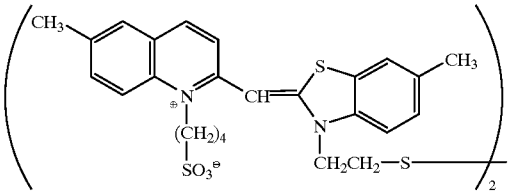
D-30
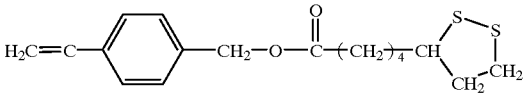
D-31
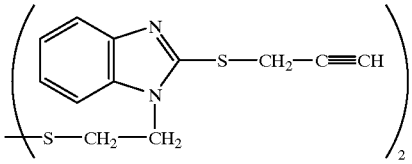
D-32
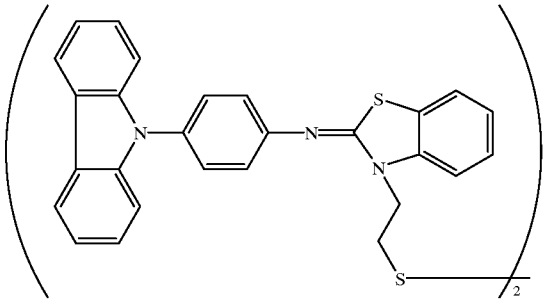
D-33
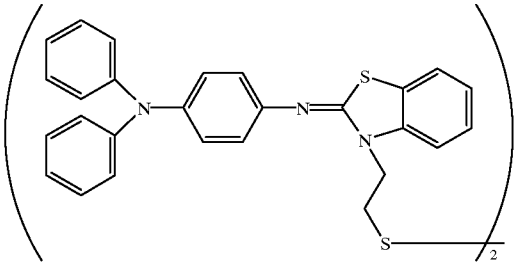
D-34
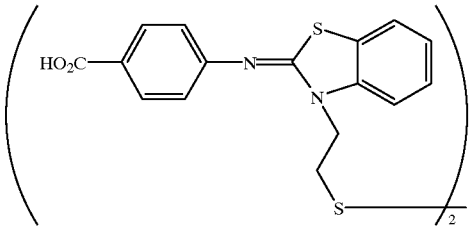
D-35
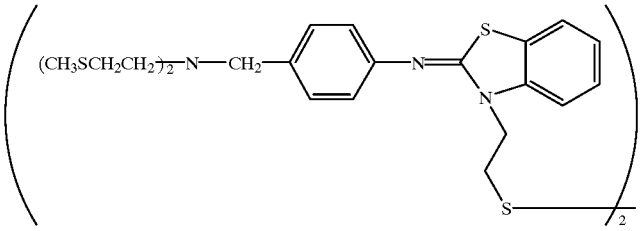

-continued
D-36
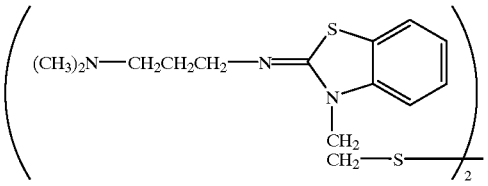
D-37
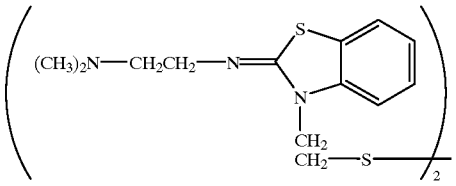
2HBr
D-38
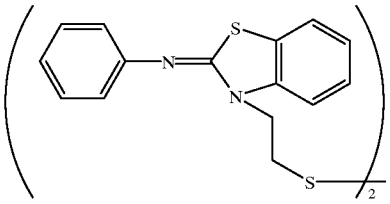
D-39
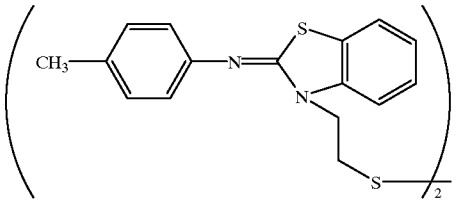
D-40
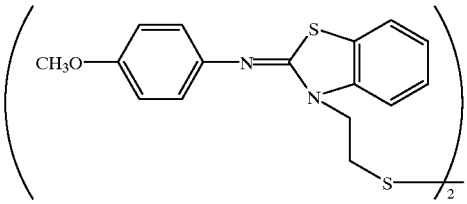
D-41
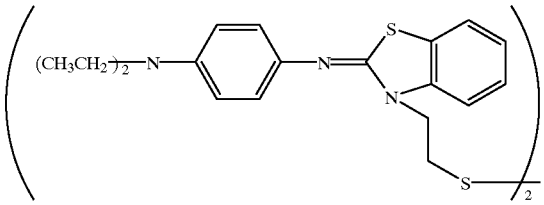
D-42
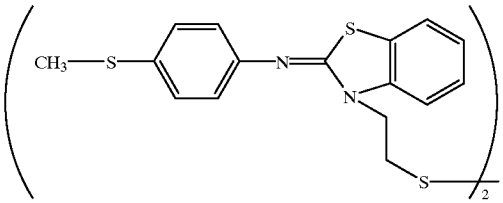
D-43
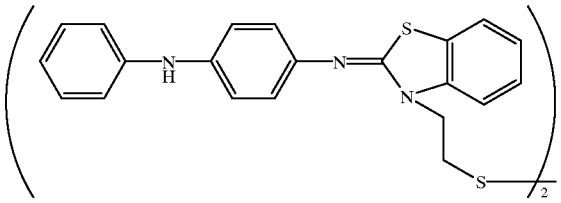
D-44
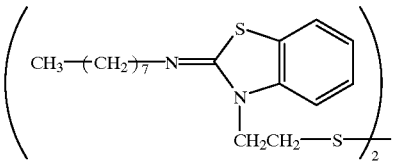
D-45
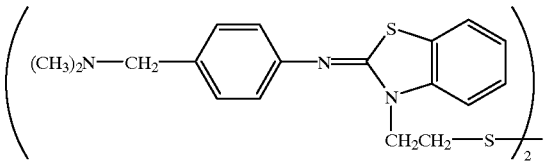
D-46
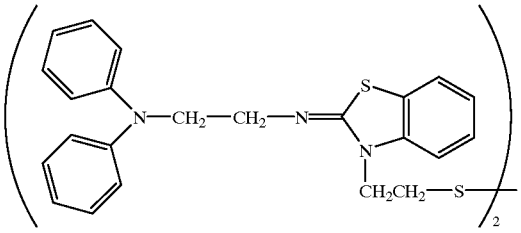
D-47
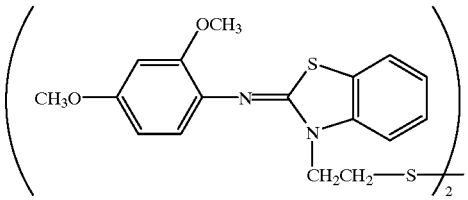

-continued
D-48
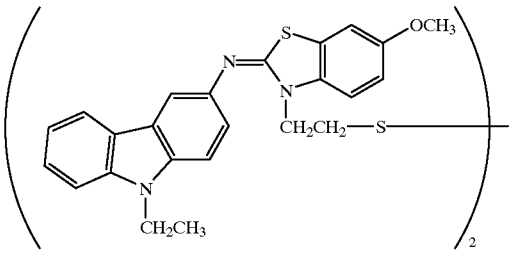
D-49
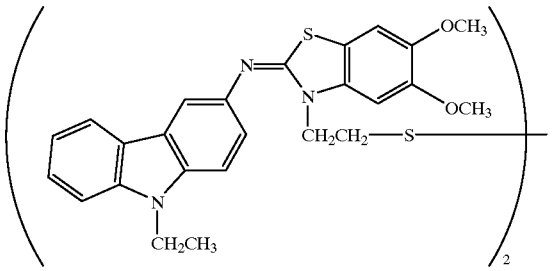
D-50
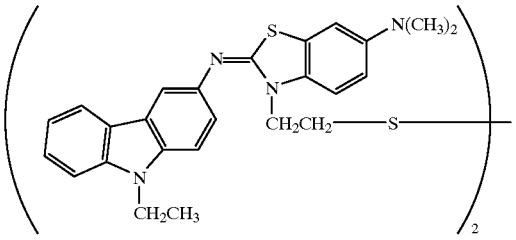
D-51
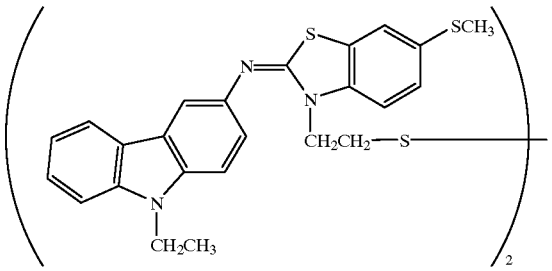
D-52
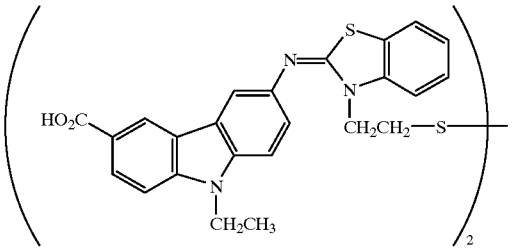
D-53
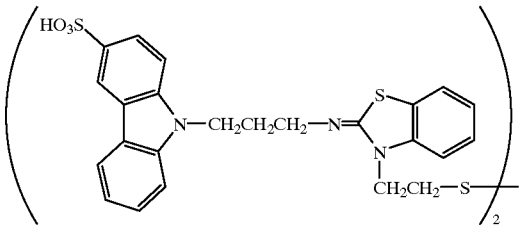
D-54
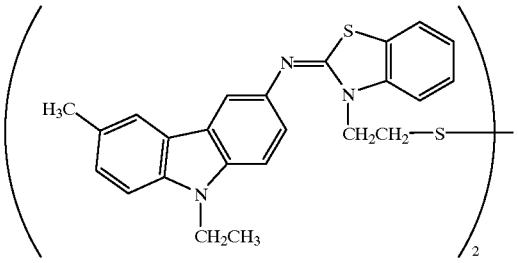
D-55
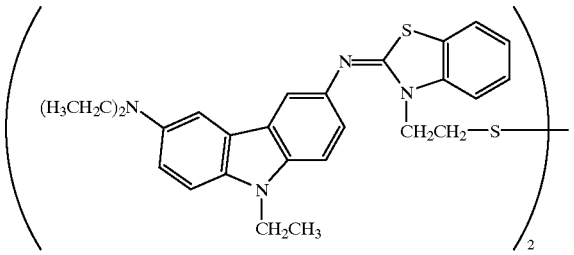
D-56
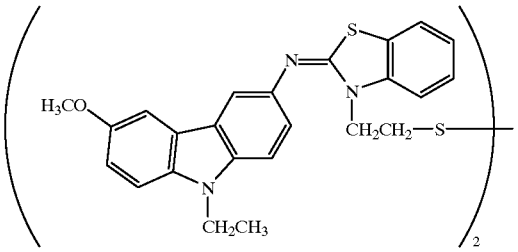
D-57
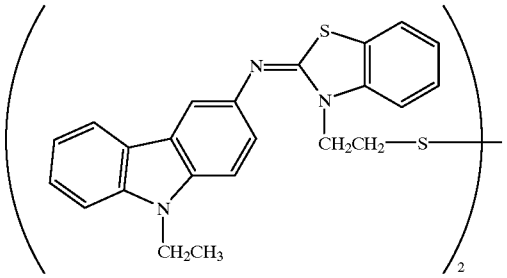

-continued

D-58

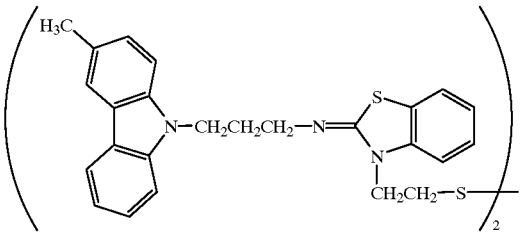

D-59

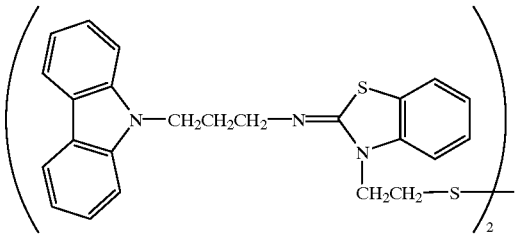

D-60

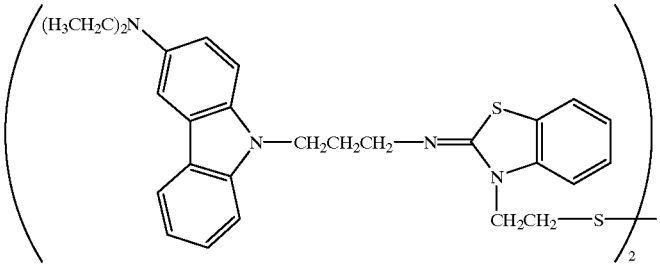

D-61

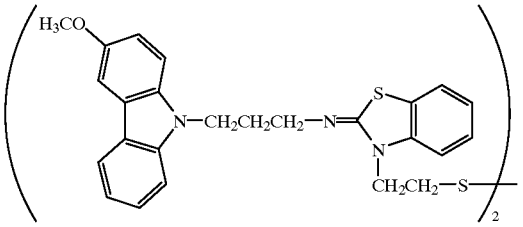

D-62

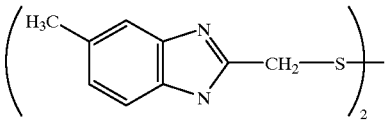

D-63

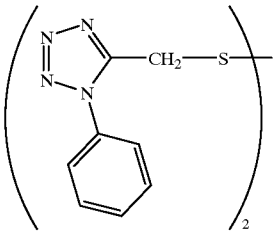

D-64

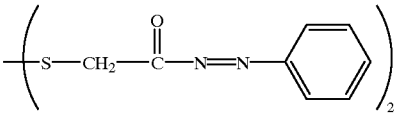

D-65

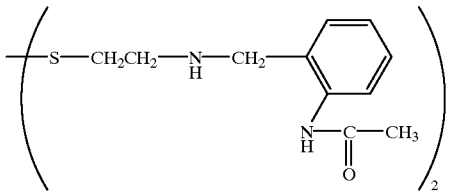

D-66

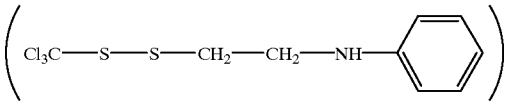

The compounds of formula (I) may be commercially available ones or synthesized by well-known methods. For example, they can be synthesized by the methods described in Japanese Chemical Society Ed., "New Experimental Chemistry Series," Vol. 14, III, pages 1735–1741, 1978.

In another embodiment where a contrast enhancer as will be described later is used, there may be used disulfides of the general formula (1).

$$Z_1—S—S—Z_2 \quad (1)$$

$Z_1$ is an aliphatic hydrocarbon or aryl group and $Z_2$ is an aryl group.

The aliphatic hydrocarbon groups represented by $Z_1$ in formula (1) include normal, branched or cyclic alkyl groups (preferably having 1 to 20 carbon atoms, more preferably 1 to 12 carbon atoms, most preferably 1 to 8 carbon atoms, such as methyl, ethyl, n-propyl, iso-propyl, n-butyl, sec-butyl, iso-butyl, tert-butyl, n-octyl, n-dodecyl, tert-amyl, and cyclohexyl), alkenyl groups (preferably having 2 to 20 carbon atoms, more preferably 2 to 12 carbon atoms, most preferably 2 to 8 carbon atoms, such as vinyl, allyl, 2-butenyl, and 3-pentenyl), and alkynyl groups (preferably having 2 to 20 carbon atoms, more preferably 2 to 12 carbon atoms, most preferably 2 to 8 carbon atoms, such as propargyl and 3-pentynyl), which may have substituents.

The aliphatic hydrocarbon groups represented by $Z_1$ are preferably alkyl groups, more preferably chain alkyl groups.

The aliphatic hydrocarbon groups may have substituents. Exemplary substituents include aryl groups, preferably having 6 to 30 carbon atoms, more preferably 6 to 20 carbon atoms, most preferably 6 to 12 carbon atoms, for example, phenyl, p-methylphenyl, and naphthyl; amino groups, preferably having 0 to 20 carbon atoms, more preferably 0 to 10 carbon atoms, most preferably 0 to 6 carbon atoms, for example, amino, methylamino, dimethylamino, diethylamino, and dibenzylamino; alkoxy groups, preferably having 1 to 20 carbon atoms, more preferably 1 to 12 carbon atoms, most preferably 1 to 8 carbon atoms, for example, methoxy, ethoxy, and butoxy; aryloxy groups, preferably having 6 to 20 carbon atoms, more preferably 6 to 16 carbon atoms, most preferably 6 to 12 carbon atoms, for example, phenyloxy and 2-naphthyloxy; acyl groups, preferably having 1 to 20 carbon atoms, more preferably 1 to 16 carbon atoms, most preferably 1 to 12 carbon atoms, for example, acetyl, benzoyl, formyl, and pivaloyl; alkoxycarbonyl groups, preferably having 2 to 20 carbon atoms, more preferably 2 to 16 carbon atoms, most preferably 2 to 12 carbon atoms, for example, methoxycarbonyl and ethoxycarbonyl; aryloxycarbonyl groups, preferably having 7 to 20 carbon atoms, more preferably 7 to 16 carbon atoms, most preferably 7 to 10 carbon atoms, for example, phenoxycarbonyl; acyloxy groups, preferably having 1 to 20 carbon atoms, more preferably 2 to 16 carbon atoms, most preferably 2 to 10 carbon atoms, for example, acetoxy and benzoyloxy; acylamino groups, preferably having 1 to 20 carbon atoms, more preferably 2 to 16 carbon atoms, most preferably 2 to 10 carbon atoms, for example, acetylamino, propionylamino, butyrylamino, valerylamino, and benzoylamino; alkoxycarbonylamino groups, preferably having 2 to 20 carbon atoms, more preferably 2 to 16 carbon atoms, most preferably 2 to 12 carbon atoms, for example, methoxycarbonylamino; aryloxycarbonylamino groups, preferably having 7 to 20 carbon atoms, more preferably 7 to 16 carbon atoms, most preferably 7 to 12 carbon atoms, for example, phenyloxycarbonylamino; sulfonylamino groups, preferably having 1 to 20 carbon atoms, more preferably 1 to 16 carbon atoms, most preferably 1 to 12 carbon atoms, for example, methanesulfonylamino, octanesulfonylamino and benzenesulfonylamino; sulfamoyl groups, preferably having 0 to 20 carbon atoms, more preferably 0 to 16 carbon atoms, most preferably 0 to 12 carbon atoms, for example, sulfamoyl, methylsulfamoyl, dimethylsulfamoyl, and phenylsulfamoyl; carbamoyl groups, preferably having 1 to 20 carbon atoms, more preferably 1 to 16 carbon atoms, most preferably 1 to 12 carbon atoms, for example, carbamoyl, diethylcarbamoyl, and phenylcarbamoyl; ureido groups, preferably having 1 to 20 carbon atoms, more preferably 1 to 16 carbon atoms, most preferably 1 to 12 carbon atoms, for example, ureido, methylureido, phenylureido, and naphthylureido; alkylthio groups, preferably having 1 to 20 carbon atoms, more preferably 1 to 16 carbon atoms, most preferably 1 to 12 carbon atoms, for example, methylthio and ethylthio; arylthio groups, preferably having 6 to 20 carbon atoms, more preferably 6 to 16 carbon atoms, most preferably 6 to 12 carbon atoms, for example, phenylthio; sulfonyl groups, preferably having 1 to 20 carbon atoms, more preferably 1 to 16 carbon atoms, most preferably 1 to 12 carbon atoms, for example, mesyl and tosyl; sulfinyl groups, preferably having 1 to 20 carbon atoms, more preferably 1 to 16 carbon atoms, most preferably 1 to 12 carbon atoms, for example, methanesulfinyl and benzenesulfinyl; thioureido groups, preferably having 1 to 20 carbon atoms, more preferably 1 to 16 carbon atoms, most preferably 1 to 12 carbon atoms, for example, thioureido, methylthioureido, and phenylthioureido; phosphoramide groups, preferably having 1 to 20 carbon atoms, more preferably 1 to 16 carbon atoms, most preferably 1 to 12 carbon atoms, for example, diethylphosphoramide, phenylphosphoramide, and diphenylphosphoramide; hydroxy groups; mercapto groups; halogen atoms such as fluorine, chlorine, bromine and iodine atoms; cyano groups; sulfo groups; carboxyl groups; nitro groups; hydroxamic groups; sulfino groups; hydrazino groups; sulfonylthio groups; thiosulfonyl groups; heterocyclic groups such as imidazolyl, pyridyl, furyl, piperidyl, morpholinyl, oxolanyl, and 1,3-dione-isoindolyl; and disulfide groups. Among the foregoing groups, hydroxy, mercapto, sulfo, sulfino, carboxyl, phosphono, and phosphino groups may form salts. These substituents may be further substituted. Where there are two or more substituents, they may be identical or different.

Preferred substituents on the aliphatic hydrocarbon groups represented by $Z_1$ are halogen, aryl, alkoxy, heterocyclic, cyano, acyl, alkoxycarbonyl, sulfamoyl, carbamoyl, carboxyl, sulfo, hydroxy, and nitro groups. More preferred substituents are halogen, aryl, carboxyl, alkoxycarbonyl, hydroxy, heterocyclic, cyano, acyl, and nitro groups.

The aryl groups represented by $Z_1$ and $Z_2$ are preferably monocyclic or fused ring aryl groups of 6 to 30 carbon atoms, more preferably monocyclic or fused ring aryl groups of 6 to 20 carbon atoms, for example, phenyl and naphthyl, with the phenyl being especially preferred. $Z_1$ and $Z_2$ may be the same or different. The aryl groups represented by $Z_1$ and $Z_2$ may have substituents, examples of which include the above-described substituents on the aliphatic hydrocarbon groups represented by $Z_1$ as well as alkyl groups (preferably having 1 to 20 carbon atoms, more preferably 1 to 12 carbon atoms, most preferably 1 to 8 carbon atoms, such as methyl, ethyl, iso-propyl, tert-butyl, n-octyl, tert-amyl, and cyclohexyl), alkenyl groups (preferably having 2 to 20 carbon atoms, more preferably 2 to 12 carbon atoms, most preferably 2 to 8 carbon atoms, such as vinyl, allyl, 2-butenyl, and 3-pentenyl), and alkynyl groups (preferably having 2 to 20 carbon atoms, more preferably 2 to 12 carbon atoms, most preferably 2 to 8 carbon atoms, such as propargyl and 3-pentynyl).

Preferred substituents on aryl groups represented by $Z_1$ and $Z_2$ are alkyl, alkoxy, aryloxy, acyl, alkoxycarbonyl, acylamino, alkoxycarbonylamino, aryloxycarbonylamino, sulfonylamino, carbamoylamino, carbamoyl, sulfamoyl, ureido, alkylthio, arylthio, sulfinyl, sulfonylthio, thiosulfonyl, thioureido, carboxyl, sulfo, hydroxy, halogen, cyano, nitro, heterocyclic, and phosphoramide groups. More preferred substituents are alkyl, alkoxy, alkoxycarbonyl, carbamoyl, sulfamoyl, aryloxycarbonylamino, sulfonylamino, ureido, thioureido, acylamino, halogen, cyano, hydroxy, carboxyl, nitro, heterocyclic, and phosphoramide groups.

Illustrative, non-limiting, examples of the compound of the general formula (1) are given below.

(D-1)

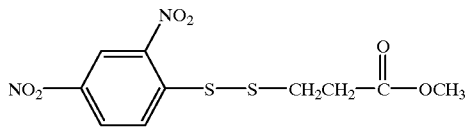

-continued
(D-2)
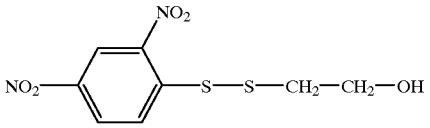
(D-3)
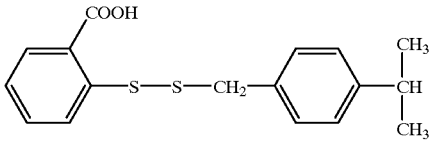
(D-4)
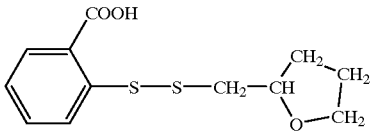
(D-5)
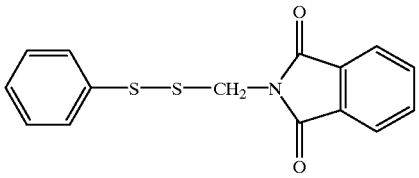
(D-6)
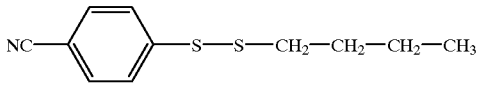
(D-7)
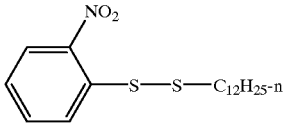
(D-8)
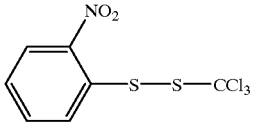
(D-9)
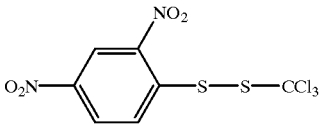
(D-10)
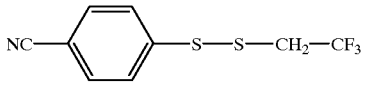
(D-11)
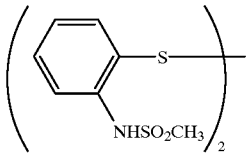
-continued
(D-12)
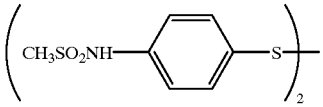
(D-13)
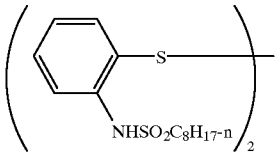
(D-14)
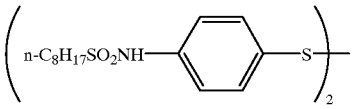
(D-15)
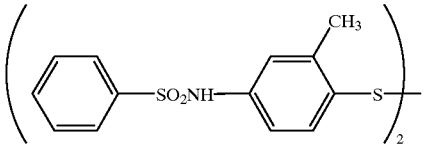
(D-16)
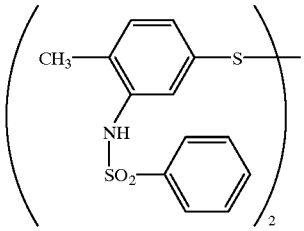
(D-17)
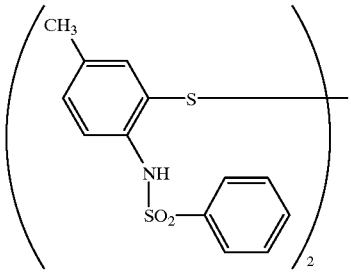
(D-18)
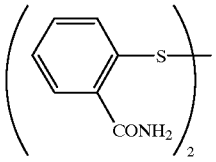
(D-19)
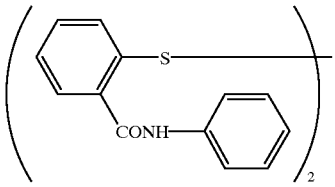

-continued
(D-20)
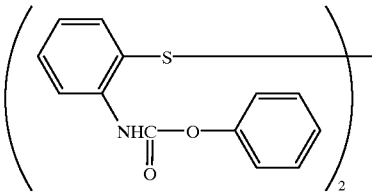
(D-21)
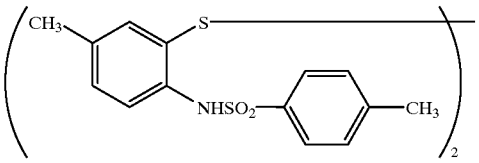
(D-22)
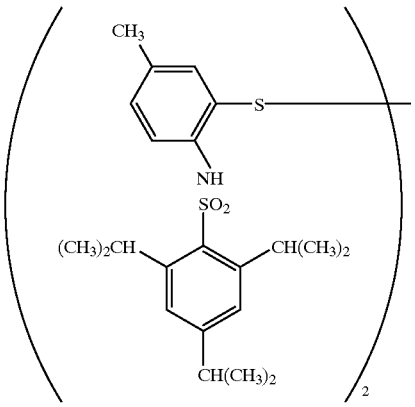
(D-23)
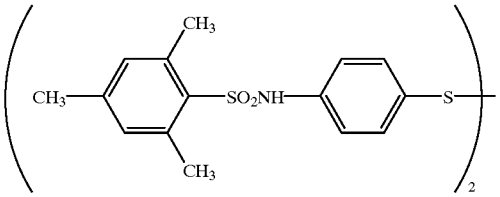
(D-24)
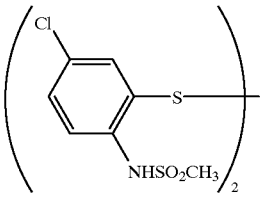
(D-25)
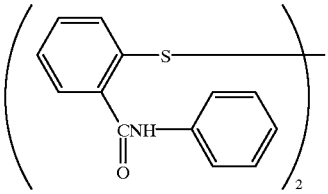
-continued
(D-26)
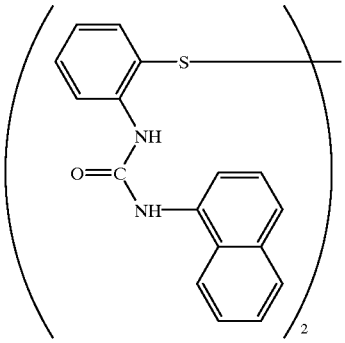
(D-27)
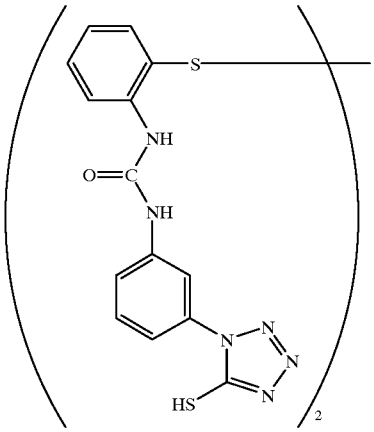
(D-28)
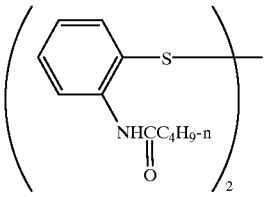
(D-29)
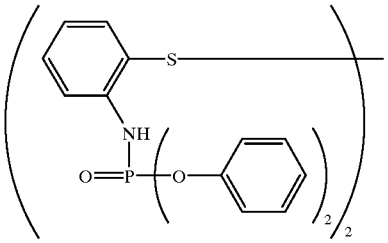
(D-30)
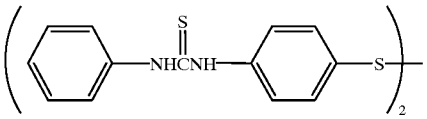
(D-31)
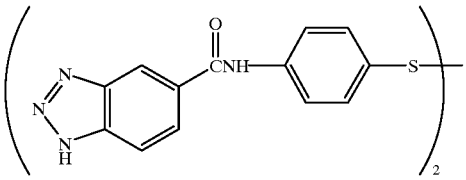

-continued (D-32)

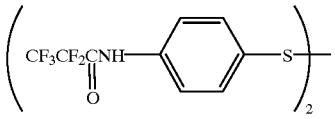

(D-33)

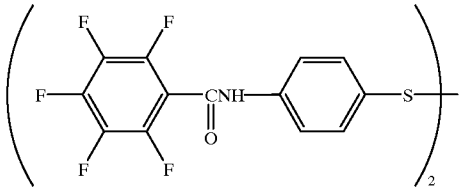

(D-34)

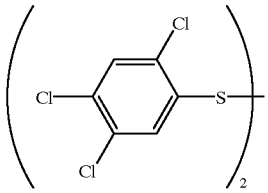

(D-35)

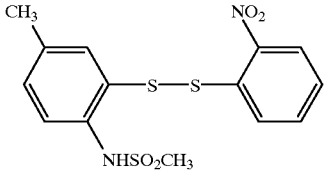

(D-36)

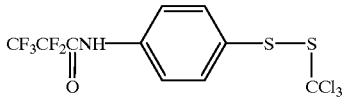

(D-37)

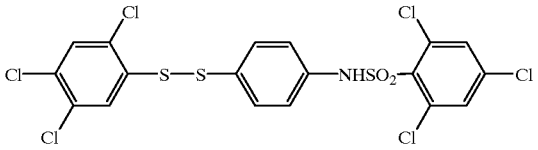

In a further embodiment where a contrast enhancer as will be described later is used, there may be used disulfides of the general formula (2):

$$Z_1—S—S—Z_2 \quad (2)$$

wherein $Z_1$ is an aliphatic hydrocarbon, aryl or heterocyclic group and $Z_2$ is a heterocyclic group.

The aliphatic hydrocarbon groups represented by $Z_1$ in formula (2) include normal, branched or cyclic alkyl groups (preferably having 1 to 20 carbon atoms, more preferably 1 to 12 carbon atoms, most preferably 1 to 8 carbon atoms, such as methyl, ethyl, iso-propyl, tert-butyl, n-octyl, tert-amyl, and cyclohexyl), alkenyl groups (preferably having 2 to 20 carbon atoms, more preferably 2 to 12 carbon atoms, most preferably 2 to 8 carbon atoms, such as vinyl, allyl, 2-butenyl, and 3-pentenyl), and alkynyl groups (preferably having 2 to 20 carbon atoms, more preferably 2 to 12 carbon atoms, most preferably 2 to 8 carbon atoms, such as propargyl and 3-pentynyl), which may have substituents.

The aliphatic hydrocarbon groups may have substituents. Exemplary substituents include aryl groups, preferably having 6 to 30 carbon atoms, more preferably 6 to 20 carbon atoms, most preferably 6 to 12 carbon atoms, for example, phenyl, p-methylphenyl, and naphthyl; amino groups, preferably having 0 to 20 carbon atoms, more preferably 0 to 10 carbon atoms, most preferably 0 to 6 carbon atoms, for example, amino, methylamino, dimethylamino, diethylamino, and dibenzylamino; alkoxy groups, preferably having 1 to 20 carbon atoms, more preferably 1 to 12 carbon atoms, most preferably 1 to 8 carbon atoms, for example, methoxy, ethoxy, and butoxy; aryloxy groups, preferably having 6 to 20 carbon atoms, more preferably 6 to 16 carbon atoms, most preferably 6 to 12 carbon atoms, for example, phenyloxy and 2-naphthyloxy; acyl groups, preferably having 1 to 20 carbon atoms, more preferably 1 to 16 carbon atoms, most preferably 1 to 12 carbon atoms, for example, acetyl, benzoyl, formyl, and pivaloyl; alkoxycarbonyl groups, preferably having 2 to 20 carbon atoms, more preferably 2 to 16 carbon atoms, most preferably 2 to 12 carbon atoms, for example, methoxycarbonyl and ethoxycarbonyl; aryloxycarbonyl groups, preferably having 7 to 20 carbon atoms, more preferably 7 to 16 carbon atoms, most preferably 7 to 10 carbon atoms, for example, phenoxycarbonyl; acyloxy groups, preferably having 1 to 20 carbon atoms, more preferably 2 to 16 carbon atoms, most preferably 2 to 10 carbon atoms, for example, acetoxy and benzoyloxy; acylamino groups, preferably having 1 to 20 carbon atoms, more preferably 2 to 16 carbon atoms, most preferably 2 to 10 carbon atoms, for example, acetylamino, propionylamino, and benzoylamino; alkoxycarbonylamino groups, preferably having 2 to 20 carbon atoms, more preferably 2 to 16 carbon atoms, most preferably 2 to 12 carbon atoms, for example, methoxycarbonylamino; aryloxycarbonylamino groups, preferably having 7 to 20 carbon atoms, more preferably 7 to 16 carbon atoms, most preferably 7 to 12 carbon atoms, for example, phenyloxycarbonylamino; sulfonylamino groups, preferably having 1 to 20 carbon atoms, more preferably 1 to 16 carbon atoms, most preferably 1 to 12 carbon atoms, for example, methanesulfonylamino and benzenesulfonylamino; sulfamoyl groups, preferably having 0 to 20 carbon atoms, more preferably 0 to 16 carbon atoms, most preferably 0 to 12 carbon atoms, for example, sulfamoyl, methylsulfamoyl, dimethylsulfamoyl, and phenylsulfamoyl; carbamoyl groups, preferably having 1 to 20 carbon atoms, more preferably 1 to 16 carbon atoms, most preferably 1 to 12 carbon atoms, for example, carbamoyl, diethylcarbamoyl, and phenylcarbamoyl; ureido groups, preferably having 1 to 20 carbon atoms, more preferably 1 to 16 carbon atoms, most preferably 1 to 12 carbon atoms, for example, ureido, methylureido, and phenylureido; alkylthio groups, preferably having 1 to 20 carbon atoms, more preferably 1 to 16 carbon atoms, most preferably 1 to 12 carbon atoms, for example, methylthio and ethylthio; arylthio groups, preferably having 6 to 20 carbon atoms, more preferably 6 to 16 carbon atoms, most preferably 6 to 12 carbon atoms, for example, phenylthio; sulfonyl groups, preferably having 1 to 20 carbon atoms, more preferably 1 to 16 carbon atoms, most preferably 1 to 12 carbon atoms, for example, mesyl and tosyl; sulfinyl groups, preferably having 1 to 20 carbon atoms, more preferably 1 to 16 carbon atoms, most preferably 1 to 12 carbon atoms, for example, methanesulfinyl and benzenesulfinyl; phosphoramide groups, preferably having 1 to 20 carbon atoms, more preferably 1 to 16 carbon atoms, most preferably 1 to 12 carbon atoms, for example, diethylphosphoramide and phenylphosphoramide; hydroxy groups; mercapto groups; halogen atoms such as fluorine, chlorine, bromine and iodine atoms; cyano groups; sulfo groups; carboxyl groups; nitro groups; hydroxamic groups; sulfino groups; hydrazino groups; sulfonylthio groups; thiosulfonyl groups; heterocyclic groups such as imidazolyl, pyridyl, furyl, piperidyl, and morpholyl; and disulfide groups. Among the foregoing groups, hydroxy, mercapto, sulfo, sulfino, carboxyl, phosphono, and phosphino groups may form salts. These substituents may be further substituted. Where there are two or more substituents, they may be identical or different.

Preferred substituents on the aliphatic hydrocarbon groups represented by $Z_1$ are hydroxy, carboxyl, halogen, aryl, alkoxy, heterocyclic, cyano, acyl, alkoxycarbonyl, sulfamoyl, carbamoyl, sulfonyl, and nitro groups. More preferred substituents are halogen, hydroxy, carboxyl, heterocyclic, cyano, acyl, sulfonyl, and nitro groups.

The aliphatic hydrocarbon groups represented by $Z_1$ are preferably alkyl groups, more preferably chain alkyl groups.

The aryl groups represented by $Z_1$ are preferably monocyclic or fused ring aryl groups of 6 to 30 carbon atoms, more preferably monocyclic or fused ring aryl groups of 6 to 20 carbon atoms, for example, phenyl and naphthyl, with the phenyl being especially preferred. The aryl groups represented by $Z_1$ may have substituents, examples of which include the above-described substituents on the aliphatic hydrocarbon groups represented by $Z_1$ as well as alkyl groups (preferably having 1 to 20 carbon atoms, more preferably 1 to 12 carbon atoms, most preferably 1 to 8 carbon atoms, such as methyl, ethyl, iso-propyl, tert-butyl, n-octyl, tert-amyl, and cyclohexyl), alkenyl groups (preferably having 2 to 20 carbon atoms, more preferably 2 to 12 carbon atoms, most preferably 2 to 8 carbon atoms, such as vinyl, allyl, 2-butenyl and 3-pentenyl), and alkynyl groups (preferably having 2 to 20 carbon atoms, more preferably 2 to 12 carbon atoms, most preferably 2 to 8 carbon atoms, such as propargyl and 3-pentynyl).

Preferred substituents on aryl groups represented by $Z_1$ are alkyl, aryl, alkoxy, aryloxy, acyl, alkoxycarbonyl, acyloxy, acylamino, alkoxycarbonylamino, aryloxycarbonylamino, sulfonylamino, sulfamoylamino, carbamoylamino, ureido, alkylthio, arylthio, sulfonyl, sulfinyl, sulfonylthio, thiosulfonyl, phosphoramide, halogen, cyano, sulfo, nitro, and heterocyclic groups. More preferred substituents are alkyl, alkoxy, aryloxy, acyl, alkoxycarbonyl, acyloxy, acylamino, alkoxycarbonylamino, aryloxycarbonylamino, sulfonylamino, carbamoyl, ureido, alkylthio, arylthio, sulfonyl, sulfinyl, phosphoramide, halogen, and heterocyclic groups. Further preferred substituents are alkyl, alkoxy, aryloxy, acylamino, sulfonylamino, sulfamoyl, carbamoyl, ureido, phosphoramide, halogen, and heterocyclic groups. Most preferred substituents are halogen, alkyl, alkoxy, aryloxy, acylamino, sulfonylamino, sulfamoyl, carbamoyl, and ureido groups.

The heterocyclic groups represented by $Z_1$ and $Z_2$ are 3- to 10-membered, saturated or unsaturated, heterocyclic groups each containing at least one atom selected from nitrogen (N), oxygen (O) and sulfur (S). The heterocyclic groups may be monocyclic or may form a fused ring with another ring. The heterocyclic groups are preferably 5- or 6-membered nitrogenous heterocyclic groups, more preferably 5- or 6-membered heterocyclic groups containing one to four nitrogen atoms.

Illustrative examples of the heterocyclic group include thienyl, furyl, pyranyl, 2H-pyrrolyl, pyrrolyl, imidazolyl, pyrazolyl, isothiazolyl, isooxazolyl, thiazolyl, oxazolyl, 1,2,3-triazolyl, 1,2,4-triazolyl, 1,3,4-oxadiazolyl, 1,3,4-thiadiazolyl, pyridyl, pyrazinyl, pyrimidinyl, pyridazinyl, indolizinyl, isoindolizinyl, 3H-indolyl, indolyl, 1H-indazolyl, purinyl, 4H-quinolizinyl, isoquinolyl, quinolyl, phthalazinyl, naphthyridinyl, quinoxalinyl, quinazolinyl, cinnolinyl, pteridinyl, carbazolyl, β-carbonylyl, phenanthridinyl, acridinyl, perimidinyl, phenanthrolinyl, phenazinyl, phenarsazinyl, phenothiazinyl, furazanyl, phenoxazinyl, isochromanyl, chromanyl, pyrrolidinyl, oxoranyl, pyrrolinyl, imidazolidinyl, imidazolinyl, pyrazolidinyl, pyrazolinyl, piperidyl, piperazinyl, indolinyl, isoindolinyl, quinuclidinyl, morpholinyl, tetrazolyl, benzimidazolyl, benzoxazolyl, benzthiazolyl, benztriazolyl, triazinyl, uracil, and triazopyrimidinyl.

Preferred heterocyclic groups are pyrrolyl, imidazolyl, pyrazolyl, thiazolyl, oxazolyl, 1,2,3-triazolyl, 1,2,4-triazolyl, 1,3,4-oxadiazolyl, 1,3,4-thiadiazolyl, pyridyl, pyrazinyl, pyrimidinyl, pyridazinyl, indolyl, 1H-indazolyl, purinyl, 4H-quinolizinyl, isoquinolyl, quinolyl, phthalazinyl, naphthyridinyl, quinoxalinyl, quinazolinyl, cinnolinyl, pteridinyl, tetrazolyl, benzimidazolyl, benzoxazolyl, benzthiazolyl, benztriazolyl, triazinyl, uracil, and triazopyrimidinyl.

More preferred heterocyclic groups are imidazolyl, pyrazolyl, thiazolyl, oxazolyl, 1,2,3-triazolyl, 1,2,4-triazolyl, 1,3,4-oxadiazolyl, 1,3,4-thiadiazolyl, pyridyl, pyrazinyl, pyrimidinyl, pyridazinyl, indolyl, 1H-indazolyl, purinyl, quinolyl, phthalazinyl, naphthyridinyl, quinoxalinyl, quinazolinyl, cinnolinyl, pteridinyl, tetrazolyl, benzimidazolyl, benzoxazolyl, benzthiazolyl, benztriazolyl, triazinyl, uracil, and triazopyrimidinyl.

Further preferred heterocyclic groups are imidazolyl, thiazolyl, oxazolyl, 1,2,3-triazolyl, 1,2,4-triazolyl, 1,3,4-oxadiazolyl, 1,3,4-thiadiazolyl, pyridyl, quinolyl, tetrazolyl, benzimidazolyl, benzoxazolyl, benzthiazolyl, benztriazolyl, triazinyl, uracil, and triazopyrimidinyl.

The heterocyclic groups represented by $Z_1$ and $Z_2$ may have substituents, examples of which include the aforementioned substituents on the aliphatic hydrocarbon groups represented by $Z_1$ as well as alkyl groups (preferably having 1 to 20 carbon atoms, more preferably 1 to 12 carbon atoms, most preferably 1 to 8 carbon atoms, such as methyl, ethyl, iso-propyl, tert-butyl, n-octyl, tert-amyl, and cyclohexyl), alkenyl groups (preferably having 2 to 20 carbon atoms, more preferably 2 to 12 carbon atoms, most preferably 2 to 8 carbon atoms, such as vinyl, allyl, 2-butenyl, and 3-2 pentenyl), and alkynyl groups (preferably having 2 to 20 carbon atoms, more preferably 2 to 12 carbon atoms, most preferably 2 to 8 carbon atoms, such as propargyl and 3-pentynyl).

Preferred substituents on the heterocyclic groups represented by $Z_1$ and $Z_2$ are alkyl, aryl, alkoxy, aryloxy, acyl, alkoxycarbonyl, acyloxy, acylamino, sulfonylamino, sulfamoylamino, carbamoyl, ureido, alkylthio, arylthio, sulfonyl, sulfinyl, sulfonylthio, halogen, cyano, nitro and heterocyclic groups. More preferred substituents are alkyl, aryl, alkoxy, acyl, alkoxycarbonyl, acyloxy, acylamino, sulfonylamino, sulfamoyl, sulfonylthio, carbamoyl, ureido, and heterocyclic groups. Further preferred substituents are alkyl, aryl, alkoxy, acyl, aryloxy, acylamino, sulfonylamino, sulfamoyl, carbamoyl, ureido, phosphoramide, and heterocyclic groups. Most preferred substituents are alkyl, aryl, alkoxy, aryloxy, acylamino, sulfonylamino, sulfamoyl, sulfonylthio, carbamoyl, ureido, and heterocyclic groups.

Illustrative, non-limiting, examples of the compound of the general formula (2) are given below.

(S-1)
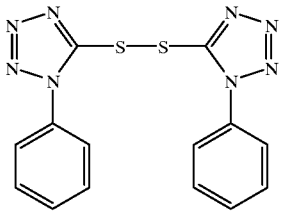
(S-2)
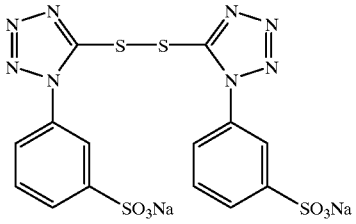
(S-3)
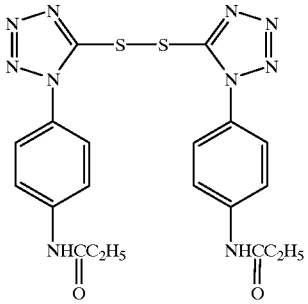
(S-4)
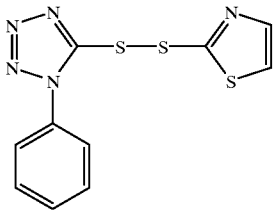
(S-5)
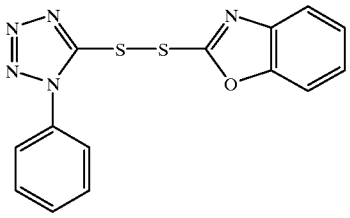
(S-6)
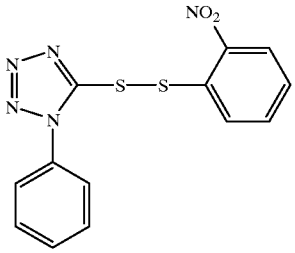
-continued
(S-7)
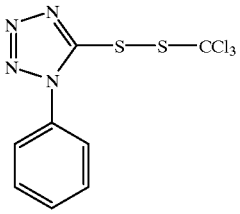
(S-8)
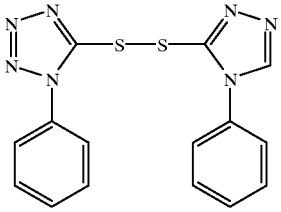
(S-9)
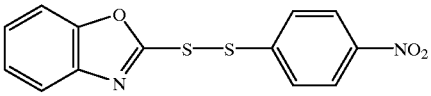
(S-10)
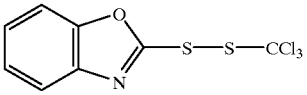
(S-11)
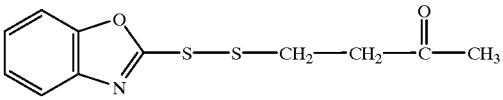
(S-12)
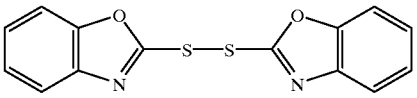
(S-13)
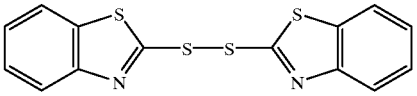
(S-14)
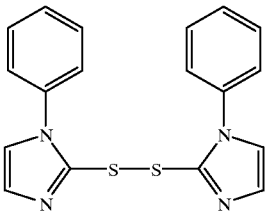
(S-15)
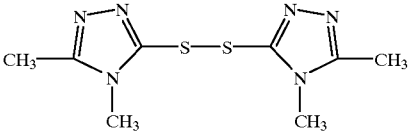

-continued
(S-16)
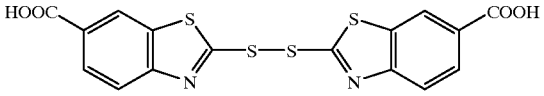
(S-17)
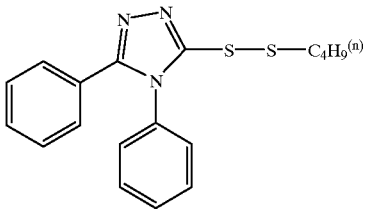
(S-18)
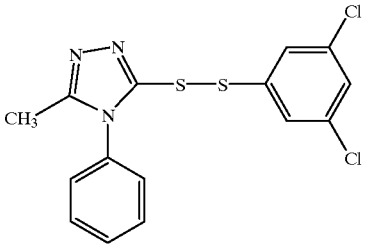
(S-19)
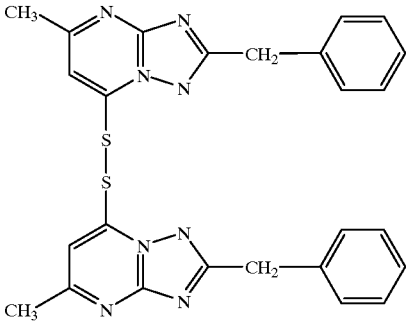
(S-20)
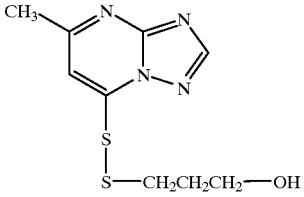
(S-21)
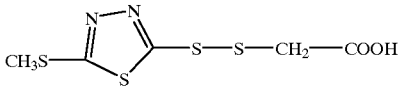
(S-22)
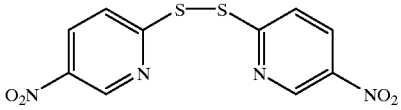
-continued
(S-23)
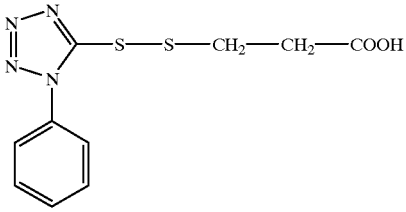
(S-24)
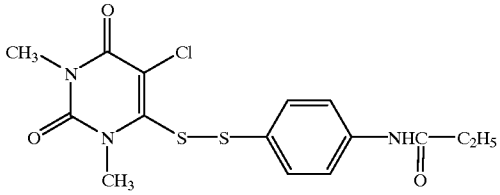
(S-25)
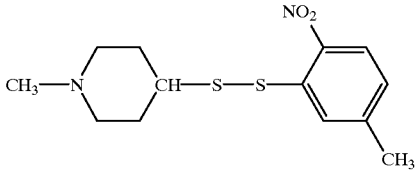
(S-26)
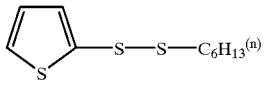
(S-27)
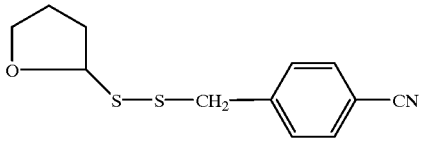
(S-28)
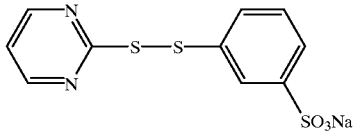
(S-29)
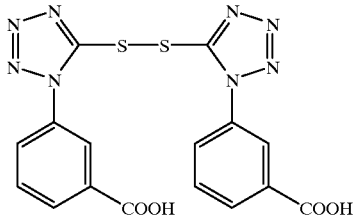
(S-30)
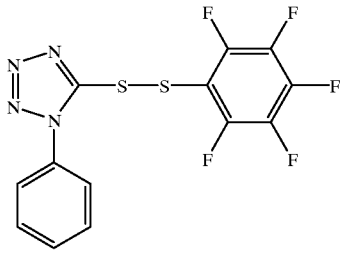

-continued (S-31)

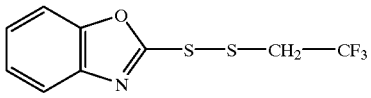

(S-32)

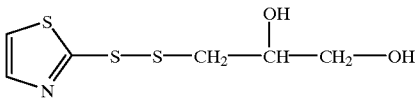

(S-33)

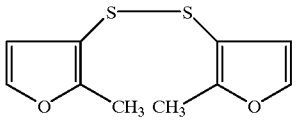

(S-34)

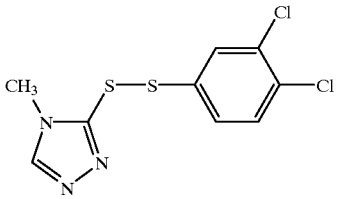

(S-35)

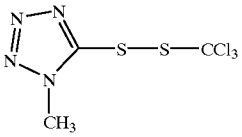

(S-36)

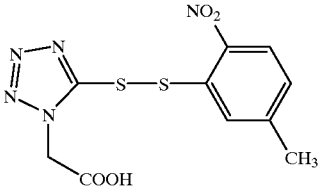

(S-37)

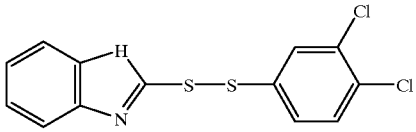

(S-38)

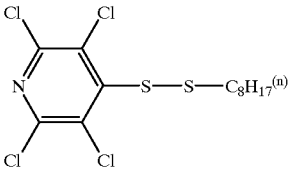

(S-39)

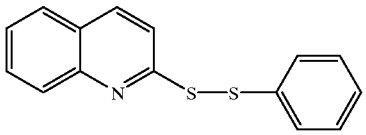

-continued (S-40)

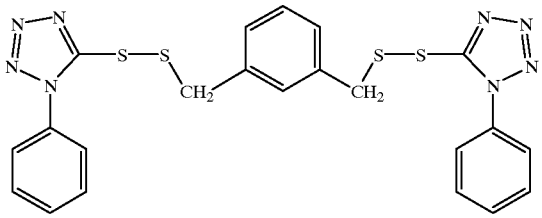

(S-41)

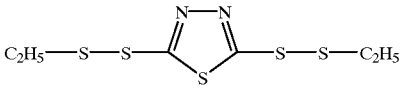

The compounds of formula (2) may be commercially available ones or synthesized by well-known methods. For example, they can be synthesized by the methods described in Kagaku Dojin Ed., "Organic Sulfur Chemistry (Synthetic Reaction)," pages 85–120, for example, oxidation reaction of thiols, reaction of sulfinyl chloride with thiols, reaction of thiol sulfonates with thiols, and reaction of Bunte salts with thiols.

In the practice of the invention, the disulfide compounds of formulae (I), (1) and (2) are used as solutions in water or suitable organic solvents. Suitable solvents include alcohols (e.g., methanol, ethanol, propanol, and fluorinated alcohols), ketones (e.g., acetone and methyl ethyl ketone), dimethylformamide, dimethylsulfoxide and methyl cellosolve.

A well-known emulsifying dispersion method may be used for dissolving the disulfide compound with the aid of an oil such as dibutyl phthalate, tricresyl phosphate, glyceryl triacetate or diethyl phthalate or an auxiliary solvent such as ethyl acetate or cyclohexanone whereby an emulsified dispersion is mechanically prepared. Alternatively, a method known as a solid dispersion method is used for dispersing the disulfide compound in powder form in water in a ball mill, colloidal mill, sand grinder mill, Manton Gaulin, micro-fluidizer or ultrasonic mixer.

The disulfide compounds of formulae (I), (1) and (2) may be added to a silver halide emulsion layer or any other layer on the silver halide emulsion layer side of a support, and preferably to the silver halide emulsion layer or a layer disposed adjacent thereto. When expressed in a molar amount per mol of silver, the amount of the disulfide compound of formula (I) added is preferably 0.01 to 500 mmol, more preferably 0.05 to 100 mmol, further preferably 0.1 to 50 mmol, and the amount of the disulfide compound of formula (1) or (2) added is preferably 0.2 to 500 mmol, more preferably 0.3 to 100 mmol, further preferably 0.5 to 30 mmol. The disulfide compounds may be used alone or in admixture of two or more.

Contrast Enhancer

In the practice of the invention, contrast enhancers may be used for forming ultrahigh contrast images. Useful contrast enhancers include the hydrazine derivatives described in U.S. Pat. Nos. 5,464,738, 5,496,695, 6,512,411, 5,536,622, Japanese Patent Application Nos. 228627/1995, 215822/1996, 130842/1996, 148113/1996, 156378/1996, 148111/1996, and 148116/1996, the compounds having quaternary nitrogen atom as described in Japanese Patent Application No. 83566/1996, and the acrylonitrile compounds described in U.S. Pat. No. 5,545,515. Illustrative examples are Compounds 1 to 10 in U.S. Pat. No. 5,464,738, Compounds H-1 to H-28 in U.S. Pat. No. 5,496,695, Compounds I-1 to I-86 in Japanese Patent Application No. 215822/1996, Compound H-1 to H-62 in Japanese Patent Application No. 130842/1996, Compounds 1-1 to 1-21 in Japanese Patent Application No. 148113/1996, Compounds 1 to 50 in Japanese Patent Application No. 148111/1996, Compounds 1 to 40 in Japanese Patent Application No. 148116/1996, Compounds P-1 to P-26 and T-1 to T-18 in Japanese Patent Application No. 83566/1996, and Compounds CN-1 to CN-13 in U.S. Pat. No. 5,545,515.

Also in the practice of the invention, ultrahigh contrast promoting agents may be used in combination with the contrast enhancers for forming ultrahigh contrast images. Such ultrahigh contrast promoting agents include the amine compounds described in U.S. Pat. No. 5,545,505, specifically Compounds AM-1 to AM-5 therein, the hydroxamic acids described in U.S. Pat. No. 5,545,507, specifically HA-1 to HA-11 therein, the acrylonitriles described in U.S. Pat. No. 5,545,507, specifically CN-1 to CN-13 therein, the hydrazine compounds described in U.S. Pat. No. 5,558,983, specifically CA-1 to CA-6 therein, the onium salts described in Japanese Patent Application No. 132836/1996, specifically A-1 to A-42, B-1 to B-27 and C-1 to C-14.

The synthesis methods, addition methods, and addition amounts of these ultrahigh contrast enhancers and ultrahigh contrast promoting agents are as described in the above-listed patents.

Any of the aforementioned ultrahigh contrast enhancers may be used as the contrast enhancer according to the invention insofar as they have the function for achieving the objects of the invention. Preferably, hydrazine derivatives are used.

Any of hydrazine derivatives may be used as the contrast enhancer according to the invention insofar as they have the function for achieving the objects of the invention. Preferred hydrazine derivatives are of the following general formula (H).

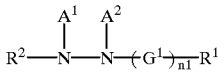

In formula (H), $R^2$ is an aliphatic, aromatic or heterocyclic group. $R^1$ is hydrogen or a block group. $G^1$ is —CO—, —COCO—, —C(=S)—, —$SO_2$—, —SO—, —PO($R^3$)— or iminomethylene group. $R^3$ is selected from the same range as defined for $R^1$ and may be different from $R^1$. $A^1$ and $A^2$ are both hydrogen, or one of $A^1$ and $A^2$ is hydrogen and the other is a substituted or unsubstituted alkylsulfonyl, substituted or unsubstituted arylsulfonyl or substituted or unsubstituted acyl group. Letter n1 is equal to 0 or 1. $R^1$ is an aliphatic, aromatic or heterocyclic group when n1 is 0.

In formula (H), the aliphatic groups represented by $R^2$ are preferably substituted or unsubstituted, normal, branched or cyclic alkyl, alkenyl and alkynyl groups having 1 to 30 carbon atoms.

In formula (H), the aromatic groups represented by $R^2$ are preferably monocyclic or fused ring aryl groups, for example, phenyl and naphthyl groups derived from benzene and naphthalene rings. The heterocyclic groups represented by $R^3$ are preferably monocyclic or fused ring, saturated or unsaturated, aromatic or non-aromatic heterocyclic groups while the heterocycles in these groups include pyridine, pyrimidine, imidazole, pyrazole, quinoline, isoquinoline, benzimidazole, thiazole, benzothiazole, piperidine, triazine, morpholine, and piperazine rings.

Aryl and alkyl groups are most preferred as $R^2$.

The groups represented by $R^2$ may have substituents. Exemplary substituents include halogen atoms (e.g., fluorine, chlorine, bromine and iodine), alkyl groups (inclusive of aralkyl, cycloalkyl and active methine groups), alkenyl groups, alkynyl groups, aryl groups, heterocyclic groups, heterocyclic groups containing a quaternized nitrogen atom (e.g., pyridinio), acyl groups, alkoxycarbonyl groups, aryloxycarbonyl groups, carbamoyl groups, carboxy groups or salts thereof, sulfonylcarbamoyl groups, acylcarbamoyl groups, sulfamoylcarbamoyl groups, carbazoyl groups, oxalyl groups, oxamoyl groups, cyano groups, thiocarbamoyl groups, hydroxy groups, alkoxy groups (inclusive of groups having recurring ethylenoxy or propylenoxy units), aryloxy groups, heterocyclic oxy groups, acyloxy groups, (alkoxy or aryloxy)carbonyloxy groups, carbamoyloxy groups, sulfonyloxy groups, amino groups, (alkyl, aryl or heterocyclic) amino groups, N-substituted nitrogenous heterocyclic groups, acylamino groups, sulfonamide groups, ureido groups, thioureido groups, imide groups, (alkoxy or aryloxy)carbonylamino groups, sulfamoylamino groups, semicarbazide groups, thiosemicarbazide groups, hydrazino groups, quaternary ammonio groups, oxamoylamino groups, (alkyl or aryl)sulfonylureido groups, acylureido groups, acylsulfamoylamino groups, nitro groups, mercapto groups, (alkyl, aryl or heterocyclic) thio groups, (alkyl or aryl)sulfonyl groups, (alkyl or aryl)sulfinyl groups, sulfo groups or salts thereof, sulfamoyl groups, acylsulfamoyl groups, sulfonylsulfamoyl groups or salts thereof, and groups containing a phosphoramide or phosphate structure. These substituents may be further substituted with such substituents.

Preferred substituents that $R^2$ may have include, where $R^2$ is an aromatic or heterocyclic group, alkyl (inclusive of active methylene), aralkyl, heterocyclic, substituted amino, acylamino, sulfonamide, ureido, sulfamoylamino, imide, thioureido, phosphoramide, hydroxy, alkoxy, aryloxy, acyloxy, acyl, alkoxycarbonyl, aryloxycarbonyl, carbamoyl, carboxy (inclusive of salts thereof), (alkyl, aryl or heterocyclic) thio, sulfo (inclusive of salts thereof), sulfamoyl, halogen, cyano, and nitro groups.

Where $R^2$ is an aliphatic group, preferred substituents include alkyl, aryl, heterocyclic, amino, acylamino, sulfonamide, ureido, sulfamoylamino, imide, thioureido, phosphoramide, hydroxy, alkoxy, aryloxy, acyloxy, acyl, alkoxycarbonyl, aryloxycarbonyl, carbamoyl, carboxy (inclusive of salts thereof), (alkyl, aryl or heterocyclic) thio, sulfo (inclusive of salts thereof), sulfamoyl, halogen, cyano, and nitro groups.

In formula (H), $R^1$ is hydrogen or a block group. Examples of the block group include aliphatic groups (e.g., alkyl, alkenyl and alkynyl groups), aromatic groups (monocyclic or fused ring aryl groups), heterocyclic groups, alkoxy, aryloxy, amino and hydrazino groups.

The alkyl groups represented by $R^1$ are preferably substituted or unsubstituted alkyl groups having 1 to 10 carbon atoms, for example, methyl, ethyl, trifluoromethyl, difluoromethyl, 2-carboxytetrafluoroethyl, pyridiniomethyl, difluoromethoxymethyl, difluorocarboxymethyl, 3-hydroxypropyl, 3-methanesulfonamidopropyl, phenylsulfonylmethyl, o-hydroxybenzyl, methoxymethyl, phenoxymethyl, 4-ethylphenoxymethyl, phenylthiomethyl, t-butyl, dicyanomethyl, diphenylmethyl, triphenylmethyl, methoxycarbonyldiphenylmethyl, cyanodiphenylmethyl, and methylthiodiphenylmethyl groups. The alkenyl groups are preferably those having 1 to 10 carbon atoms, for example, vinyl, 2-ethoxycarbonylvinyl, and 2-trifluoro-2-methoxycarbonylvinyl groups. The alkynyl groups are preferably those having 1 to 10 carbon atoms, for example, ethynyl and 2-methoxycarbonylethynyl groups. The aryl groups are preferably monocyclic or fused ring aryl groups, especially those containing a benzene ring, for example, phenyl, perfluorophenyl, 3,5-dichlorophenyl, 2-methanesulfonamidophenyl, 2-carbamoylphenyl, 4,5-dicyanophenyl, 2-hydroxymethylphenyl, 2,6-dichloro-4-cyanophenyl, and 2-chloro-5-octylsulfamoylphenyl groups.

The heterocyclic groups represented by $R^1$ are preferably 5- and 6-membered, saturated or unsaturated, monocyclic or fused ring, heterocyclic groups containing at least one of nitrogen, oxygen and sulfur atoms, for example, morpholino, piperidino (N-substituted), imidazolyl, indazolyl (e.g., 4-nitroindazolyl), pyrazolyl, triazolyl, benzimidazolyl, tetrazolyl, pyridyl, pyridinio (e.g., N-methyl-3-pyridinio), quinolinio, and quinolyl groups.

The alkoxy groups are preferably those having 1 to 8 carbon atoms, for example, methoxy, 2-hydroxyethoxy, benzyloxy, and t-butoxy groups. The aryloxy groups are preferably substituted or unsubstituted phenoxy groups. The amino groups are preferably unsubstituted amino, alkylamino having 1 to 10 carbon atoms, arylamino, and saturated or unsaturated heterocyclic amino groups (inclusive of nitrogenous heterocyclic amino groups containing a quaternized nitrogen atom). Examples of the amino group include 2,2,6,6-tetramethylpiperidin-4-ylamino, propylamino, 2-hydroxyethylamino, anilino, o-hydroxyanilino, 5-benzotriazolylamino, and N-benzyl-3-pyridinioamino groups. The hydrazino groups are preferably substituted or unsubstituted hydrazino groups and substituted or unsubstituted phenylhydrazino groups (e.g., 4-benzenesulfonamidophenylhydrazino).

The groups represented by $R^1$ may be substituted ones, with examples of the substituent being as exemplified for the substituent on $R^2$.

In formula (H), $R^1$ may be such a group as to induce cyclization reaction to cleave a $G^1$—$R^1$ moiety from the remaining molecule to generate a cyclic structure containing the atoms of the —$G^1$—$R^1$ moiety. Such examples are described in JP-A 29751/1988, for example.

The hydrazine derivative of formula (H) may have incorporated therein a group capable of adsorbing to silver halide. Such adsorptive groups include alkylthio, arylthio, thiourea, thioamide, mercapto heterocyclic and triazole groups as described in U.S. Pat. Nos. 4,385,108 and 4,459,347, JP-A 195233/1984, 200231/1984, 201045/1984, 201046/1984, 201047/1984, 201048/1984, 201049/1984, 170733/1986, 270744/1986, 948/1987, 234244/1988, 234245/1988, and 234246/1988. These adsorptive groups to silver halide may take the form of precursors. Such precursors are exemplified by the groups described in JP-A 285344/1990.

$R^1$ and $R^2$ in formula (H) may have incorporated therein a ballast group or polymer commonly used in immobile photographic additives such as couplers. The ballast group is a group having at least 8 carbon atoms and relatively inert with respect to photographic properties. It may be selected from, for example, alkyl, aralkyl, alkoxy, phenyl, alkylphenyl, phenoxy, and alkylphenoxy groups. The polymer is exemplified in JP-A 100530/1989, for example.

$R^1$ or $R^2$ in formula (H) may have a plurality of hydrazino groups as a substituent. In this case, the compounds of formula (H) are polymeric with respect to hydrazino groups. Exemplary polymeric compounds are described in JP-A 86134/1989, 16938/1992, 197091/1993, WO 95-32452 and 95-32453, Japanese Patent Application Nos. 351132/1995, 351269/1995, 351168/1995, 351287/1995, and 351279/1995.

$R^1$ or $R^2$ in formula (H) may contain a cationic group (e.g., a group containing a quaternary ammonio group and a nitrogenous heterocyclic group containing a quaternized nitrogen atom), a group containing recurring ethyleneoxy or propyleneoxy units, an (alkyl, aryl or heterocyclic) thio group, or a group which is dissociable with a base (e.g., carboxy, sulfo, acylsulfamoyl, and carbamoylsulfamoyl). Exemplary compounds containing such a group are described in, for example, in JP-A 234471/1995, 333466/1993, 19032/1994, 19031/1994, 45761/1993, 259240/1991, 5610/1995, and 244348/1995, U.S. Pat. Nos. 4,994,365 and 4,988,604, and German Patent No. 4006032.

In formula (H), each of $A^1$ and $A^2$ is a hydrogen atom, a substituted or unsubstituted alkyl- or arylsulfonyl group having up to 20 carbon atoms (preferably a phenylsulfonyl group or a phenylsulfonyl group substituted such that the sum of Hammette's substituent constants may be −0.5 or more), or a substituted or unsubstituted acyl group having up to 20 carbon atoms (preferably a benzoyl group, a benzoyl group substituted such that the sum of Hammette's substituent constants may be −0.5 or more, or a linear, branched or cyclic, substituted or unsubstituted, aliphatic acyl group wherein the substituent is selected from a halogen atom, ether group, sulfonamide group, carbonamide group, hydroxyl group, carboxy group and sulfo group). Most preferably, both $A^1$ and $A^2$ are hydrogen atoms.

The preferable range of the hydrazine derivatives of the general formula (H) is described.

In formula (H), $R^2$ is preferably phenyl or substituted alkyl of 1 to 3 carbon atoms.

Where $R^2$ represents phenyl groups, preferred substituents thereon include nitro, alkoxy, alkyl, acylamino, ureido, sulfonamide, thioureido, carbamoyl, sulfamoyl, carboxy (or salts thereof), sulfo (or salts thereof), alkoxycarbonyl, and chloro groups.

Where $R^2$ represents substituted phenyl groups, it is preferred that the substituents be, directly or via a linking group, replaced by at least one substituent selected from ballast groups, adsorptive groups to silver halide, quaternary ammonio-containing groups, nitrogenous heterocyclic groups containing a quaternized nitrogen atom, groups containing recurring ethyleneoxy units, (alkyl, aryl or heterocyclic) thio groups, nitro groups, alkoxy groups, acylamino groups, sulfonamide groups, dissociable groups (e.g., carboxy, sulfo, acylsulfamoyl, and carbamoylsulfamoyl), and hydrazino groups (groups represented by —NHNH—$G^1$—$R^1$) capable of forming a polymer.

Where $R^2$ represents substituted alkyl groups of 1 to 3 carbon atoms, it is more preferably substituted methyl groups, and further preferably di- or tri-substituted methyl groups. Exemplary preferred substituents on these methyl groups include methyl, phenyl, cyano, (alkyl, aryl or heterocyclic) thio, alkoxy, aryloxy, chloro, heterocyclic, alkoxycarbonyl, aryloxycarbonyl, carbamoyl, sulfamoyl, amino, acylamino, and sulfonamide groups, and especially, substituted or unsubstituted phenyl groups.

Where $R^2$ represents substituted methyl groups, preferred examples thereof are t-butyl, dicyanomethyl, dicyanophenylmethyl, triphenylmethyl (trityl), diphenylmethyl, methoxycarbonyldiphenylmethyl, cyanodiphenylmethyl, methylthiodiphenylmethyl, cyclopropyldiphenylmethyl groups, with trityl being most preferred.

Most preferably, $R^2$ in formula (H) represents substituted phenyl groups.

In formula (H), n1 is equal to 0 or 1. When n1 is 0, $R^1$ represents aliphatic, aromatic or heterocyclic groups. When n1 is 0, $R^1$ more preferably represents phenyl groups or substituted alkyl groups of 1 to 3 carbon atoms. The preferred ranges of these groups are the same as the preferred range of $R^2$.

Preferably n1 is equal to 1.

Where $R^2$ is a phenyl group and $G^1$ is —CO—, the groups represented by $R^1$ are preferably selected from hydrogen, alkyl, alkenyl, alkynyl, aryl and heterocyclic groups, more preferably from hydrogen, alkyl and aryl groups, and most preferably from hydrogen atoms and alkyl groups. Where $R^1$ represents alkyl groups, preferred substituents thereon are halogen, alkoxy, aryloxy, alkylthio, arylthio, and carboxy groups.

Where $R^2$ is a substituted methyl group and $G^1$ is —CO—, the groups represented by $R^1$ are preferably selected from hydrogen, alkyl, aryl, heterocyclic, alkoxy, and amino groups (including unsubstituted amino, alkylamino, arylamino and heterocyclic amino groups), more preferably from hydrogen, alkyl, aryl, heterocyclic, alkoxy, alkylamino, arylamio and heterocyclic amino groups. Where $G^1$ is —COCO—, independent of $R^2$, $R^1$ is preferably selected from alkoxy, aryloxy, and amino groups, more preferably from substituted amino groups, specifically alkylamino, arylamino and saturated or unsaturated heterocyclic amino groups.

Where $G^1$ is —$SO_2$—, independent of $R^2$, $R^1$ is preferably selected from alkyl, aryl and substituted amino groups.

In formula (H), $G^1$ is preferably —CO— or —COCO—, and most preferably —Co—.

Illustrative, non-limiting, examples of the compound represented by formula (H) are given below.

List 1

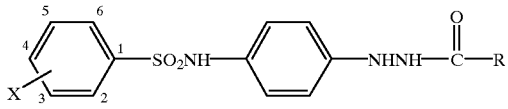

| | X = | R = —H | —$C_2F_4$—COOH (or —$C_2F_4$—$COO^{\ominus}K^{\oplus}$) | 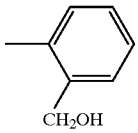 | 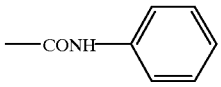 |
|---|---|---|---|---|---|
| 1 | 3-NHCO—$C_9H_{19}$(n) | 1a | 1b | 1c | 1d |
| 2 | 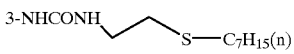 | 2a | 2b | 2c | 2d |
| 3 | 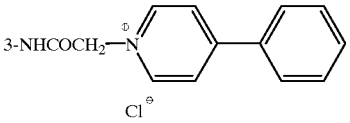 | 3a | 3b | 3c | 3d |
| 4 | 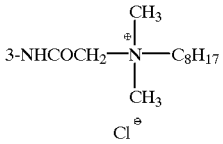 | 4a | 4b | 4c | 4d |
| 5 | 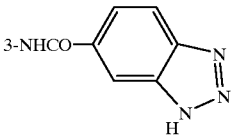 | 5a | 5b | 5c | 5d |
| 6 | 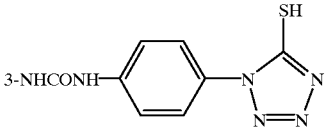 | 6a | 6b | 6c | 6d |
| 7 | 2,4-$(CH_3)_2$-3-$SC_2H_4$—$(OC_2H_4)_4$—$OC_8H_{17}$ | 7a | 7b | 7c | 7d |

List 2
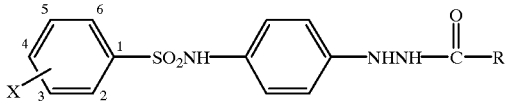
| | X = | R = —H | —$CF_2H$ | —$CH_2$—$N^{\oplus}$ $Cl^{\ominus}$ | —CONH— 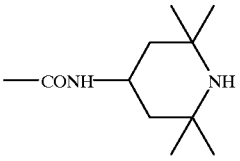 |
|---|---|---|---|---|---|
| 8 | 3-$CONHCH_2CH(C_2H_5)C_4H_9$ | 8a | 8e | 8f | 8g |
| 9 | 6-$OCH_3$-3-$C_5H_{11}$(t) | 9a | 9e | 9f | 9g |
| 10 | 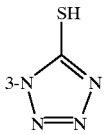 | 10a | 10e | 10f | 10g |
| 11 | 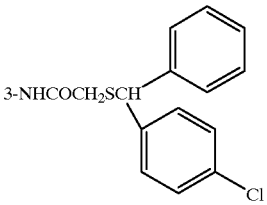 | 11a | 11e | 11f | 11g |
| 12 | 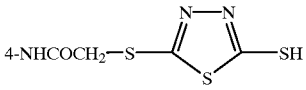 | 12a | 12e | 12f | 12g |
| 13 | 3-$NHCOCH(CH_2COOH)C_8H_{17}$ | 13a | 13e | 13f | 13g |
| 14 | 3,5-$(CONHCH_2CH(C_2H_5)C_4H_9)_2$ | 14a | 14e | 14f | 14g |

List 3
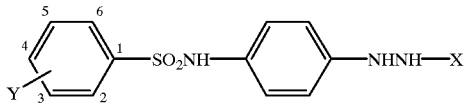
| | | X = | | | |
|---|---|---|---|---|---|
| | Y = | —CHO | —$COCF_3$ | —$SO_2CH_3$ | —$P(=O)(OC_2H_5)_2$ |
| 15 | 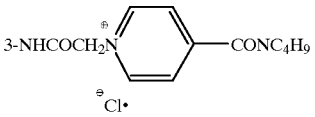 | 15a | 15h | 15i | 15j |
| 16 | 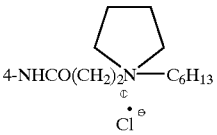 | 16a | 16h | 16i | 16j |
| 17 | 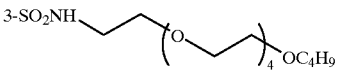 | 17a | 17h | 17i | 17j |
| 18 | 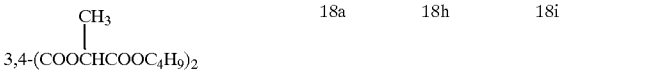 | 18a | 18h | 18i | 18j |
| 19 | 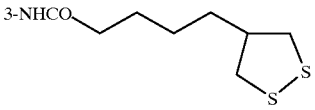 | 19a | 19h | 19i | 19j |
| 20 | 3-$NHSO_2NH—C_9H_{17}$ | 20a | 20h | 20i | 20j |
| 21 | 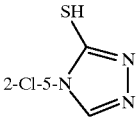 | 21a | 21h | 21i | 21j |

List 4
| | | R = | | | |
|---|---|---|---|---|---|
| | | —H | —$CF_3$ | 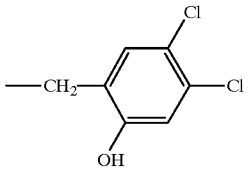 | 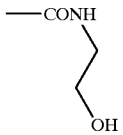 |
| 22 | 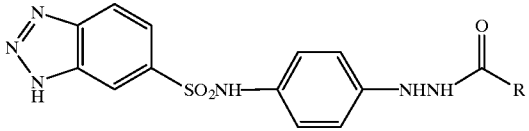 | 22a | 22h | 22k | 22l |
| 23 | 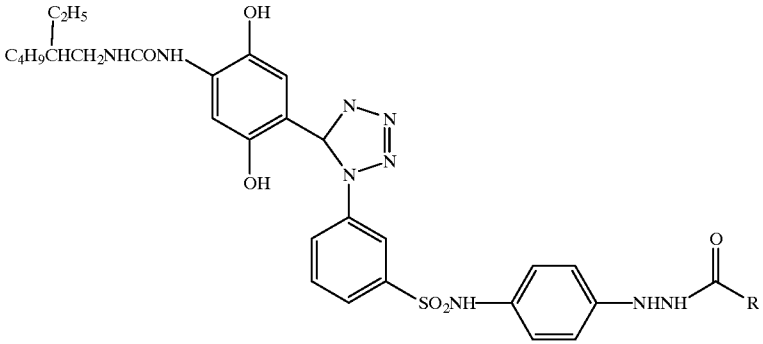 | 23a | 23h | 23k | 23l |

-continued
List 4
| | | R = | | | |
|---|---|---|---|---|---|
| | | —H | —$CF_3$ | 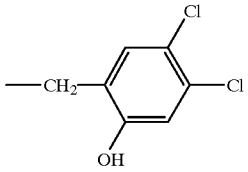 | 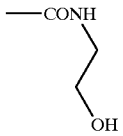 |
| 24 | 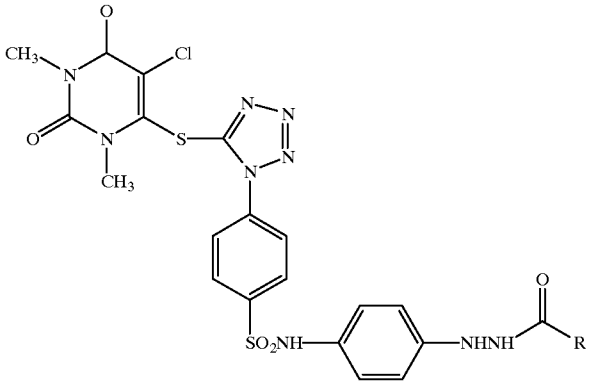 | 24a | 24h | 24k | 24l |
| 25 | 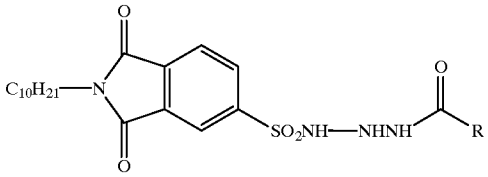 | 25a | 25h | 25k | 25l |

-continued
List 4
| | | R = | | | |
|---|---|---|---|---|---|
| | | —H | —$CF_3$ | 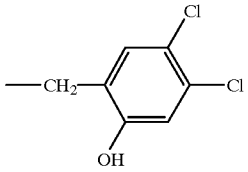 | 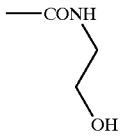 |
| 26 | 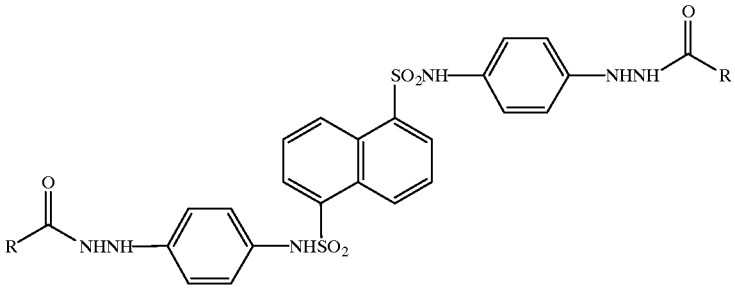 | 26a | 26h | 26k | 26l |
| 27 | 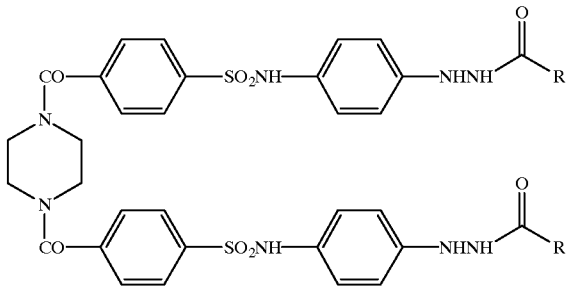 | 27a | 27h | 27k | 27l |

-continued
List 4
| | | R = | | | |
|---|---|---|---|---|---|
| | | —H | —$CF_3$ | 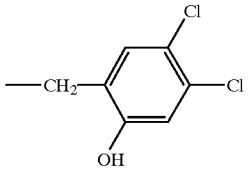 | 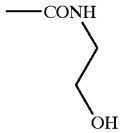 |
| 28 | 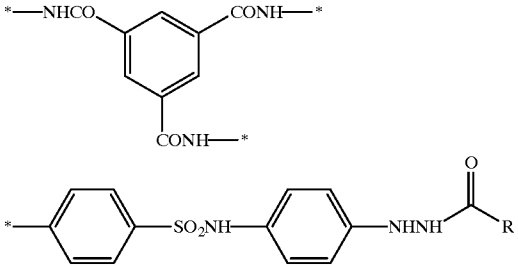 | 28a | 28h | 28k | 28l |

List 5
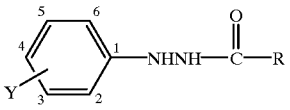
| | Y = | R = —H | —$CH_2OCH_3$ | 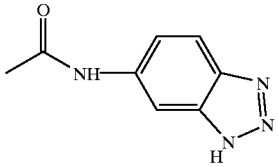 | 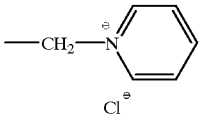 |
|---|---|---|---|---|---|
| 29 | 4-NHC(=S)NH—$C_8H_{17}$(n) | 29a | 29m | 29n | 29f |
| 30 | 4-NHP(=O)($OCH_2$—C$_6$H$_5$)$_2$ | 30a | 30m | 30n | 30f |
| 31 | 4-NHCONH—$(CH_2)_3O$—C$_6$H$_4$—C(CH$_3$)$_2$—CH$_3$ | 31a | 31m | 31n | 31f |
| 32 | 4-OH<br>3-NHCONH$CH_2$CH($C_2H_5$)—$C_4H_9$ | 32a | 32m | 32n | 32f |
| 33 | 4-$NHSO_2(CH_2)_2NHCO$—C$_6$H$_4$— 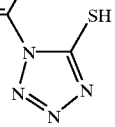 | 33a | 33m | 33n | 33f |
| 34 | 4-$OCH_2$—C$_6$H$_5$ | 34a | 35m | 34n | 34f |
| 35 | 4-NHCONHN(—$CH_2$—C$_6$H$_5$)$_2$ | 35a | 35m | 35n | 35f |

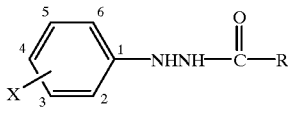
List 6
| | Y = | R = —H | —$CF_2SCH_3$ | —$CONHCH_3$ | 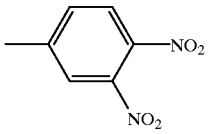 |
|---|---|---|---|---|---|
| 36 | 2-$NHSO_2CH_3$— 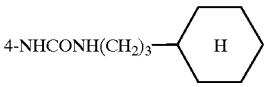 | 36a | 36c | 36p | 36q |
| 37 | 2-$OCH_3$-4-$NHSO_2C_{12}H_{25}$ | 37a | 37o | 37p | 37q |
| 38 | 3-$NHCOC_{11}H_{23}$-4-$NHSO_2CF_3$ | 38a | 38o | 38p | 38q |
| 39 | 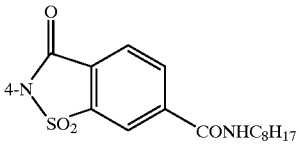 | 39a | 39o | 39p | 39q |
| 40 | 4-$OCO(CH_2)_2COOC_6H_{13}$ | 40a | 40o | 40p | 40q |
| 41 | 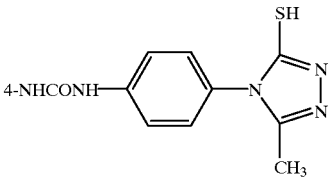 | 41a | 41o | 41p | 41q |
| 42 | 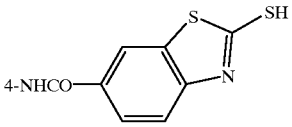 | 42a | 42o | 42p | 42q |
List 7
43
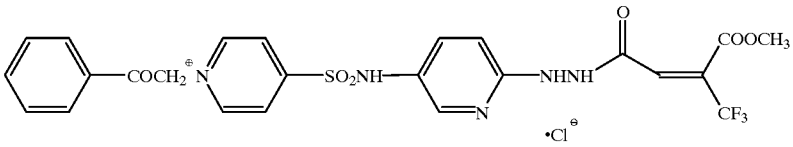
44
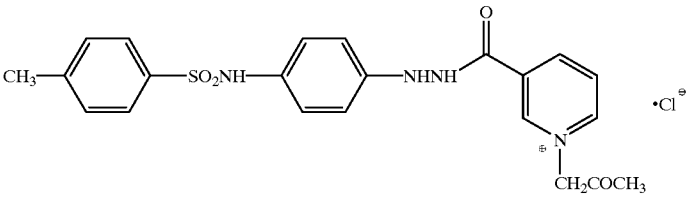

-continued
45
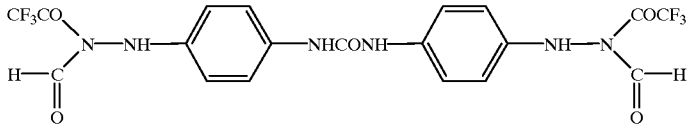
46
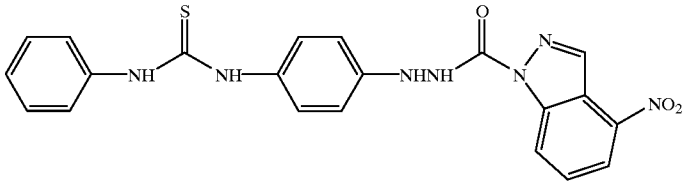
47
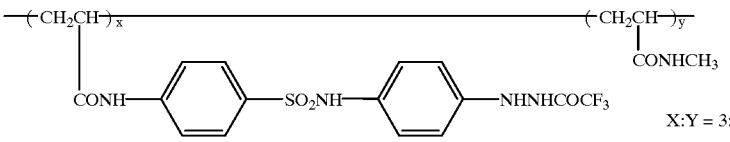
X:Y = 3:97
mean particle size ≈ 100,000
48
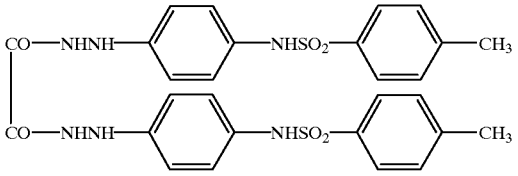
49
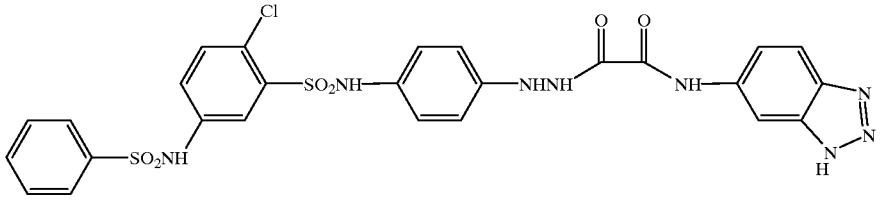
50
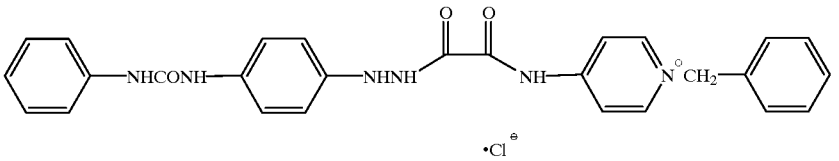
List 8
51
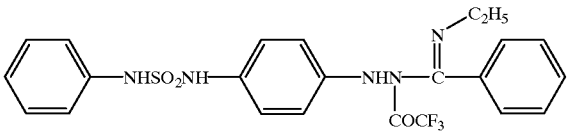
52
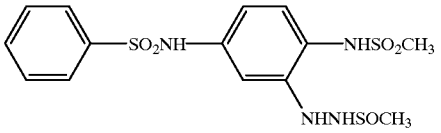

-continued
| | |
|---|---|
| 53 | 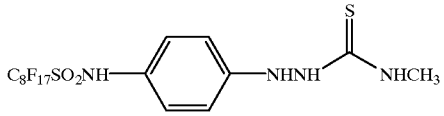 |
List 9
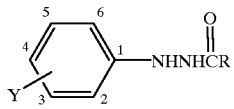
| | | R = | | | |
|---|---|---|---|---|---|
| | Y = | —H | —$CH_2OCH_3$ | —$CH_2O$— 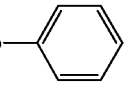 | —$CONHC_3H_7$ |
| 54 | 2-$OCH_3$ | 54a | 54m | 54r | 54s |
| 55 | 2-$OCH_3$ 5-$C_8H_{17}$(t) | 55a | 55m | 55r | 55s |
| 56 | 4-$NO_2$ | 56a | 56m | 56r | 56s |
| 57 | 4-$CH_3$ | 57a | 57m | 57r | 57s |
| 58 | 4-NHCO— 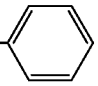 | 58a | 58m | 58r | 58s |
| 59 | 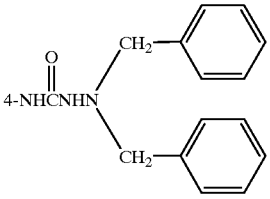 | 59a | 59m | 59r | 59s |
List 10
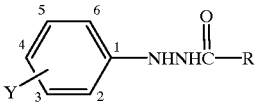
| | | R = | | | |
|---|---|---|---|---|---|
| | Y = | —H | 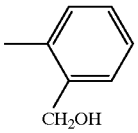 | —$CH_2$—$N^{\oplus}$ 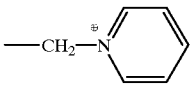 $\cdot Cl^{\ominus}$ | —CONH— 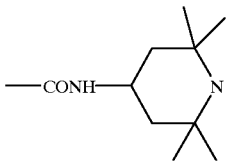 |
| 60 | 2-$OCH_3$ 5-$OCH_3$ | 60a | 60c | 60f | 60g |
| 61 | 4-$C_8H_{17}$(t) | 61a | 61c | 61f | 61g |
| 62 | 2-$OC_2H_5$ | — | 62c | 62f | 62g |
| 63 | 3-$NO_2$ | 63a | 63c | 63f | 63g |

-continued
List 10
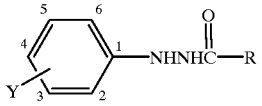
| | Y = | R = —H | 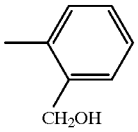 | 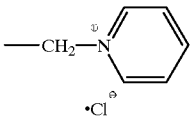 | 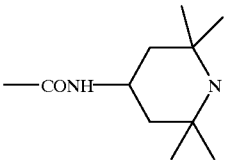 |
|---|---|---|---|---|---|
| 64 | 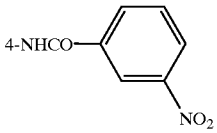 | 64a | 64c | 64f | 64g |
| 65 | 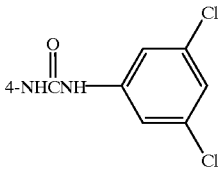 | 65a | 65c | 65f | 65g |
List 11
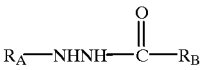
| | $R_A$ = | $R_B$ = —H | 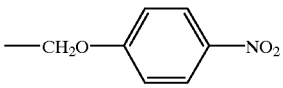 | 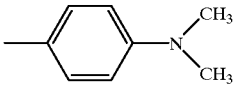 | 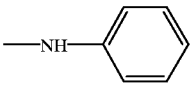 |
|---|---|---|---|---|---|
| 66 | 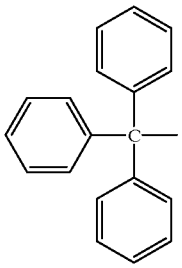 | 66a | 66u | 66v | 66t |

-continued
List 11
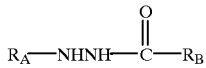
| | $R_A$ = | $R_B$ = —H | —$CH_2O$— 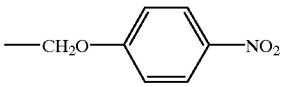 | 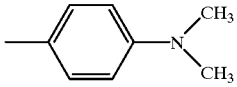 | —NH— 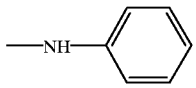 |
|---|---|---|---|---|---|
| 67 | 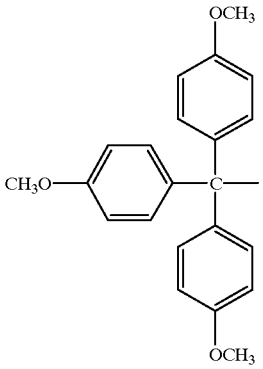 | 67a | 67u | 67v | 67t |
| 68 | 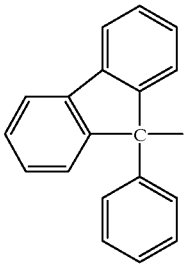 | 68a | 68u | 68v | 68t |
| 69 | 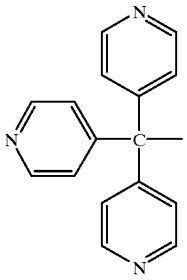 | 69a | 69u | 69v | 69t |
| 70 | 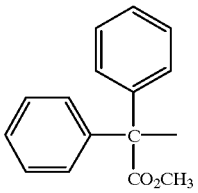 | 70a | 70u | 70v | 70t |

-continued
List 11
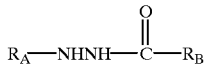
| | $R_A$ = | $R_B$ = —H | —$CH_2O$—⟨benzene⟩—$NO_2$ | —⟨benzene⟩—N($CH_3$)$_2$ | —NH—⟨benzene⟩ |
|---|---|---|---|---|---|
| 71 | 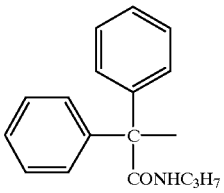 | 71a | 71u | 71v | 71t |
List 12
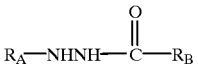
| | $R_A$ = | $R_B$ = —C(=O)$NHC_3H_7$ | —C(=O)O—$C_4H_9$(t) | —$OC_4H_9$(t) | —⟨pyridine⟩ |
|---|---|---|---|---|---|
| 72 | 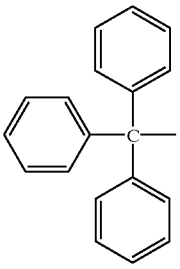 | 72s | 72x | 72y | 72w |
| 73 | 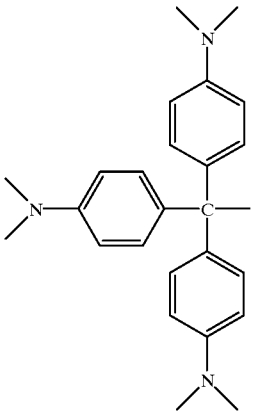 | 73s | 73x | 73y | 73w |

-continued
List 12
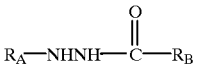
| | $R_B$ = | | | |
|---|---|---|---|---|
| $R_A$ = | 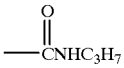 | 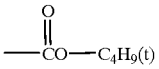 | 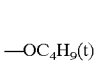 | 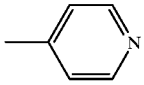 |
| 74 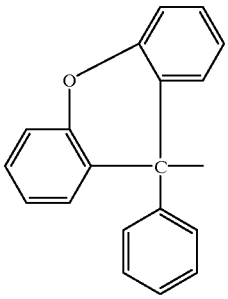 | 74s | 74x | 74y | 74w |
| 75 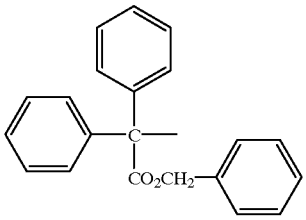 | 75s | 75x | 75y | 75w |
| 76 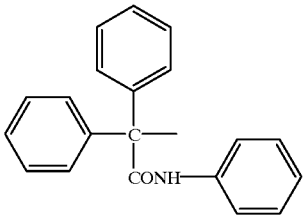 | 76s | 76x | 76y | 76w |

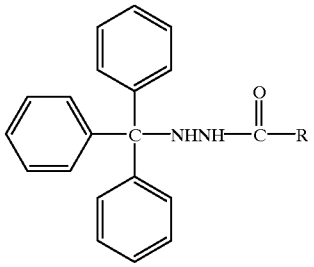
R =
List 13
77
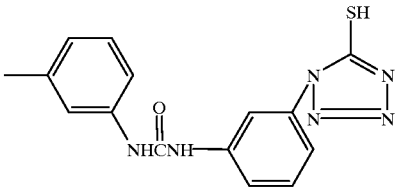
78
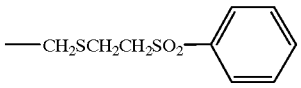
79 $—CH_2OCH_2CH_2SCH_2CH_2OCH_3$
80 $—CF_2CF_2COOH$
81
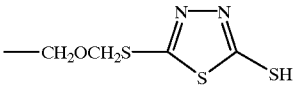
82
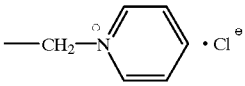
List 14
83
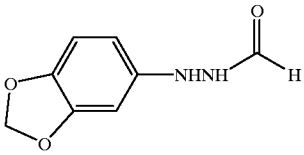
84
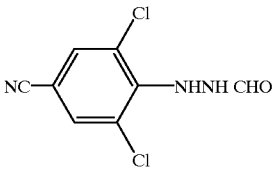
85
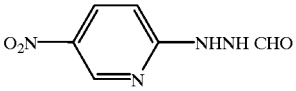
86
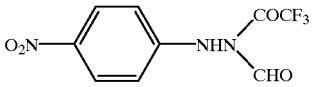

-continued
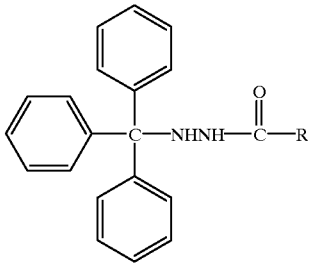
R =
87
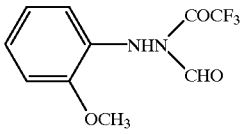
88
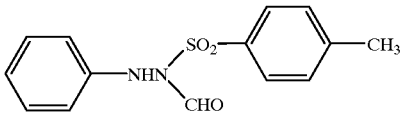
List 15
89
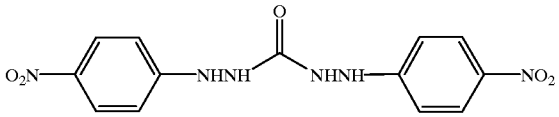
90
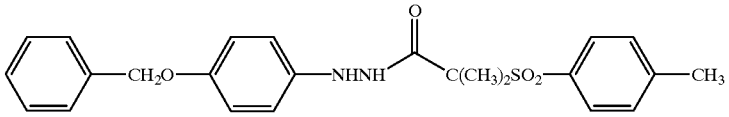

-continued
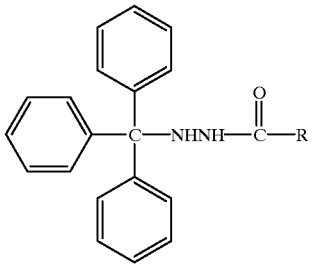
R =
91
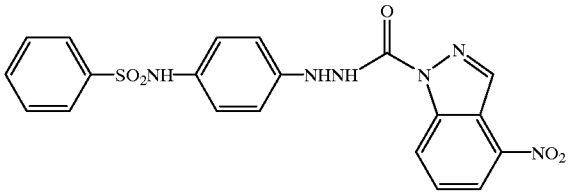
92
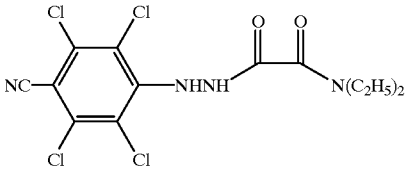
93
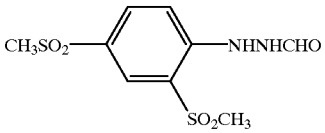
94
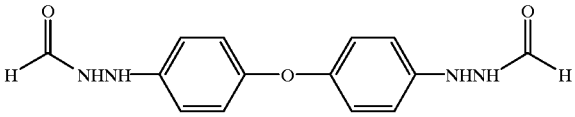

List 16
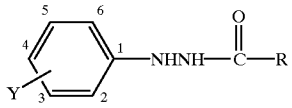
| | Y = | R = $-CH_2O-C_6H_4-C_2H_5$ | R = $-CHO(C_2H_5)-C_6H_4-C(CH_3)_3$ | R = $-CH_2S-C_6H_5$ | R = $-CH_2-Cl$ |
|---|---|---|---|---|---|
| 95 | 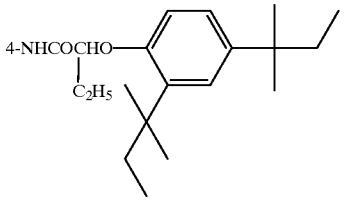 | 95-1 | 95-2 | 95-3 | 95-4 |
| 96 | 4-COOH | 96-1 | 96-2 | 96-3 | 96-4 |
| 97 | 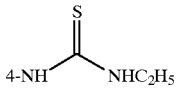 | 97-1 | 97-2 | 97-3 | 97-4 |
| 98 | 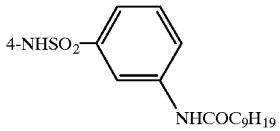 | 98-1 | 98-2 | 98-3 | 98-4 |

-continued
List 16
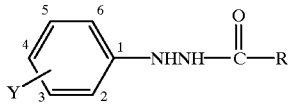
| Y = | R = | | | | |
|---|---|---|---|---|---|
| | 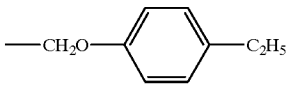 | 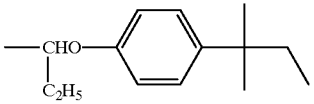 | 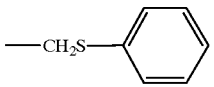 | $—CH_2—Cl$ |
| 99 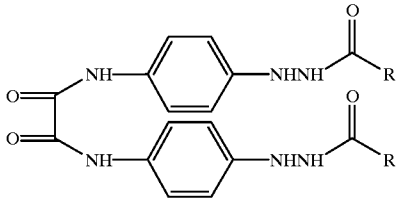 | 99-1 | 99-2 | 99-3 | 99-4 |
| 100 4-$NHCONHCH_2CH(C_2H_5)(C_4H_9)$ | 100-1 | 100-2 | 100-3 | 100-4 |

List 17
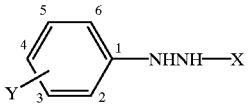
| | Y = | X = 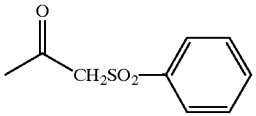 | 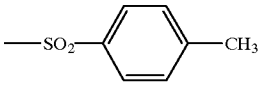 | 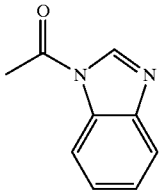 | 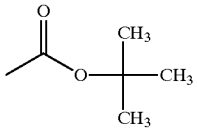 |
|---|---|---|---|---|---|
| 101 | 4-$NO_2$ | 101-5 | 101-6 | 101-7 | 101y |
| 102 | 2,4-$OCH_3$ | 102-5 | 102-6 | 102-7 | 102y |
| 103 | 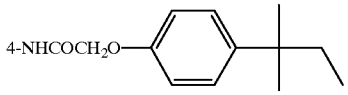 | 103-5 | 103-6 | 103-7 | 103y |

-continued
List 17
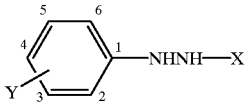
X =
| | Y = | X = 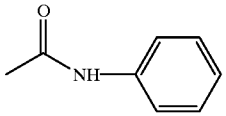 | 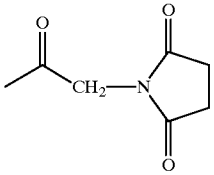 | 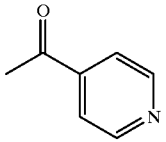 | 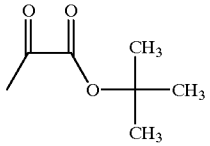 |
|---|---|---|---|---|---|
| 104 | 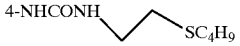 | 104-8 | 104-9 | 104w' | 104x |
| 105 | 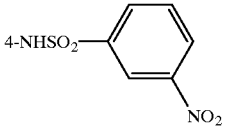 | 105-8 | 105-9 | 105w' | 105x |

List 18
Y—NH NH—X
| | Y = | X = 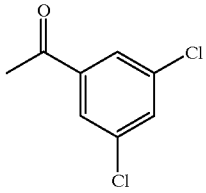 | 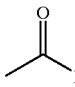 | 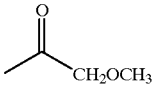 | 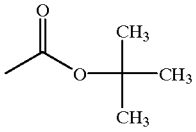 |
|---|---|---|---|---|---|
| 106 | 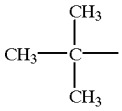 | 106-10 | 106a | 106m | 106y |
| 107 | 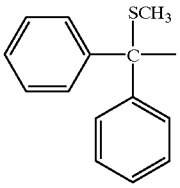 | 107-10 | 107a | 107m | 107y |
| 108 | 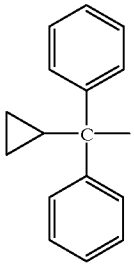 | 108-10 | 108a | 108m | 108y |
| 109 | 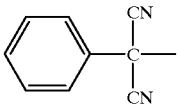 | 109-10 | 109a | 109m | 109y |
| 110 | 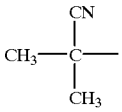 | 110-10 | 110a | 110m | 110y |
| 111 | 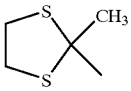 | 111-10 | 111a | 111m | 111y |

List 19
Y—NH NH—X
| Y = | X = 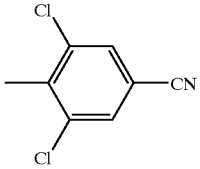 | 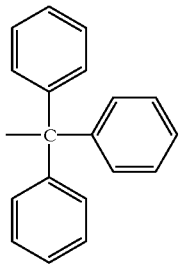 | 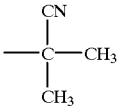 | 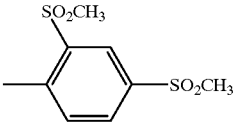 |
|---|---|---|---|---|
| 112 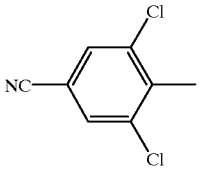 | 112-11 | 112-12 | 112-13 | 112-14 |
| 113 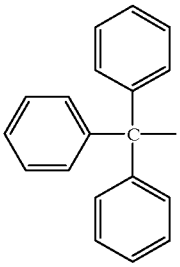 | 113-11 | 113-12 | 113-13 | 113-14 |
| 114 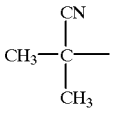 | 114-11 | 114-12 | 114-13 | 114-14 |
| 115 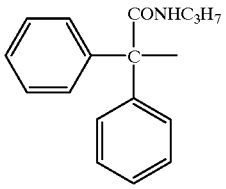 | 115-11 | 115-12 | 115-13 | 115-14 |
| 116 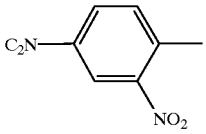 | 116-11 | 116-12 | 116-13 | 116-14 |
| 117 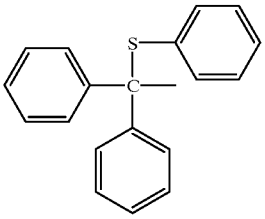 | 117-11 | 117-12 | 117-13 | 117-14 |

List 20
118
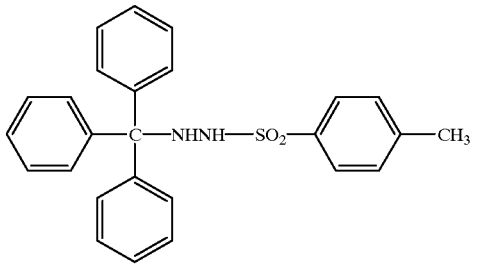
119
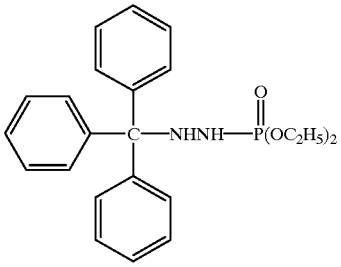
120
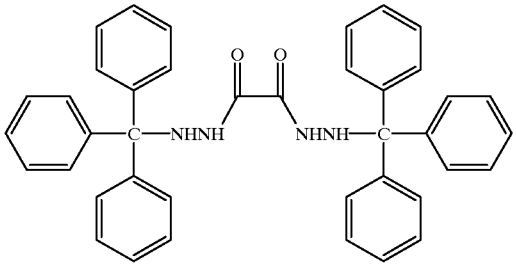
121
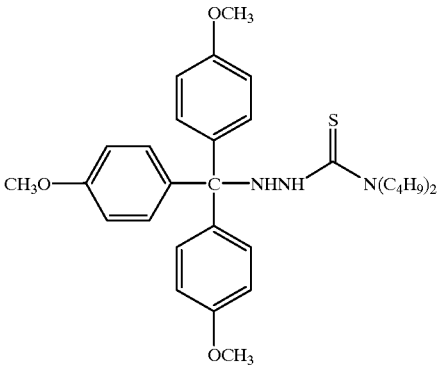
122
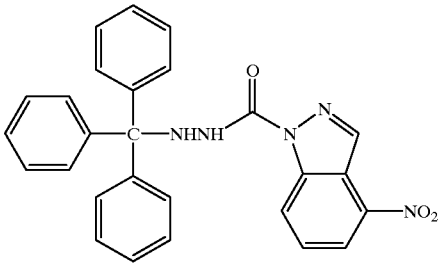

-continued

| List 20 |
| --- |
| 123 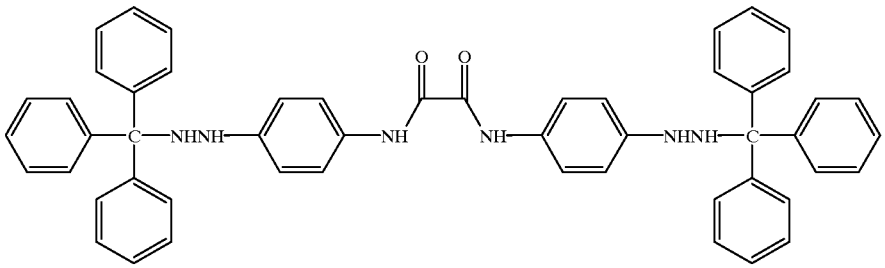 |

The compounds of formula (H) may be used alone or in admixture of two or more.

In addition to the above-described ones, the following hydrazine derivatives are also preferable for use in the practice of the invention. If desired, any of the following hydrazine derivatives may be used in combination with the hydrazine derivatives of formula (H). The hydrazine derivatives which are used herein can be synthesized by various methods as described in the following patents.

Exemplary hydrazine derivatives which can be used herein include the compounds of the chemical formula [1] in JP-B 77138/1994, more specifically the compounds described on pages 3 and 4 of the same; the compounds of the general formula (I) in JP-B 93082/1994, more specifically compound Nos. 1 to 38 described on pages 8 to 18 of the same; the compounds of the general formulae (4), (5) and (6) in JP-A 230497/1994, more specifically compounds 4-1 to 4-10 described on pages 25 and 26, compounds 5-1 to 5-42 described on pages 28 to 36, and compounds 6-1 to 6-7 described on pages 39 and 40 of the same; the compounds of the general formulae (1) and (2) in JP-A 289520/1994, more specifically compounds 1-1 to 1-17 and 2-1 described on pages 5 to 7 of the same; the compounds of the chemical formulae [2] and [3] in JP-A 313936/1994, more specifically the compounds described on pages 6 to 19 of the same; the compounds of the chemical formula [1] in JP-A 313951/1994, more specifically the compounds described on pages 3 to 5 of the same; the compounds of the general formula (I) in JP-A 5610/1995, more specifically compounds I-1 to I-38 described on pages 5 to 10 of the same; the compounds of the general formula (II) in JP-A 77783/1995, more specifically compounds II-1 to II-102 described on pages 10 to 27 of the same; the compounds of the general formulae (H) and (Ha) in JP-A 104426/1995, more specifically compounds H-1 to H-44 described on pages 8 to 15 of the same; the compounds having an anionic group in proximity to a hydrazine group or a nonionic group capable of forming an intramolecular hydrogen bond with the hydrogen atom of hydrazine described in EP 713131A, especially compounds of the general formulae (A), (B), (C), (D), (E), and (F), more specifically compounds N-1 to N-30 described therein; and the compounds of the general formula (1) in EP 713131A, more specifically compounds D-1 to D-55 described therein.

Also useful are the hydrazine derivatives described in "Known Technology," Aztech K. K., Mar. 22, 1991, pages 25–34 and Compounds D-2 and D-39 described in JP-A 86354/1987, pages 6–7.

In the practice of the invention, the hydrazine nucleating agent is used as solution in a suitable organic solvent. Suitable solvents include alcohols (e.g., methanol, ethanol, propanol, and fluorinated alcohols), ketones (e.g., acetone and methyl ethyl ketone), dimethylformamide, dimethylsulfoxide and methyl cellosolve.

A well-known emulsifying dispersion method may be used for dissolving the hydrazine derivative with the aid of an oil such as dibutyl phthalate, tricresyl phosphate, glyceryl triacetate or diethyl phthalate or an auxiliary solvent such as ethyl acetate or cyclohexanone whereby an emulsified dispersion is mechanically prepared. Alternatively, a method known as a solid dispersion method is used for dispersing the hydrazine derivative in powder form in water in a ball mill, colloidal mill, Manton Gaulin, micro-fluidizer or ultrasonic mixer.

The hydrazine nucleating agent may be added to a silver halide emulsion layer or any other layer on the silver halide emulsion layer side of a support, and preferably to the silver halide emulsion layer or a layer disposed adjacent thereto.

The nucleating agent is preferably used in an amount of $1\times10^{-6}$ mol to $1\times10^{-2}$ mol, more preferably $1\times10^{-5}$ mol to $5\times10^{-3}$ mol, and most preferably $2\times10^{-5}$ mol to $5\times10^{-3}$ mol per mol of silver.

Silver Halide

When the thermographic element of the invention is used as a photothermographic element, the element further contains a photosensitive silver halide. A method for forming the photosensitive silver halide is well known in the art. Any of the methods disclosed in Research Disclosure No. 17029 (June 1978) and U.S. Pat. No. 3,700,458, for example, may be used. Illustrative methods which can be used herein are a method of preparing an organic silver salt and adding a halogen-containing compound to the organic silver salt to convert a part of silver of the organic silver salt into photosensitive silver halide and a method of adding a silver-providing compound and a halogen-providing compound to a solution of gelatin or another polymer to form photosensitive silver halide grains and mixing the grains with an organic silver salt. The latter method is preferred in the practice of the invention. The photosensitive silver halide should preferably have a smaller mean grain size for the purpose of minimizing white turbidity after image formation. Specifically, the grain size is preferably up to 0.20 μm, more preferably 0.01 μm to 0.15 μm, most preferably 0.02 μm to 0.12 μm. The term grain size designates the length of an edge of a silver halide grain where silver halide grains are regular grains of cubic or octahedral shape. Where silver halide grains are tabular, the grain size is the diameter of an equivalent circle having the same area as the projected area of a major surface of a tabular grain. Where silver halide grains are not regular, for example, in the case of spherical or rod-shaped grains, the grain size is the diameter of an equivalent sphere having the same volume as a grain.

The shape of silver halide grains may be cubic, octahedral, tabular, spherical, rod-like and potato-like, with cubic and tabular grains being preferred in the practice of the invention. Where tabular silver halide grains are used, they should preferably have an average aspect ratio of from 100:1 to 2:1, more preferably from 50:1 to 3:1. Silver halide grains having rounded corners are also preferably used. No particular limit is imposed on the face indices (Miller indices) of an outer surface of photosensitive silver halide grains. Preferably silver halide grains have a high proportion of {100} face featuring high spectral sensitization efficiency upon adsorption of a spectral sensitizing dye. The proportion of {100} face is preferably at least 50%, more preferably at least 65%, most preferably at least 80%. Note that the proportion of Miller index {100} face can be determined by the method described in T. Tani, J. Imaging Sci., 29, 165 (1985), utilizing the adsorption dependency of {111} face and {100} face upon adsorption of a sensitizing dye.

The halogen composition of photosensitive silver halide is not critical and may be any of silver chloride, silver chlorobromide, silver bromide, silver iodobromide, silver iodochlorobromide, and silver iodide. Silver bromide or silver iodobromide is preferred in the practice of the invention. Most preferred is silver iodobromide preferably having a silver iodide content of 0.1 to 40 mol %, especially 0.1 to 20 mol %. The halogen composition in grains may have a uniform distribution or a non-uniform distribution wherein the halogen concentration changes in a stepped or continuous manner. Preferred are silver iodobromide grains having a higher silver iodide content in the interior. Silver halide grains of the core/shell structure are also useful. Such core/shell grains preferably have a multilayer structure of 2 to 5 layers, more preferably 2 to 4 layers.

Preferably the photosensitive silver halide grains used herein contain at least one complex of a metal selected from the group consisting of rhodium, rhenium, ruthenium, osmium, iridium, cobalt, and iron. The metal complexes may be used alone or in admixture of two or more complexes of a common metal or different metals. The metal complex is preferably contained in an amount of $1\times10^{-9}$ to $1\times10^{-2}$ mol, more preferably $1\times10^{-8}$ to $1\times10^{-4}$ mol per mol of silver. Illustrative metal complex structures are those described in JP-A 225449/1995. The cobalt and iron compounds are preferably hexacyano metal complexes while illustrative, non-limiting examples include ferricyanate, ferrocyanate, and hexacyanocobaltate ions. The distribution of the metal complex in silver halide grains is not critical. That is, the metal complex may be contained in silver halide grains to form a uniform phase or at a high concentration in either the core or the shell.

Photosensitive silver halide grains may be desalted by any of well-known water washing methods such as noodle and flocculation methods although silver halide grains may be either desalted or not according to the invention.

The photosensitive silver halide grains used herein should preferably be chemically sensitized. Preferred chemical sensitization methods are sulfur, selenium, and tellurium sensitization methods which are well known in the art. Also useful are a noble metal sensitization method using compounds of gold, platinum, palladium, and iridium and a reduction sensitization method. In the sulfur, selenium, and tellurium sensitization methods, any of compounds well known for the purpose may be used. For example, the compounds described in JP-A 128768/1995 are useful. Exemplary tellurium sensitizing agents include diacyltellurides, bis(oxycarbonyl)tellurides, bis(carbamoyl) tellurides, bis(oxycarbonyl)ditellurides, bis(carbamoyl) ditellurides, compounds having a P═Te bond, tellurocarboxylic salts, Te-organyltellurocarboxylic esters, di(poly) tellurides, tellurides, telluroles, telluroacetals, tellurosulfonates, compounds having a P—Te bond, Te-containing heterocycles, tellurocarbonyl compounds, inorganic tellurium compounds, and colloidal tellurium. The preferred compounds used in the noble metal sensitization method include chloroauric acid, potassium chloroaurate, potassium aurithiocyanate, gold sulfide, and gold selenide as well as the compounds described in U.S. Pat. No. 2,448,060 and BP 618,061. Illustrative examples of the compound used in the reduction sensitization method include ascorbic acid, thiourea dioxide, stannous chloride, aminoiminomethanesulfinic acid, hydrazine derivatives, borane compounds, silane compounds, and polyamine compounds. Reduction sensitization may also be accomplished by ripening the emulsion while maintaining it at pH 7 or higher or at pAg 8.3 or lower. Reduction sensitization may also be accomplished by introducing a single addition portion of silver ion during grain formation.

According to the invention, the photosensitive silver halide is preferably used in an amount of 0.01 to 0.5 mol, more preferably 0.02 to 0.3 mol, most preferably 0.03 to 0.25 mol per mol of the organic silver salt. With respect to a method and conditions of admixing the separately prepared photosensitive silver halide and organic silver salt, there may be used a method of admixing the separately prepared photosensitive silver halide and organic silver salt in a high speed agitator, ball mill, sand mill, colloidal mill, vibrating mill or homogenizer or a method of preparing an organic silver salt by adding the already prepared photosensitive silver halide at any timing during preparation of an organic silver salt. Any desired mixing method may be used insofar as the benefits of the invention are fully achievable.

Organic Silver Salt

The organic silver salt which can be used herein is relatively stable to light, but forms a silver image when heated at 80° C. or higher in the presence of an exposed photocatalyst (as typified by a latent image of photosensitive silver halide) and a reducing agent. The organic silver salt may be of any desired organic compound containing a source capable of reducing silver ion. Preferred are silver salts of organic acids, typically long chain aliphatic carboxylic acids having 10 to 30 carbon atoms, especially 15 to 28 carbon atoms. Also preferred are complexes of organic or inorganic silver salts with ligands having a stability constant in the range of 4.0 to 10.0. A silver-providing substance is preferably used in an amount of about 5 to 30% by weight of an image forming layer. Preferred organic silver salts include silver salts of organic compounds having a carboxyl group. Examples include silver salts of aliphatic carboxylic acids and silver salts of aromatic carboxylic acids though not limited thereto. Preferred examples of the silver salt of aliphatic carboxylic acid include silver behenate, silver stearate, silver oleate, silver laurate, silver caproate, silver myristate, silver palmitate, silver maleate, silver fumarate, silver tartrate, silver linolate, silver butyrate, silver camphorate and mixtures thereof.

Silver salts of compounds having a mercapto or thion group and derivatives thereof are also useful. Preferred examples of these compounds include a silver salt of 3-mercapto-4-phenyl-1,2,4-triazole, a silver salt of 2-mercaptobenzimidazole, a silver salt of 2-mercapto-5-aminothiadiazole, a silver salt of 2-(ethylglycolamido) benzothiazole, silver salts of thioglycolic acids such as silver salts of S-alkylthioglycolic acids wherein the alkyl group has 12 to 22 carbon atoms, silver salts of dithiocarboxylic acids such as a silver salt of dithioacetic acid, silver salts of thioamides, a silver salt of 5-carboxyl-1-methyl-2-phenyl-4-thiopyridine, silver salts of mercaptotriazines, a silver salt of 2-mercaptobenzoxazole as well as silver salts of 1,2,4-mercaptothiazole derivatives such as a silver salt of 3-amino-5-benzylthio-1,2,4-thiazole as described in U.S. Pat. No. 4,123,274 and silver salts of thion compounds such as a silver salt of 3-(3-carboxyethyl)-4-methyl-4-thiazoline-2-thione as described in U.S. Pat. No. 3,301,678. Compounds containing an imino group may also be used. Preferred examples of these compounds include silver salts of benzotriazole and derivatives thereof, for example, silver salts of benzotriazoles such as silver methylbenzotriazole, silver salts of halogenated benzotriazoles such as silver 5-chlorobenzotriazole as well as silver salts of 1,2,4-triazole and 1-H-tetrazole and silver salts of imidazole and imidazole derivatives as described in U.S. Pat. No. 4,220,709. Also useful are various silver acetylide compounds as described, for example, in U.S. Pat. Nos. 4,761,361 and 4,775,613.

The organic silver salt which can be used herein may take any desired shape although needle crystals having a minor axis and a major axis are preferred. The inverse proportional relationship between the size of silver salt crystal grains and their covering power that is well known for photosensitive silver halide materials also applies to the photothermographic material of the present invention. That is, as organic silver salt grains constituting image forming regions of photothermographic material increase in size, the covering power becomes smaller and the image density becomes lower. It is thus necessary to reduce the grain size of the organic silver salt. In the practice of the invention, grains should preferably have a minor axis of 0.01 $\mu$m to 0.20 $\mu$m, more preferably 0.01 $\mu$m to 0.15 $\mu$m and a major axis of 0.10 $\mu$m to 5.0 $\mu$m, more preferably 0.10 $\mu$m to 4.0 $\mu$m. The grain size distribution is desirably monodisperse. The monodisperse distribution means that a standard deviation of the length of minor and major axes divided by the length, respectively, expressed in percent, is preferably up to 100%, more preferably up to 80%, most preferably up to 50%. It can be determined from the measurement of the shape of organic silver salt grains using an image obtained through a transmission electron microscope. Another method for determining a monodisperse distribution is to determine a standard deviation of a volume weighed mean diameter. The standard deviation divided by the volume weighed mean diameter, expressed in percent, which is a coefficient of variation, is preferably up to 100%, more preferably up to 80%, most preferably up to 50%. It may be determined by irradiating laser light, for example, to organic silver salt grains dispersed in liquid and determining the autocorrelation function of the fluctuation of scattering light relative to a time change, and obtaining the grain size (volume weighed mean diameter) therefrom.

Sensitizing Dye

A sensitizing dye may be used in the practice of the invention. There may be used any of sensitizing dyes which can spectrally sensitize silver halide grains in a desired wavelength region when adsorbed to the silver halide grains. The sensitizing dyes used herein include cyanine dyes, merocyanine dyes, complex cyanine dyes, complex merocyanine dyes, holopolar cyanine dyes, styryl dyes, hemicyanine dyes, oxonol dyes, and hemioxonol dyes. Useful sensitizing dyes which can be used herein are described in Research Disclosure, Item 17643 IV-A (December 1978, page 23), ibid., Item 1831 X (August 1979, page 437) and the references cited therein. It is advantageous to select a sensitizing dye having appropriate spectral sensitivity to the spectral properties of a particular light source of various laser imagers, scanners, image setters and printing plate-forming cameras.

Exemplary dyes for spectral sensitization to red light include compounds I-1 to I-38 described in JP-A 18726/1979, compounds I-1 to I-35 described in JP-A 75322/1994, and compounds I-1 to I-34 described in JP-A 287338/1995 for He—Ne laser light sources, and dyes 1 to 20 described in JP-B 39818/1980, compounds I-1 to I-37 described in JP-A 284343/1987, and compounds I-1 to I-34 described in JP-A 287338/1995 for LED light sources.

In the practice of the invention, silver halide grains are spectrally sensitized at any desired band in the wavelength range of 750 to 1,400 nm. More specifically, spectral sensitization of photosensitive silver halide may be advantageously done with various known dyes including cyanine, merocyanine, styryl, hemicyanine, oxonol, hemioxonol, and xanthene dyes. Useful cyanine dyes are cyanine dyes having a basic nucleus such as a thiazoline, oxazoline, pyrroline, pyridine, oxazole, thiazole, selenazole and imidazole nucleus. Preferred examples of the useful merocyanine dye contain an acidic nucleus such as a thiohydantoin, rhodanine, oxazolidinedione, thiazolinedione, barbituric acid, thiazolinone, malononitrile, and pyrazolone nucleus in addition to the above-mentioned basic nucleus. Among the above-mentioned cyanine and merocyanine dyes, those having an imino or carboxyl group are especially effective. A suitable choice may be made of well-known dyes as described, for example, in U.S. Pat. Nos. 3,761,279, 3,719,495, and 3,877,943, BP 1,466,201, 1,469,117, and 1,422,057, JP-B 10391/1991 and 52387/1994, JP-A 341432/1993, 194781/1994, and 301141/1994. Especially preferred dye structures are cyanine dyes having a thioether bond, examples of which are the cyanine dyes described in JP-A 58239/1987, 138638/1991, 138642/1991, 255840/1992, 72659/1993, 72661/1993, 222491/1994, 230506/1990, 258757/1994, 317868/1994, and 324425/1994, Publication of International Patent Application No. 500926/1995.

These sensitizing dyes may be used alone or in admixture of two or more. A combination of sensitizing dyes is often used for the purpose of supersensitization. In addition to the sensitizing dye, the emulsion may contain a dye which itself has no spectral sensitization function or a compound which does not substantially absorb visible light, but is capable of supersensitization. Useful sensitizing dyes, combinations of dyes showing supersensitization, and compounds showing supersensitization are described in Research Disclosure, Vol. 176, 17643 (December 1978), page 23, IV J and JP-B 25500/1974 and 4933/1968, JP-A 19032/1984 and 192242/1984.

The sensitizing dye may be added to a silver halide emulsion by directly dispersing the dye in the emulsion or by dissolving the dye in a solvent and adding the solution to the emulsion. The solvent used herein includes water, methanol, ethanol, propanol, acetone, methyl cellosolve, 2,2,3,3-tetrafluoropropanol, 2,2,2-trifluoroethanol, 3-methoxy-1-propanol, 3-methoxy-1-butanol, 1-methoxy-2-propanol, N,N-dimethylformamide and mixtures thereof.

Also useful are a method of dissolving a dye in a volatile organic solvent, dispersing the solution in water or hydrophilic colloid and adding the dispersion to an emulsion as disclosed in U.S. Pat. No. 3,469,987, a method of dissolving a dye in an acid and adding the solution to an emulsion or forming an aqueous solution of a dye with the aid of an acid or base and adding it to an emulsion as disclosed in JP-B 23389/1969, 27555/1969 and 22091/1982, a method of forming an aqueous solution or colloidal dispersion of a dye with the aid of a surfactant and adding it to an emulsion as disclosed in U.S. Pat. Nos. 3,822,135 and 4,006,025, a method of directly dispersing a dye in hydrophilic colloid and adding the dispersion to an emulsion as disclosed in JP-A 102733/1978 and 105141/1983, and a method of dissolving a dye using a compound capable of red shift and adding the solution to an emulsion as disclosed in JP-A 74624/1976. It is also acceptable to apply ultrasonic waves to form a solution.

The time when the sensitizing dye is added to the silver halide emulsion according to the invention is at any step of an emulsion preparing process which has been ascertained effective. The sensitizing dye may be added to the emulsion at any stage or step before the emulsion is coated, for example, at a stage prior to the silver halide grain forming step and/or desalting step, during the desalting step and/or a stage from desalting to the start of chemical ripening as disclosed in U.S. Pat. Nos. 2,735,766, 3,628,960, 4,183,756, and 4,225,666, JP-A 184142/1983 and 196749/1985, and a stage immediately before or during chemical ripening and a stage from chemical ripening to emulsion coating as disclosed in JP-A 113920/1983. Also as disclosed in U.S. Pat. No. 4,225,666 and JP-A 7629/1983, an identical compound may be added alone or in combination with a compound of different structure in divided portions, for example, in divided portions during a grain forming step and during a chemical ripening step or after the completion of chemical ripening, or before or during chemical ripening and after the completion thereof. The type of compound or the combination of compounds to be added in divided portions may be changed.

Reducing Agent

The thermographic element of the invention contains a reducing agent for the organic silver salt. The reducing agent for the organic silver salt may be any of substances, preferably organic substances, that reduce silver ion into metallic silver. Conventional photographic developing agents such as Phenidone®, hydroquinone and catechol are useful although hindered phenols are preferred reducing agents. The reducing agent should preferably be contained in an amount of 1 to 10% by weight of the image forming layer. In a multi-layer construction where the reducing agent is added to a layer other than the emulsion layer, the reducing agent should desirably be contained in a slightly greater amount of about 2 to 15% by weight of the layer.

For photothermographic elements using organic silver salts, a wide range of reducing agents are disclosed. Exemplary reducing agents include amidoximes such as phenylamidoxime, 2-thienylamidoxime, and p-phenoxyphenylamidoxime; azines such as 4-hydroxy-3,5-dimethoxybenzaldehydeazine; combinations of aliphatic carboxylic acid arylhydrazides with ascorbic acid such as a combination of 2,2'-bis(hydroxymethyl)propionyl-β-phenylhydrazine with ascorbic acid; combinations of polyhydroxybenzenes with hydroxylamine, reductone and/or hydrazine, such as combinations of hydroquinone with bis(ethoxyethyl)hydroxylamine, piperidinohexosereductone or formyl-4-methylphenylhydrazine; hydroxamic acids such as phenylhydroxamic acid, p-hydroxyphenylhydroxamic acid, and β-anilinehydroxamic acid; combinations of azines with sulfonamidophenols such as a combination of phenothiazine with 2,6-dichloro-4-benzenesulfonamidephenol; α-cyanophenyl acetic acid derivatives such as ethyl-α-cyano-2-methylphenyl acetate and ethyl-α-cyanophenyl acetate; bis-β-naphthols such as 2,2'-dihydroxy-1,1'-binaphthyl, 6,6'-dibromo-2,2'-dihydroxy-l,1'-binaphthyl, and bis(2-hydroxy-1-naphthyl)methane; combinations of bis-β-naphthols with 1,3-dihydroxybenzene derivatives such as 2,4-dihydroxybenzophenone and 2',4'-dihydroxyacetophenone; 5-pyrazolones such as 3-methyl-1-phenyl-5-pyrazolone; reductones such as dimethylaminohexosereductone, anhydrodihydroaminohexosereductone and anhydrodihydropiperidonehexosereductone; sulfonamidephenol reducing agents such as 2,6-dichloro-4-benzenesulfonamidephenol and p-benzenesulfonamidephenol; 2-phenylindane-1,3-dione, etc.; chromans such as 2,2-dimethyl-7-t-butyl-6-hydroxychroman; 1,4-dihydropyridines such as 2,6-dimethoxy-3,5-dicarboethoxy-1,4-dihydropyridine; bisphenols such as bis(2-hydroxy-3-t-butyl-5-methylphenyl)methane, 2,2-bis(4-hydroxy-3-methylphenyl)propane, 4,4-ethylidene-bis(2-t-butyl-6-methylphenol), 1,1-bis(2-hydroxy-3,5-dimethylphenyl)-3,5,5-trimethylhexane, and 2,2-bis(3,5-dimethyl-4-hydroxyphenyl)propane; ascorbic acid derivatives such as 1-ascorbyl palmitate and ascorbyl stearate; aldehydes and ketones such as benzil and diacetyl; and 3-pyrazolidones and certain indane-1,3-diones.

Especially preferred reducing agents for use in the practice of the invention are compounds of the following general formulae (R-I), (R-II), (R-III) and (R-IV).

(R-I)

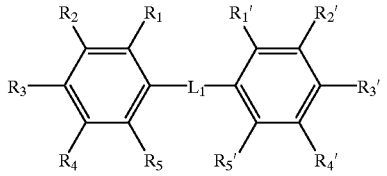

(R-II)

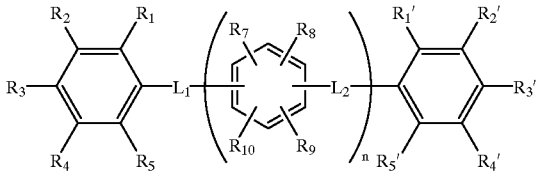

(R-III)

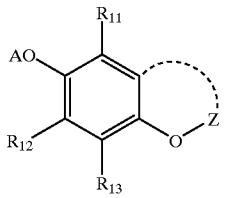

(R-IV)

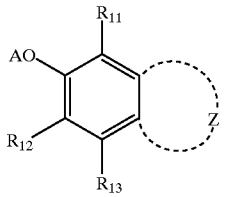

In formula (R-III), Z forms a cyclic structure represented by the following formula (Z-1) or (Z-2).

(Z-1)

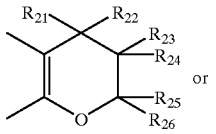

(Z-2)

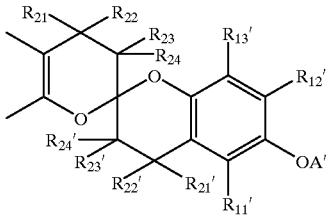

In formula (R-IV), Z forms a cyclic structure represented by the following formula (Z-3) or (Z-4).

(Z-1)

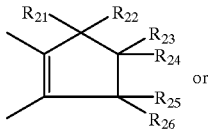

(Z-2)

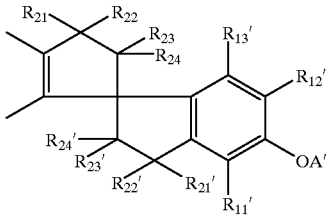

In formulae (R-I) and (R-II), each of $L_1$ and $L_2$ is a group CH—$R_6$, CH—$R_6$' or a sulfur atom, and n is a natural number.

Herein, Ri is used as a representative of $R_1$ to $R_{10}$, $R_1$' to $R_5$', $R_6$', $R_{11}$ to $R_{13}$, $R_{11}$' to $R_{13}$', $R_{21}$ to $R_{26}$, and $R_{21}$' to $R_{24}$', Ri stands for hydrogen atoms, alkyl groups having 1 to 30 carbon atoms, aryl groups, aralkyl groups, halogen atoms, amino groups or substituents represented by —O—A, with the proviso that at least one of $R_1$ to $R_5$, at least one of $R_1$' to $R_5$', and at least one of $R_7$ to $R_{10}$ each are a group represented by —O—A. Alternatively, Ri groups, taken together, may form a ring. A and A' each are a hydrogen atom, alkyl group having 1 to 30 carbon atoms, acyl group having 1 to 30 carbon atoms, aryl group, phosphate group or sulfonyl group.

Ri, A and A' may be substituted groups while typical examples of the substituent include alkyl groups (including active methylene groups), nitro groups, alkenyl groups, alkynyl groups, aryl groups, heterocyclic ring-containing groups, heterocyclic groups containing a quaternized nitrogen atom (e.g., pyridinio group), hydroxy groups, alkoxy groups (including groups containing recurring ethyleneoxy or propyleneoxy units), aryloxy groups, acyloxy groups, acyl groups, alkoxycarbonyl groups, aryloxycarbonyl groups, carbamoyl groups, urethane groups, carboxyl groups, imido groups, amino groups, carbonamide groups, sulfonamide groups, ureido groups, thioureido groups, sulfamoylamino groups, semicarbazide groups, thiosemicarbazide groups, hydrazino-containing groups, quaternary ammonium-containing groups, mercapto groups, (alkyl, aryl or heterocyclic) thio groups, (alkyl or aryl) sulfonyl groups, (alkyl or aryl) sulfinyl groups, sulfo groups, sulfamoyl groups, acylsulfamoyl groups, (alkyl or aryl) sulfonylureido groups, (alkyl or aryl) sulfonylcarbamoyl groups, halogen atoms, cyano groups, phosphoramide groups, phosphate structure-containing groups, acylurea structure-bearing groups, selenium or tellurium atom-containing groups, and tertiary or quaternary sulfonium structure-bearing groups. These substituents on Ri, A and A' may be further substituted, with preferred examples of the further substituent being the same as the foregoing substituents exemplified for Ri. The further substituent, in turn, may be further substituted, the still further substituent, in turn, may be further substituted, and so on. In this way, multiple substitution is acceptable while preferred substituents are those groups exemplified as the substituent on Ri, A and A'.

Illustrative, non-limiting, examples of the compounds represented by formulae (R-I), (R-II), (R-III) and (R-IV) are given below.

| No. | $R_1$,$R_{1'}$ | $R_2$,$R_{2'}$ | $R_3$,$R_{3'}$ | $R_4$,$R_{4'}$ | $R_5$,$R_{5'}$ | $L_1$ | $R_6$ |
|---|---|---|---|---|---|---|---|
| R-I-1 | —OH | —$CH_3$ | —H | —$CH_3$ | —H | CH—R6 | —H |
| R-I-2 | —OH | —$CH_3$ | —H | —$CH_3$ | —H | CH—R6 | —$CH_3$ |
| R-I-3 | —OH | —$CH_3$ | —H | —$CH_3$ | —H | CH—R6 | —$C_3H_7$ |
| R-I-4 | —OH | —$CH_3$ | —H | —$CH_3$ | —H | CH—R6 | —$C_5H_{11}$ |
| R-I-5 | —OH | —$CH_3$ | —H | —$CH_3$ | —H | CH—R6 | —TMB |
| R-I-6 | —OH | —$CH_3$ | —H | —$CH_3$ | —H | CH—R6 | —$C_9H_{19}$ |
| R-I-7 | —OH | —$CH_3$ | —H | —$CH_3$ | —H | S | — |
| R-I-8 | —OH | —$CH_3$ | —H | —$C_2H_5$ | —H | S | — |
| R-I-9 | —OH | —$CH_3$ | —H | —$C_4H_9$(t) | —H | S | — |
| R-I-10 | —OH | —$C_4H_9$(t) | —H | —$CH_3$ | —H | CH—R6 | —H |
| R-I-11 | —OH | —$C_4H_9$(t) | —H | —$CH_3$ | —H | CH—R6 | —$CH_3$ |
| R-I-12 | —OH | —$C_4H_9$(t) | —H | —$CH_3$ | —H | CH—R6 | —TMB |
| R-I-13 | —OH | —$C_4H_9$(t) | —H | —$C_2H_5$ | —H | CH—R6 | —Ph |
| R-I-14 | —OH | —CHex | —H | —$CH_3$ | —H | S | — |
| R-I-15 | —OH | —$C_4H_9$(t) | —H | —$C_2H_5$ | —H | S | — |
| R-I-16 | —OH | —$C_2H_5$ | —H | —$C_4H_9$(t) | —H | CH—R6 | —H |
| R-I-17 | —OH | —$C_2H_5$ | —H | —$C_4H_9$(t) | —H | CH—R6 | —$CH_3$ |
| R-I-18 | —OH | —$C_2H_5$ | —H | —$C_4H_9$(t) | —H | CH—R6 | —TMB |
| R-I-19 | —OH | —$CH_3$ | —H | —$C_4H_9$(t) | —H | CH—R6 | —Ph |
| R-I-20 | —OH | —$CH_3$ | —Cl | —$C_4H_9$(t) | —H | CH—R6 | —H |
| R-I-21 | —OH | —$CH_3$ | —H | —$C_4H_9$(t) | —OCH3 | CH—R6 | —H |

-continued

| No. | $R_1$,$R_{1'}$ | $R_2$,$R_{2'}$ | $R_3$,$R_{3'}$ | $R_4$,$R_{4'}$ | $R_5$,$R_{5'}$ | $L_1$ | $R_6$ |
|---|---|---|---|---|---|---|---|
| R-I-22 | —H | —$C_4H_9$(t) | —OH | —CPen | —H | CH—R6 | —H |
| R-I-23 | —H | —$C_4H_9$(t) | —OH | —$C_4H_9$(t) | —H | CH—R6 | —TMB |
| R-I-24 | —H | —$C_4H_9$(t) | —OH | —H | —H | CH—R6 | —H |
| R-I-25 | —H | —$C_4H_9$(t) | —OH | —H | —H | CH—R6 | —$C_3H_7$ |
| R-I-26 | —H | —$CH_3$ | —OH | —$C_4H_9$(t) | —H | CH—R6 | —TMB |
| R-I-27 | —H | —$C_2H_5$ | —OH | —$C_4H_9$(t) | —H | CH—R6 | —H |
| R-I-28 | —H | —$CH_3$ | —OH | —$C_2H_5$ | —H | CH—R6 | —TMB |
| R-I-29 | —H | —$CH_3$ | —OH | —$CH_3$ | —H | S | — |
| R-I-30 | —H | —$CH_3$ | —OH | —$CH_3$ | —Cl | S | — |
| R-I-31 | —H | —$CH_3$ | —OH | —$C_2H_5$ | —H | S | — |
| R-I-32 | —H | —$C_2H_5$ | —OH | —$C_2H_5$ | —H | S | — |
| R-I-33 | —H | —$C_2H_5$ | —OH | —$CH_3$ | —Cl | S | — |
| R-I-34 | —H | —$CH_3$ | —OH | —$C_4H_9$(t) | —H | S | — |
| R-I-35 | —H | —CHex | —OH | —$C_4H_9$(t) | —H | S | — |

TMB: 1,3,3-trimethylbutyl group —CH(—$CH_3$)—$CH_2$—C(—$CH_3$)$_3$
CPen: cyclopentyl group
CHex: cyclohexyl group (R-I)

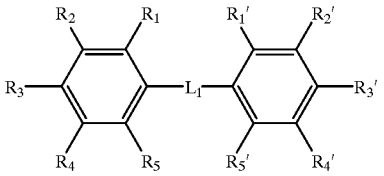

| No. | $R_1$ | $R_2$ | $R_3$ | $R_4$ | $R_5$ | $R_{1'}$ | $R_{2'}$ | $R_{3'}$ | $R_{4'}$ | $R_{5'}$ | $L_1$ | $R_6$ |
|---|---|---|---|---|---|---|---|---|---|---|---|---|
| R-I-36 | —OH | —$CH_3$ | —H | —$CH_3$ | —H | —H | —$CH_3$ | —OH | —$CH_3$ | —H | CH—R6 | —H |
| R-I-37 | —OH | —$C_4H_9$(t) | —H | —$CH_3$ | —H | —H | —$CH_3$ | —OH | —$CH_3$ | —H | CH—R6 | —H |
| R-I-38 | —OH | —$CH_3$ | —H | —$CH_3$ | —H | —H | —CHex | —OH | —$CH_3$ | —H | CH—R6 | —$CH_3$ |
| R-I-39 | —OH | —$C_4H_9$(t) | —H | —$CH_3$ | —H | —H | —$CH_3$ | —OH | —$CH_3$ | —H | CH—R6 | —$CH_3$ |
| R-I-40 | —OH | —$CH_3$ | —H | —$CH_3$ | —H | —H | —$CH_3$ | —OH | —$CH_3$ | —H | CH—R6 | —TMB |
| R-I-41 | —OH | —$C_4H_9$(t) | —H | —$CH_3$ | —H | —H | —$CH_3$ | —OH | —$CH_3$ | —H | CH—R6 | —TMB |
| R-I-42 | —OH | —$CH_3$ | —H | —$CH_3$ | —H | —H | —$CH_3$ | —OH | —$CH_3$ | —H | S | — |
| R-I-43 | —OH | —$C_4H_9$(t) | —H | —$CH_3$ | —H | —H | —$CH_3$ | —OH | —$CH_3$ | —H | S | — |
| R-I-44 | —OH | —$CH_3$ | —H | —$CH_3$ | —H | —H | —CHex | —OH | —$CH_3$ | —H | S | — |

CHex: cyclohexyl group (R-I)

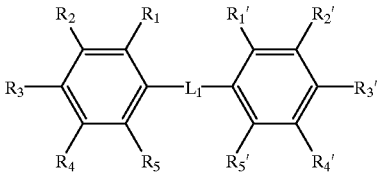

R-I-45

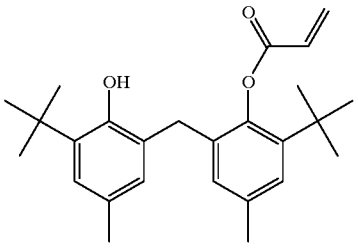

-continued

R-I-46

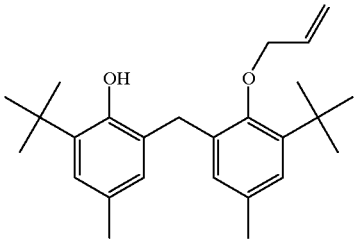

-continued

R-I-47

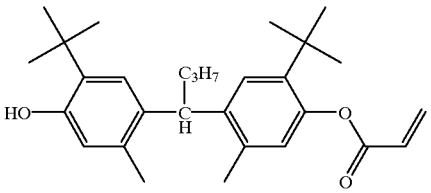

R-I-48

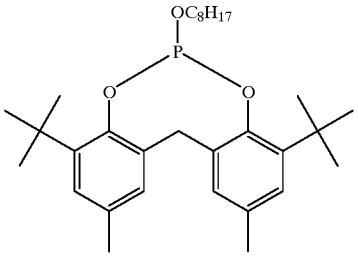

R-I-49

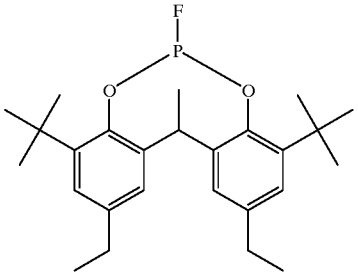

R-I-50

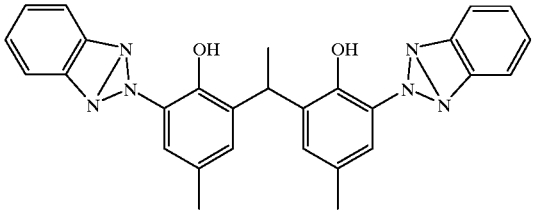

R-I-51

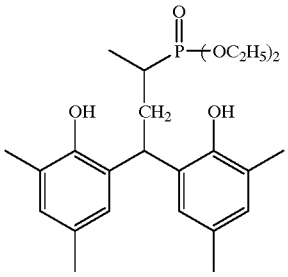

-continued

R-I-51

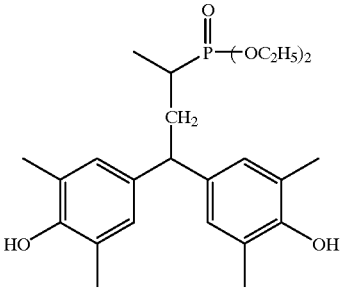

R-I-53

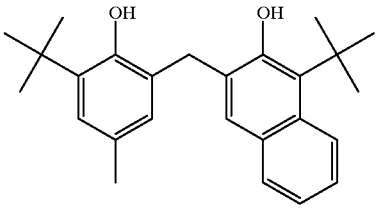

R-I-54

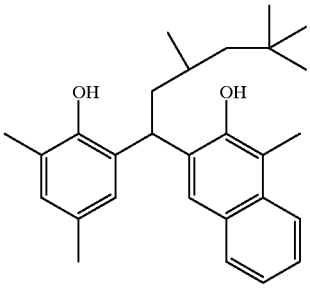

R-I-55

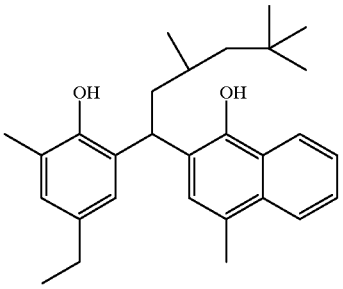

| No. | $R_1,R_{1'}$ | $R_2,R_{2'}$ | $R_3,R_{3'}$ | $R_4,R_{4'}$ | $R_5,R_{5'}$ | $R_7$ | $R_8$ | $R_9$ | $R_{10}$ | $L_1$ | $R_6$ | $L_2$ | $R_{6'}$ | n |
|---|---|---|---|---|---|---|---|---|---|---|---|---|---|---|
| R-II-1 | —OH | —$C_4H_9$(t) | —H | —$CH_3$ | —H | —OH | —$CH_3$ | —$CH_3$ | —H | CH—R6 | —H | CH—R6 | —$CH_3$ | 1 |
| R-II-2 | —OH | —$CH_3$ | —H | —$CH_3$ | —H | —OH | —$C_2H_5$ | —$CH_3$ | —H | CH—R6 | —TMB | CH—R6 | —$CH_3$ | 1 |
| R-II-3 | —OH | —$C_4H_9$(t) | —H | —$CH_3$ | —H | —OH | —$CH_3$ | —$CH_3$ | —H | CH—R6 | —H | CH—R6 | —TMB | 3 |
| R-II-4 | —OH | —$CH_3$ | —H | —$CH_3$ | —H | —OH | —$C_2H_5$ | —$CH_3$ | —H | CH—R6 | —TMB | CH—R6 | —TMB | 2 |
| R-II-5 | —H | —$C_4H_9$(t) | —OH | —$CH_3$ | —H | —OH | —$CH_3$ | —$CH_3$ | —H | S | — | CH—R6 | —$CH_3$ | 1 |
| R-II-6 | —H | —$CH_3$ | —OH | —$CH_3$ | —H | —OH | —$C_2H_5$ | —$CH_3$ | —H | S | — | S | — | 1 |
| R-II-7 | —H | —$C_4H_9$(t) | —OH | —$CH_3$ | —H | —OH | —$CH_3$ | —$CH_3$ | —H | S | — | S | — | 2 |

-continued

| No. | $R_1,R_{1'}$ | $R_2,R_{2'}$ | $R_3,R_{3'}$ | $R_4,R_{4'}$ | $R_5,R_{5'}$ | $R_7$ | $R_8$ | $R_9$ | $R_{10}$ | $L_1$ | $R_6$ | $L_2$ | $R_{6'}$ | n |
|---|---|---|---|---|---|---|---|---|---|---|---|---|---|---|
| R-II-8 | —H | —$CH_3$ | —OH | —$CH_3$ | —H | —OH | —$C_2H_5$ | —$CH_3$ | —H | S | — | CH—R6 | —TMB | 3 |

(R-II)

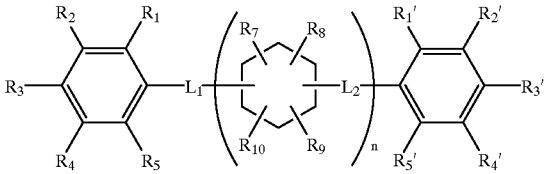

| No. | Z | $R_{11}$ | $R_{12}$ | $R_{13}$ | $R_{21}$ | $R_{22}$ | $R_{23}$ | $R_{24}$ | $R_{25}$ | $R_{26}$ | A |
|---|---|---|---|---|---|---|---|---|---|---|---|
| R-III-1 | Z-1 | —$CH_3$ | —$CH_3$ | —$CH_3$ | —H | —H | —H | —H | —$CH_3$ | —$C_{16}H_{33}$ | —H |
| R-III-2 | Z-1 | —$CH_3$ | —$CH_3$ | —$CH_3$ | —H | —H | —H | —H | —$CH_3$ | —$C_{16}H_{13}$ | —H |
| R-III-3 | Z-1 | —$CH_3$ | —$C_8H_{17}$ | —H | —H | —$CH_3$ | —H | —H | —$CH_3$ | —$CH_3$ | —H |
| R-III-4 | Z-1 | —H | —$C_8H_{17}$ | —H | —H | —$CH_3$ | —H | —H | —$CH_3$ | —$CH_3$ | —H |
| R-III-5 | Z-1 | —H | —H | —$CH_3$ | —H | —H | —H | —H | —$CH_3$ | —$C_{16}H_{33}$ | —H |
| R-III-6 | Z-1 | —H | —$CH_3$ | —H | —$CH_3$ | —$CH_3$ | —H | —H | —$CH_3$ | —$CH_3$ | —H |
| R-III-7 | Z-1 | —H | —$CH_3$ | —H | —$CH_3$ | —$CH_3$ | —H | —H | —$CH_3$ | —DHP | —H |

DHP: 2,4-dihydroxyphenyl group (R-III)

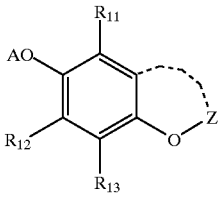

(Z-1)

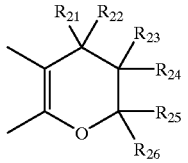

| No. | Z | $R_{11},R_{11'}$ | $R_{12},R_{12'}$ | $R_{13},R_{13'}$ | $R_{21},R_{22}$ | $R_{21'}, R_{22'}$ | $R_{23},R_{24}$ | $R_{23'},R_{24'}$ | A |
|---|---|---|---|---|---|---|---|---|---|
| R-III-8 | Z-2 | —H | —$CH_3$ | —H | —$CH_3$ | —$CH_3$ | —H | —H | —H |
| R-III-9 | Z-2 | —$CH_3$ | —$CH_3$ | —$CH_3$ | —H | —H | —$CH_3$ | —$CH_3$ | —H |
| R-III-10 | Z-2 | —$CH_3$ | —$CH_3$ | —$CH_3$ | —H | —H | —H | —H | —H |
| R-III-11 | Z-2 | —$CH_3$ | —OH | —$CH_3$ | —$CH_3$ | —$CH_3$ | —H | —H | —H |
| R-III-12 | Z-2 | —H | —OH | —$CH_3$ | —$CH_3$ | —$CH_3$ | —H | —H | —H |

-continued
| No. | Z | $R_{11}$,$R_{11'}$ | $R_{12}$,$R_{12'}$ | $R_{13}$,$R_{13'}$ | $R_{21}$,$R_{22}$ | $R_{21'}$, $R_{22'}$ | $R_{23}$,$R_{24}$ | $R_{23'}$,$R_{24'}$ | A |
|---|---|---|---|---|---|---|---|---|---|
(R-III)
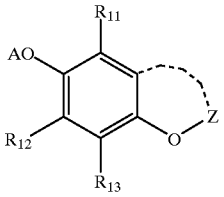
(Z-2)
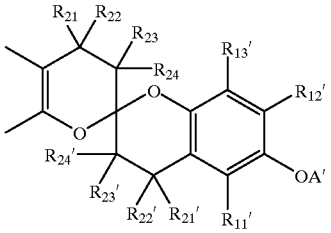
25
| No. | Z | $R_{11}$ | $R_{12}$ | $R_{13}$ | $R_{21}$,$R_{22}$ | $R_{23}$,$R_{24}$ | $R_{25}$,$R_{26}$ | A |
|---|---|---|---|---|---|---|---|---|
| R-IV-1 | Z-3 | —H | —OH | —$CH_3$ | —$CH_3$ | —H | —H | —H |
| R-IV-2 | Z-3 | —$CH_3$ | —$CH_3$ | —$CH_3$ | —$CH_3$ | —H | —H | —H |
(R-IV)
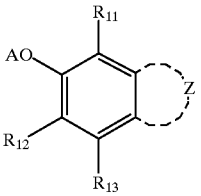
(Z-3)
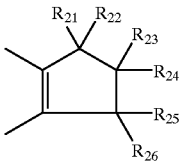
| No. | Z | $R_{11}$,$R_{11'}$ | $R_{12}$,$R_{12'}$ | $R_{13}$,$R_{13'}$ | $R_{21}$,$R_{21'}$ | $R_{22}$,$R_{22'}$ | $R_{23}$,$R_{24}$ | $R_{23'}$,$R_{24'}$ | A |
|---|---|---|---|---|---|---|---|---|---|
| R-IV-3 | Z-4 | —$CH_3$ | —H | —H | —$CH_3$ | —$CH_3$ | —H | —H | —H |
| R-IV-4 | Z-4 | —$CH_3$ | —$CH_3$ | —H | —$CH_3$ | —$CH_3$ | —H | —H | —H |
| R-IV-5 | Z-4 | —$CH_3$ | —H | —H | —$C_2H_5$ | —$CH_3$ | —H | —H | —H |

-continued

| No. | Z | $R_{11}$,$R_{11'}$ | $R_{12}$,$R_{12'}$ | $R_{13}$,$R_{13'}$ | $R_{21}$,$R_{21'}$ | $R_{22}$,$R_{22'}$ | $R_{23}$,$R_{24}$ | $R_{23'}$,$R_{24'}$ | A |
|---|---|---|---|---|---|---|---|---|---|

(R-IV)

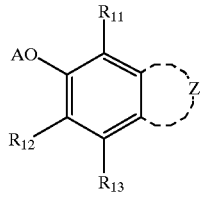

(Z-4)

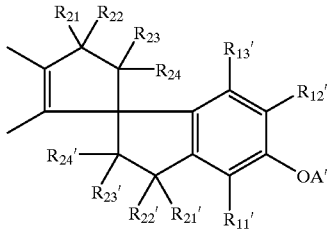

The reducing agents are preferably used in amounts of $1\times10^{-3}$ to 10 mol, more preferably $1\times10^{-2}$ to 1.5 mol per mol of silver.

In the thermographic element of the invention, mercapto and thion compounds may be added for the purposes of retarding or accelerating development to control development, improving spectral sensitization efficiency, and improving storage stability before and after development.

Where mercapto compounds are used herein, any structure is acceptable. Preferred are structures represented by Ar—S—M wherein M is a hydrogen atom or alkali metal atom, and Ar is an aromatic ring or fused aromatic ring having at least one nitrogen, sulfur, oxygen, selenium or tellurium atom. Preferred hetero-aromatic rings are benzimidazole, naphthimidazole, benzothiazole, naphthothiazole, benzoxazole, naphthoxazole, benzoselenazole, benzotellurazole, imidazole, oxazole, pyrrazole, triazole, thiadiazole, tetrazole, triazine, pyrimidine, pyridazine, pyrazine, pyridine, purine, quinoline and quinazolinone rings. These hetero-aromatic rings may have a substituent selected from the group consisting of halogen (e.g., Br and Cl), hydroxy, amino, carboxy, alkyl groups (having at least 1 carbon atom, preferably 1 to 4 carbon atoms), and alkoxy groups (having at least 1 carbon atom, preferably 1 to 4 carbon atoms). Illustrative, non-limiting examples of the mercapto-substituted hetero-aromatic compound include 2-mercaptobenzimidazole, 2-mercaptobenzoxazole, 2-mercaptobenzothiazole, 2-mercapto-5-methylbenzimidazole, 6-ethoxy-2-mercaptobenzothiazole, 2,2'-dithiobis(benzothiazole), 3-mercapto-1,2,4-triazole, 4,5-diphenyl-2-imidazolethiol, 2-mercaptoimidazole, 1-ethyl-2-mercaptobenzimidazole, 2-mercaptoquinoline, 8-mercaptopurine, 2-mercapto-4(3H)-quinazolinone, 7-trifluoromethyl-4-quinolinethiol, 2,3,5,6-tetrachloro-4-pyridinethiol, 4-amino-6-hydroxy-2-mercaptopyrimidine monohydrate, 2-amino-5-mercapto-1,3,4-thiadiazole, 3-amino-5-mercapto-1,2,4-triazole, 4-hydroxy-2-mercaptopyrimidine, 2-mercaptopyrimidine, 4,6-diamino-2-mercaptopyrimidine, 2-mercapto-4-methylpyrimidine hydrochloride, 3-mercapto-5-phenyl-1,2,4-triazole, and 2-mercapto-4-phenyloxazole.

These mercapto compounds are preferably added to the emulsion layer (serving as the image forming layer) in amounts of $1\times10^{-6}$ to 1 mol, more preferably $1\times10^{-5}$ to 0.3 mol per mol of silver.

Toner

Better results are sometimes obtained when an additive known as a "toner" for improving images is contained. The toner is preferably used in an amount of 0.1 to 10% by weight of the overall silver-carrying components. The toners are well-known substances in the photographic art as disclosed in U.S. Pat. Nos. 3,080,254, 3,847,612 and 4,123,282.

Examples of the toner include phthalimide and N-hydroxyphthalimide; cyclic imides such as succinimide, pyrazolin-5-one, quinazolinone, 3-phenyl-2-pyrazolin-5-one, 1-phenylurazol, quinazoline and 2,4-thiazolizinedione; naphthalimides such as N-hydroxy-1,8-naphthalimide; cobalt complexes such as cobaltic hexamine trifluoroacetate; mercaptans as exemplified by 3-mercapto-1,2,4-triazole, 2,4-dimercaptopyrimidine, 3-mercapto-4,5-diphenyl-1,2,4-triazole, and 2,5-dimercapto-1,3,4-thiadiazole; N-(aminomethyl)aryldicarboxyimides such as (N,N-dimethylaminomethyl)phthalimide and N,N-(dimethylaminomethyl)naphthalene-2,3-dicarboxyimide; blocked pyrazoles, isothiuronium derivatives and certain photo-bleach agents such as N,N'-hexamethylenebis(1-carbamoyl-3,5-dimethylpyrazole), 1,8-(3,6-diazaoctane) bis(isothiuroniumtrifluoroacetate) and 2-tribromomethylsulfonyl-benzothiazole; 3-ethyl-5-{(3-ethyl-2-benzothiazolinylidene)-1-methylethylidene}-2-thio-2,4-oxazolidinedione; phthalazinone, phthalazinone derivatives or metal salts, or derivatives such as 4-(1-naphthyl)phthalazinone, 6-chlorophthalazinone, 5,7-dimethoxyphthalazinone and 2,3-dihydro-1,4-phthalazinedione; combinations of phthalazinones with phthalic acid derivatives (e.g., phthalic acid, 4-methylphthalic acid, 4-nitrophthalic acid and tetrachlorophthalic anhydride); phthalazine, phthalazine derivatives or metal salts such as 4-(1-naphthyl)phthalazine, 6-chlorophthalazine, 5,7-dimethoxyphthalazine and 2,3-dihydrophthalazine; combinations of phthalazine with phthalic acid derivatives (e.g., phthalic acid, 4-methylphthalic acid, 4-nitrophthalic acid and tetrachlorophthalic anhydride); quinazolinedione, benzoxazine or naphthoxazine derivatives; rhodium complexes which function not only as a tone regulating agent, but also as a source of halide ion for generating silver halide in situ, for example, ammonium hexachlororhodinate (III), rhodium bromide, rhodium nitrate and potassium hexachlororhodinate (III); inorganic peroxides and persulfates such as ammonium peroxide disulfide and hydrogen peroxide; benzoxazine-2,4-diones such as 1,3-benzoxazine-2,4-dione, 8-methyl-1,3-benzoxazine-2,4-dione, and 6-nitro-1,3-benzoxazine-2,4-dione; pyrimidine and asym-triazines such as 2,4-dihydroxypyrimidine and 2-hydroxy-4-aminopyrimidine; azauracil and tetraazapentalene derivatives such as 3,6-dimercapto-1,4-diphenyl-1H,4H-2,3a,5,6a-tetraazapentalene, and 1,4-di(o-chlorophenyl)-3,6-dimercapto-1H,4H-2,3a,5,6a-tetraazapentalene.

Binder

The emulsion layer used herein is usually based on a binder. Exemplary binders are naturally occurring polymers and synthetic resins, for example, gelatin, polyvinyl acetal, polyvinyl chloride, polyvinyl acetate, cellulose acetate, polyolefins, polyesters, polystyrene, polyacrylonitrile, and polycarbonate. Of course, copolymers and terpolymers are included. Preferred polymers are polyvinyl butyral, butylethyl cellulose, methacrylate copolymers, maleic anhydride ester copolymers, polystyrene and butadiene-styrene copolymers. These polymers may be used alone or in admixture of two or more as desired. The polymer is used in such a range that it may effectively function as a binder to carry various components. The effective range may be properly determined by those skilled in the art without undue experimentation. Taken at least as a measure for carrying the organic silver salt in the film, the weight ratio of the binder to the organic silver salt is preferably in the range of from 15:1 to 1:2, more preferably from 8:1 to 1:1.

At least one layer of the image-forming layers (or emulsion layers) used herein may be an image forming layer wherein a polymer latex constitutes more than 50% by weight of the entire binder. This image forming layer is sometimes referred to as "inventive image-forming layer" and the polymer latex used as the binder therefor is referred to as "inventive polymer latex," hereinafter. The term "polymer latex" used herein is a dispersion of a microparticulate water-insoluble hydrophobic polymer in a water-soluble dispersing medium. With respect to the dispersed state, a polymer emulsified in a dispersing medium, an emulsion polymerized polymer, a micelle dispersion, and a polymer having a hydrophilic structure in a part of its molecule so that the molecular chain itself is dispersed on a molecular basis are included. With respect to the polymer latex, reference is made to Okuda and Inagaki Ed., "Synthetic Resin Emulsion," Kobunshi Kankokai, 1978; Sugimura, Kataoka, Suzuki and Kasahara Ed., "Application of Synthetic Latex," Kobunshi Kankokai, 1993; and Muroi, "Chemistry of Synthetic Latex," Kobunshi Kankokai, 1970. Dispersed particles should preferably have a mean particle size of about 1 to 50,000 nm, more preferably about 5 to 1,000 nm. No particular limit is imposed on the particle size distribution of dispersed particles, and the dispersion may have either a wide particle size distribution or a monodisperse particle size distribution.

The inventive polymer latex used herein may be either a latex of the conventional uniform structure or a latex of the so-called core/shell type. In the latter case, better results are sometimes obtained when the core and the shell have different glass transition temperatures.

The inventive polymer latex should preferably have a minimum film-forming temperature (MFT) of about −30° C. to 90° C., more preferably about 0° C. to 70° C. A film-forming aid may be added in order to control the minimum film-forming temperature. The film-forming aid is also referred to as a plasticizer and includes organic compounds (typically organic solvents) for lowering the minimum film-forming temperature of a polymer latex. It is described in Muroi, "Chemistry of Synthetic Latex," Kobunshi Kankokai, 1970.

Polymers used in the inventive polymer latex according to the invention include acrylic resins, vinyl acetate resins, polyester resins, polyurethane resins, rubbery resins, vinyl chloride resins, vinylidene chloride resins, polyolefin resins, and copolymers thereof. The polymer may be linear or branched or crosslinked. The polymer may be either a homopolymer or a copolymer having two or more monomers polymerized together. The copolymer may be either a random copolymer or a block copolymer. The polymer preferably has a number average molecule weight Mn of about 5,000 to about 1,000,000, more preferably about 10,000 to about 100,000. Polymers with a too lower molecular weight would generally provide a low film strength after coating whereas polymers with a too higher molecular weight are difficult to form films.

The polymer of the inventive polymer latex should preferably have an equilibrium moisture content at 25° C. and RH 60% of up to 2% by weight, more preferably up to 1% by weight. The lower limit of equilibrium moisture content is not critical although it is preferably 0.01% by weight, more preferably 0.03% by weight. With respect to the definition and measurement of equilibrium moisture content, reference should be made to "Polymer Engineering Series No. 14, Polymer Material Test Methods," Edited by Japanese Polymer Society, Chijin Shokan Publishing K.K., for example.

Illustrative examples of the polymer latex which can be used as the binder in the image-forming layer of the thermographic image recording element of the invention include latexes of methyl methacrylate/ethyl acrylate/methacrylic acid copolymers, latexes of methyl methacrylate/2-ethylhexyl acrylate/styrene/acrylic acid copolymers, latexes of styrene/butadiene/acrylic acid copolymers, latexes of styrene/butadiene/divinyl benzene/methacrylic acid copolymers, latexes of methyl methacrylate/vinyl chloride/acrylic acid copolymers, and latexes of vinylidene chloride/ethyl acrylate/acrylonitrile/methacrylic acid copolymers. These polymers or polymer latexes are commercially available. Exemplary acrylic resins are Sebian A-4635, 46583 and 4601 (Daicell Chemical Industry K.K.) and Nipol LX811, 814, 820, 821 and 857 (Nippon Zeon K.K.). Exemplary polyester resins are FINETEX ES650, 611, 675, and 850 (Dai-Nippon Ink Chemical K.K.) and WD-size and WMS (Eastman Chemical Products, Inc.). Exemplary polyurethane resins are HYDRAN AP10, 20, 30 and 40 (Dai-Nippon Ink Chemical K.K.). Exemplary rubbery resins are LACSTAR 7310K, 3307B, 4700H and 7132C (Dai-Nippon Ink Chemical K.K.) and Nipol LX416, 410, 438C and 2507 (Nippon Zeon K.K.). Exemplary vinyl chloride resins are G351 and G576 (Nippon Zeon K.K.). Exemplary vinylidene chloride resins are L502 and L513 (Asahi Chemicals K.K.). Exemplary olefin resins are Chemipearl S120 and SA100 (Mitsui Petro-Chemical K.K.). These polymers may be used alone or in admixture of two or more.

In the inventive image-forming layer, the polymer latex described above is preferably used in an amount of at least 50% by weight, especially at least 70% by weight, of the entire binder. In the inventive image-forming layer, a hydrophilic polymer may be added in an amount of less than 50% by weight of the entire binder. Such hydrophilic polymers are gelatin, polyvinyl alcohol, methyl cellulose, hydroxypropyl cellulose, carboxymethyl cellulose, and hydroxypropyl methyl cellulose. The amount of the hydrophilic polymer added is preferably less than 30% by weight of the entire binder in the image-forming layer.

The inventive image-forming layer is preferably formed by applying an aqueous coating solution followed by drying. By the term "aqueous", it is meant that water accounts for at least 30% by weight of the solvent or dispersing medium of the coating solution. The component other than water of the coating solution may be a water-miscible organic solvent such as methyl alcohol, ethyl alcohol, isopropyl alcohol, methyl cellosolve, ethyl cellosolve, dimethylformamide or ethyl acetate. Exemplary solvent compositions include a 90/10 or 70/30 mixture of water/methanol, a 90/10 mixture of water/ethanol, a 90/10 mixture of water/isopropanol, a 95/5 mixture of water/dimethylformamide, a 80/15/5 or 90/5/5 mixture of water/methanol/dimethylformamide, all expressed in a weight ratio.

The method described in U.S. Pat. No. 5,496,695 is also useful.

In the inventive image-forming layer, the total amount of binder is preferably 0.2 to 30 g/m$^2$, more preferably 1 to 15 g/m$^2$ per layer. To the image forming layer, crosslinking agents for crosslinking, surfactants for ease of application, and other addenda may be added.

Protective Layer

A surface protective layer may be provided in the photosensitive element according to the present invention for the purpose of preventing sticking of the image forming layer.

In the surface protective layer, any desired anti-sticking material may be used. Examples of the anti-sticking material include wax, silica particles, styrene-containing elastomeric block copolymers (e.g., styrene-butadiene-styrene and styrene-isoprene-styrene), cellulose acetate, cellulose acetate butyrate, cellulose propionate and mixtures thereof.

In the emulsion layer or a protective layer therefor according to the invention, there may be used light absorbing substances and filter dyes as described in U.S. Pat. Nos. 3,253,921, 2,274,782, 2,527,583, and 2,956,879. The dyes may be mordanted as described in U.S. Pat. No. 3,282,699.

In the emulsion layer or a protective layer therefor according to the invention, there may be used matte agents, for example, starch, titanium dioxide, zinc oxide, and silica as well as polymer beads including beads of the type described in U.S. Pat. Nos. 2,992,101 and 2,701,245. The emulsion layer or protective layer surface may have any degree of matte insofar as no star dust failures occur although a Bekk smoothness of 1,000 to 10,000 seconds, especially 2,000 to 10,000 seconds is preferred.

Antifoggant

With antifoggants, stabilizers and stabilizer precursors, the silver halide emulsion and/or organic silver salt according to the invention can be further protected against formation of additional fog and stabilized against lowering of sensitivity during shelf storage. Suitable antifoggants, stabilizers and stabilizer precursors which can be used alone or in combination include thiazonium salts as described in U.S. Pat. Nos. 2,131,038 and 2,694,716, azaindenes as described in U.S. Pat. Nos. 2,886,437 and 2,444,605, mercury salts as described in U.S. Pat. No. 2,728,663, urazoles as described in U.S. Pat. No. 3,287,135, sulfocatechols as described in U.S. Pat. No. 3,235,652, oximes, nitrons and nitroindazoles as described in BP 623,448, polyvalent metal salts as described in U.S. Pat. No. 2,839,405, thiuronium salts as described in U.S. Pat. No. 3,220,839, palladium, platinum and gold salts as described in U.S. Pat. Nos. 2,566,263 and 2,597,915, halogen-substituted organic compounds as described in U.S. Pat. Nos. 4,108,665 and 4,442,202, triazines as described in U.S. Pat. Nos. 4,128,557, 4,137,079, 4,138,365 and 4,459,350, and phosphorus compounds as described in U.S. Pat. No. 4,411,985.

In the photosensitive layer or emulsion layer, polyhydric alcohols (e.g., glycerin and diols as described in U.S. Pat. No. 2,960,404), fatty acids and esters thereof as described in U.S. Pat. Nos. 2,588,765 and 3,121,060, and silicone resins as described in BP 955,061 may be added as a plasticizer and lubricant.

According to the invention, a hardener may be used in various layers including a photosensitive layer, protective layer, and back layer. Examples of the hardener include polyisocyanates as described in U.S. Pat. No. 4,281,060 and JP-A 208193/1994, epoxy compounds as described in U.S. Pat. No. 4,791,042, and vinyl sulfones as described in JP-A 89048/1987.

A surfactant may be used for the purposes of improving coating and electric charging properties. The surfactants used herein may be nonionic, anionic, cationic and fluorinated ones. Examples include fluorinated polymer surfactants as described in JP-A 170950/1987 and U.S. Pat. No. 5,382,504, fluorinated surfactants as described in JP-A 244945/1985 and 188135/1988, polysiloxane surfactants as described in U.S. Pat. No. 3,885,965, and polyalkylene oxide and anionic surfactants as described in JP-A 301140/1994.

Support

According to the invention, the thermographic photographic emulsion may be coated on a variety of supports. Typical supports include polyester film, subbed polyester film, poly(ethylene terephthalate) film, polyethylene naphthalate film, cellulose nitrate film, cellulose ester film, poly (vinyl acetal) film, polycarbonate film and related or resinous materials, as well as glass, paper, metals, etc. Often used are flexible substrates, typically paper supports, specifically baryta paper and paper supports coated with partially acetylated $\alpha$-olefin polymers, especially polymers of $\alpha$-olefins having 2 to 10 carbon atoms such as polyethylene, polypropylene, and ethylene-butene copolymers. The supports are either transparent or opaque, preferably transparent.

The photosensitive element of the invention may have an antistatic or electroconductive layer, for example, a layer containing soluble salts (e.g., chlorides and nitrates), an evaporated metal layer, or a layer containing ionic polymers as described in U.S. Pat. Nos. 2,861,056 and 3,206,312 or insoluble inorganic salts as described in U.S. Pat. No. 3,428,451.

A method for producing color images using the photothermographic material of the invention is as described in JP-A 13295/1995, page 10, left column, line 43 to page 11, left column, line 40. Stabilizers for color dye images are exemplified in BP 1,326,889, U.S. Pat. Nos. 3,432,300, 3,698,909, 3,574,627, 3,573,050, 3,764,337, and 4,042,394.

In the practice of the invention, the thermographic photographic emulsion can be applied by various coating procedures including dip coating, air knife coating, flow coating, and extrusion coating using a hopper of the type described in U.S. Pat. No. 2,681,294. If desired, two or more layers may be concurrently coated by the methods described in U.S. Pat. No. 2,761,791 and BP 837,095.

In the photothermographic element of the invention, there may be contained additional layers, for example, a dye accepting layer for accepting a mobile dye image, an pacifying layer when reflection printing is desired, a protective topcoat layer, and a primer layer well known in the photothermographic art. The photosensitive material of the invention is preferably such that only a single sheet of the photosensitive material can form an image. That is, it is preferred that a functional layer necessary to form an image such as an image receiving layer does not constitute a separate member.

Vinylidene chloride polymers are often used in subbing and other layers in the thermographic element of the invention. The vinylidene chloride polymers used herein are copolymers containing 50 to 99.9% by weight, preferably 70 to 99% by weight of vinylidene chloride. Examples are the copolymers of vinylidene chloride, an acrylate, and a vinylidene monomer having an alcohol on a side chain described in JP-A 135526/1976, the vinylidene chloride/alkyl acrylate/acrylic acid copolymers described in U.S. Pat. No. 2,852,378, the vinylidene chloride/acrylonitrile/itaconic acid copolymers described in U.S. Pat. No. 2,698,235, and the vinylidene chloride/alkyl acrylate/itaconic acid copolymers described in U.S. Pat. No. 3,788,856. Illustrative, non-limiting, examples of the vinylidene chloride copolymer are given below where the ratio of components is by weight.

vinylidene chloride/methyl acrylate/hydroxyethyl acrylate (83/12/5) copolymer vinylidene chloride/hydroxyethyl methacrylate/hydroxypropyl acrylate (82/10/8) copolymer vinylidene chloride/hydroxydiethyl methacrylate (92/8) copolymer vinylidene chloride/butyl acrylate/acrylic acid (94/4/2) copolymer vinylidene chloride/butyl acrylate/itaconic acid (75/20/5) copolymer vinylidene chloride/methyl acrylate/itaconic acid (90/8/2) copolymer vinylidene chloride/itaconic acid monoethyl ester (96/4) copolymer vinylidene chloride/acrylonitrile/acrylic acid (96/3.5/1.5) copolymer vinylidene chloride/methyl acrylate/acrylic acid (92/5/3) copolymer vinylidene chloride/methyl acrylate/3-chloro-2-hydroxypropyl acrylate (84/9/7) copolymer vinylidene chloride/methyl acrylate/N-ethanol acrylamide (85/10/5) copolymer In the practice of the invention, the vinylidene chloride copolymer may be coated, for example, by dissolving the polymer in a suitable organic solvent or dispersing the polymer in water and applying the solution by well-known techniques such as dip coating, air knife coating, curtain coating, roller coating, wire bar coating, and gravure coating. An extrusion coating technique using the hopper described in U.S. Pat. No. 2,681,294 is useful. Also useful are another extrusion coating technique involving casting a molten polymer to a moving support whereby the polymer is joined to the support by cooling and concurrent pressure application, and a laminating technique involving preforming a polymer into a film and joining the film to a support with glue and heat.

In one preferred embodiment, the heat-developable photosensitive element of the invention is a one-side photosensitive material having at least one photosensitive (or emulsion) layer containing a silver halide emulsion as an image-forming layer on one side and a back (or backing) layer on the other side of the support.

In the practice of the invention, a matte agent may be added to the one-side photosensitive element for improving feed efficiency. The matte agents used herein are generally microparticulate water-insoluble organic or inorganic compounds. There may be used any desired one of matte agents, for example, well-known matte agents including organic matte agents as described in U.S. Pat. Nos. 1,939,213, 2,701,245, 2,322,037, 3,262,782, 3,539,344, and 3,767,448 and inorganic matte agents as described in U.S. Pat. Nos. 1,260,772, 2,192,241, 3,257,206, 3,370,951, 3,523,022, and 3,769,020. Illustrative examples of the organic compound which can be used as the matte agent are given below; exemplary water-dispersible vinyl polymers include polymethyl acrylate, polymethyl methacrylate, polyacrylonitrile, acrylonitrile-α-methylstyrene copolymers, polystyrene, styrene-divinylbenzene copolymers, polyvinyl acetate, polyethylene carbonate, and polytetrafluoroethylene; exemplary cellulose derivatives include methyl cellulose, cellulose acetate, and cellulose acetate propionate; exemplary starch derivatives include carboxystarch, carboxynitrophenyl starch, urea-formaldehyde-starch reaction products, gelatin hardened with well-known curing agents, and hardened gelatin which has been coaceruvation hardened into microcapsulated hollow particles. Preferred examples of the inorganic compound which can be used as the matte agent include silicon dioxide, titanium dioxide, magnesium dioxide, aluminum oxide, barium sulfate, calcium carbonate, silver chloride and silver bromide desensitized by a well-known method, glass, and diatomaceous earth. The aforementioned matte agents may be used as a mixture of substances of different types if necessary. The size and shape of the matte agent are not critical. The matte agent of any particle size may be used although matte agents having a particle size of 0.1 μm to 30 μm are preferably used in the practice of the invention. The particle size distribution of the matte agent may be either narrow or wide. Nevertheless, since the haze and surface luster of coatings are largely affected by the matte agent, it is preferred to adjust the particle size, shape and particle size distribution of a matte agent as desired during preparation of the matte agent or by mixing plural matte agents.

In the practice of the invention, the back layer should preferably have a degree of matte as expressed by a Bekk smoothness of 10 to 250 seconds, more preferably 50 to 180 seconds.

In the photosensitive element of the invention, the matte agent is preferably contained in an outermost surface layer, a layer functioning as an outermost surface layer, a layer close to the outer surface or a layer functioning as a so-called protective layer.

In the practice of the invention, the binder used in the back layer is preferably transparent or translucent and generally colorless. Exemplary binders are naturally occurring polymers, synthetic resins, polymers and copolymers, and other film-forming media, for example, gelatin, gum arabic, poly(vinyl alcohol), hydroxyethyl cellulose, cellulose acetate, cellulose acetate butyrate, poly(vinyl pyrrolidone), casein, starch, poly(acrylic acid), poly(methyl methacrylate), polyvinyl chloride, poly(methacrylic acid), copoly(styrene-maleic anhydride), copoly(styrene-acrylonitrile), copoly(styrene-butadiene), polyvinyl acetals (e.g., polyvinyl formal and polyvinyl butyral), polyesters, polyurethanes, phenoxy resins, poly(vinylidene chloride), polyepoxides, polycarbonates, poly(vinyl acetate), cellulose esters, and polyamides. The binder may be dispersed in water, organic solvent or emulsion to form a dispersion which is coated to form a layer.

The back layer preferably serves as an antihalation layer which exhibits a maximum absorbance of 0.3 to 2 in the predetermined wavelength range, and more preferably an optical density of 0.5 to 2.

Where anti-halation dyes are used in the practice of the invention, such a dye may be any compound which has desired absorption in the predetermined wavelength range, has sufficiently low absorption outside that range and provides the backing layer with a preferred absorbance spectrum profile. Exemplary anti-halation dyes are the compounds described in JP-A 13295/1995, U.S. Pat. No. 5,380,635, JP-A 68539/1990, page 13, lower-left column to page 14, lower-left column, and JP-A 24539/1991, page 14, lower-left column to page 16, lower-right column though not limited thereto.

A backside resistive heating layer as described in U.S. Pat. Nos. 4,460,681 and 4,374,921 may be used in a photothermographic imaging system according to the present invention.

The photothermographic material according to the preferred embodiment of the invention may be developed by any desired method although it is generally developed by heating after imagewise exposure. The preferred developing temperature is about 80 to 250° C., more preferably 100 to 140° C. and the preferred developing time is about 1 to 180 seconds, more preferably about 10 to 90 seconds.

Any desired technique may be used for forming latent images in the thermographic photosensitive material. The preferred light source for exposure is a laser, for example, a gas laser, YAG laser, dye laser, and semiconductor laser. A semiconductor laser combined with a second harmonic generating device is also useful.

EXAMPLE

Examples of the invention are given below by way of illustration and not by way of limitation.

The trade names used in Examples have the following meaning.

Denka Butyral: polyvinyl butyral by Denki Kagaku Kogyo K. K. CAB 171-15S: cellulose acetate butyrate by Eastman Chemical Products, Inc.

Sildex: spherical silica by Dokai Chemical K.K. Sumidur N3500: polyisocyanate by Sumitomo-Bayern Urethane K.K.

Megafax F-176P: fluorinated surfactant by Dai-Nippon Ink Chemicals K.K.

LACSTAR 3307B: styrene-butadiene rubber (SBR) latex by Dai-Nippon Ink Chemicals K.K. The polymer has an equilibrium moisture content of 0.6 wt % at 25° C. and RH 60% and the dispersed particles have a mean particle diameter of about 0.1 to 0.15 μm.

Example 1

Organic Acid Silver Emulsion A

To 12 liters of water were added 840 grams of behenic acid and 95 grams of stearic acid. To the solution kept at 90° C., a solution of 48 grams of sodium hydroxide and 63 grams of sodium carbonate in 1.5 liters of water was added. The solution was stirred for 30 minutes and then cooled to 50° C. whereupon 1.1 liters of a 1% aqueous solution of N-bromosuccinimide was added. With stirring, 2.3 liters of a 17% aqueous solution of silver nitrate was slowly added. While the solution was kept at 35° C., with stirring, 1.5 liters of a 2% aqueous solution of potassium bromide was added over 2 minutes. The solution was stirred for 30 minutes whereupon 2.4 liters of a 1% aqueous solution of N-bromosuccinimide was added. With stirring, 3,300 grams of a solution containing 1.2% by weight of polyvinyl acetate in butyl acetate was added to the aqueous mixture. The mixture was allowed to stand for 10 minutes, separating into two layers. After the aqueous layer was removed, the remaining gel was washed twice with water. There was obtained a gel-like mixture of silver behenate/stearate and silver bromide, which was dispersed in 1,800 grams of a 2.6% 2-butanone solution of polyvinyl butyral (Denka Butyral #3000-K). The dispersion was further dispersed in 600 grams of polyvinyl butyral (Denka Butyral #4000-2) and 300 grams of isopropyl alcohol, obtaining an organic acid silver salt emulsion of needle grains having a mean minor diameter of 0.05 μm, a mean major diameter of 1.2 μm, and a coefficient of variation of 25%.

Emulsion Layer Coating Solution A

The following chemicals were added to the above-prepared organic acid silver salt emulsion A in amounts per mol of silver. With stirring at 25° C., 10 mg of sodium phenylthiosulfonate, 40 mg of Sensitizing Dye A, 8 mg of Sensitizing Dye B, an amount of a disulfide compound within or outside the scope of the invention as shown in Tables 1 and 2, 21.5 grams of 4-chlorobenzophenone-2-carboxylic acid (C-1), 580 grams of 2-butanone and 220 grams of dimethylformamide were added to the emulsion, which was allowed to stand for 3 hours. With stirring, 4.5 grams of 4,6-ditrichloromethyl-2-phenyltriazine (C-2), 160 grams of 1,1-bis(2-hydroxy-3,5-dimethylphenyl)-3,5,5-trimethylhexane (C-3), 15 grams of phthalazine (C-4), 5 grams of tetrachlorophthalic acid (C-5), an amount of a hydrazine derivative as shown in Tables 1 and 2, 1.1 grams of fluorinated surfactant Megafax F-176P, 590 grams of 2-butanone, and 10 grams of methyl isobutyl ketone were added to the emulsion.

Emulsion Surface Protective Layer Coating Solution A

A coating solution A for an emulsion layer surface protective layer was prepared by dissolving 75 grams of cellulose acetate butyrate CAB 171-15S, 5.7 grams of 4-methylphthalic acid (C-6), 1.5 grams of tetrachlorophthalic anhydride (C-7), 10 grams of 2-tribromomethylsulfonylbenzothiazole (C-8), 2 grams of phthalazone (C-9), 0.3 gram of Megafax F-176P, 2 grams of spherical silica Sildex H31 (mean size 3 μm), and 5 grams of polyisocyanate Sumidur N3500 in 3,070 grams of 2-butanone and 30 grams of ethyl acetate.

Preparation of Coated Sample

A back layer coating solution was prepared by adding 6 grams of polyvinyl butyral Denka Butyral #4000-2, 0.2 gram of spherical silica Sildex H121 (mean size 12 μm), 0.2 gram of spherical silica Sildex H51 (mean size 5 μm), and 0.1 gram of Megafax F-176P to 64 grams of 2-propanol and mixing them into a solution. Further, a mixed solution of 420 mg of Dyestuff A in 10 grams of methanol and 20 grams of acetone and a solution of 0.8 gram of 3-isocyanatomethyl-3,5,5-trimethylhexyl isocyanate in 6 grams of ethyl acetate were added to the solution.

A polyethylene terephthalate film having a moisture-proof undercoat of vinylidene chloride on either surface was coated on one surface with the back surface coating solution so as to give an optical density of 0.7 at 780 nm.

On the thus prepared support, the emulsion layer coating solution was coated so as to give a coverage of 2 g/m$^2$ of silver, and the emulsion layer protective layer coating solution was then coated on the emulsion layer so as to give a dry thickness of 5 μm.

Some of the compounds used in the preparation of the sample are shown below.
(C-1)
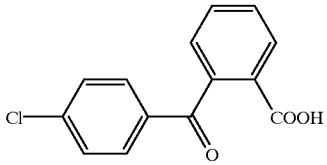
(C-2)
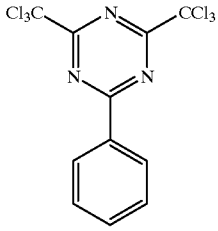
(C-3)
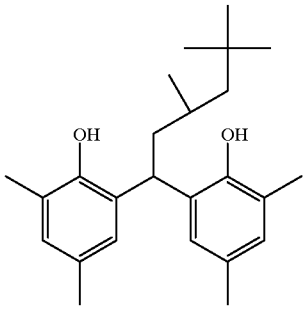
(C-4)
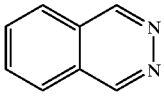
-continued
(C-5)
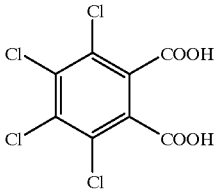
(C-6)
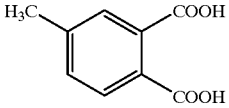
(C-7)
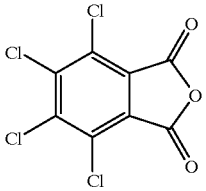
(C-8)
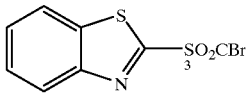
(C-9)
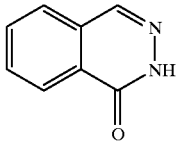
Sensitizing dye A
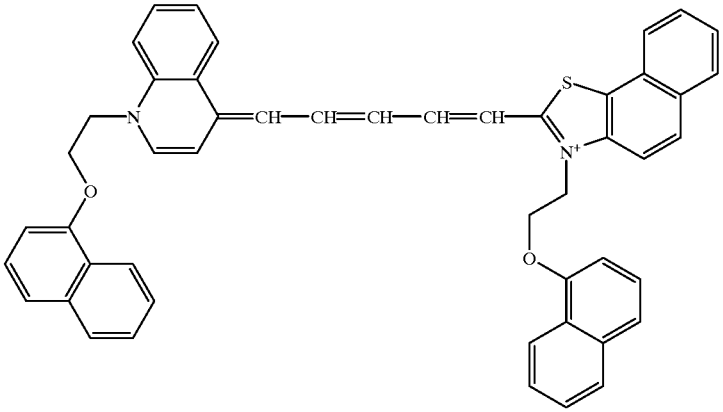
Sensitizing dye B
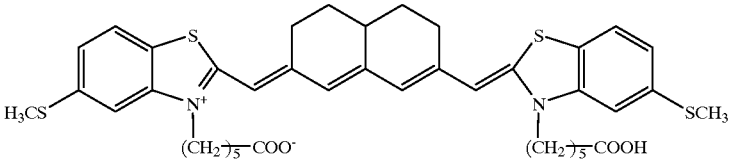

-continued

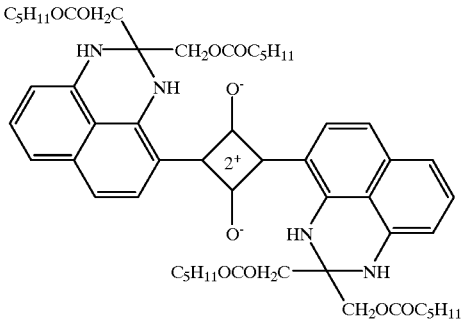

Dyestuff A

Comparative Compound (a)
(described in JP-A 78319/1976)

$HO_2CCH_2CH_2S—SCH_2CH_2CO_2H$

Comparative Compound (b)
(described in JP-A 182639/1992 and 341432/1993)

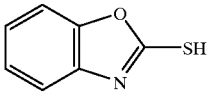

Comparative Compound (c)
(described in JP-A 341432/1993)

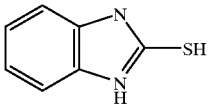

Comparative Compound (d)
(described in JP-A 341432/1993)

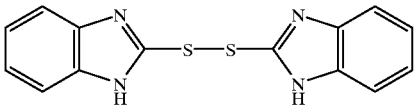

Photographic Property Test

The samples prepared above were exposed to xenon flash light for an emission time of $10^{-4}$ sec through an interference filter having a peak at 780 nm and a step wedge and heated for development at 115° C. for 25 seconds. The resulting images were determined for Dmax and sensitivity by a densitometer. The sensitivity ($S_{1.5}$) is the reciprocal of a ratio of the exposure providing a density of Dmin +1.5. The gradient of a straight line connecting points of density 0.3 and 3.0 on a characteristic curve is also reported as gradation (γ). The results are shown in Tables 1 and 2.

Storage Test

To estimate how photographic properties change during long-term storage, the samples were aged for 3 days under conditions of 50° C. and RH 75%. A sensitivity change (ΔS) is equal to the sensitivity of aged sample minus the sensitivity of fresh sample. ΔS values approximate to 0 indicate better storage stability.

The results are shown in Tables 1 and 2.

TABLE 1

| | Hydrazine derivative | | Inventive compound | | | | | |
|---|---|---|---|---|---|---|---|---|
| Sample No. | Type | Addition amount (mol/mol Ag) | Type | Addition amount (mol/mol Ag) | Sensitivity $S_{1.5}$ | Gradation G0300 | Storage stability $\Delta S_{1.5}$ | Remarks |
| 101 | None | None | None | None | 10 | 3 | ≧0.5 | Comparison |
| 102 | None | None | Comparison a | 7 | 15 | 3 | ≧0.5 | Comparison |
| 103 | None | None | Comparison b | 7 | 20 | 3 | 0.5 | Comparison |
| 104 | None | None | Comparison c | 7 | 25 | 3 | 0.2 | Comparison |
| 105 | None | None | Comparison c | 25 | 60 | 2.5 | 0.1 | Comparison |
| 106 | None | None | Comparison d | 3.5 | 15 | 3 | ≧0.5 | Comparison |
| 107 | None | None | D-32 | 3.5 | 92 | 4.5 | 0 | Invention |
| 108 | None | None | D-33 | 3.5 | 100 | 4.5 | 0 | Invention |
| 109 | None | None | D-57 | 3.5 | 80 | 4.5 | 0 | Invention |
| 110 | None | None | D-59 | 3.5 | 92 | 4.5 | 0 | Invention |
| 111 | None | None | D-61 | 3.5 | 92 | 4.5 | 0 | Invention |
| 112 | 54a | $4.2 \times 10^{-3}$ | None | None | 22 | 8.5 | ≧0.5 | Comparison |
| 113 | 54a | $4.2 \times 10^{-3}$ | Comparison a | 25 | 30 | 8.5 | ≧0.5 | Comparison |
| 114 | 54a | $4.2 \times 10^{-3}$ | Comparison b | 25 | 43 | 8.5 | 0.5 | Comparison |
| 115 | 54a | $4.2 \times 10^{-3}$ | Comparison c | 25 | 118 | 6 | 0.1 | Comparison |
| 116 | 54a | $4.2 \times 10^{-3}$ | Comparison c | 7 | 50 | 7 | 0.2 | Comparison |
| 117 | 54a | $4.2 \times 10^{-3}$ | Comparison c | 3.5 | 38 | 8 | 0.3 | Comparison |
| 118 | 54a | $4.2 \times 10^{-3}$ | Comparison d | 3.5 | 30 | 7 | ≧0.5 | Comparison |
| 119 | 54a | $4.2 \times 10^{-3}$ | D-32 | 3.5 | 290 | 20 | 0 | Invention |
| 120 | 54a | $4.2 \times 10^{-3}$ | D-33 | 3.5 | 315 | 20 | 0 | Invention |
| 121 | 54a | $4.2 \times 10^{-3}$ | D-57 | 3.5 | 253 | 20 | 0 | Invention |
| 122 | 54a | $4.2 \times 10^{-3}$ | D-59 | 3.5 | 290 | 20 | 0 | Invention |

TABLE 1-continued

| Sample No. | Hydrazine derivative Type | Hydrazine derivative Addition amount (mol/mol Ag) | Inventive compound Type | Inventive compound Addition amount (mol/mol Ag) | Sensitivity $S_{1.5}$ | Gradation G0300 | Storage stability $\Delta S_{1.5}$ | Remarks |
|---|---|---|---|---|---|---|---|---|
| 123 | 54a | $4.2 \times 10^{-3}$ | D-61 | 3.5 | 290 | 20 | 0 | Invention |
| 124 | 54m | $3.5 \times 10^{-3}$ | D-32 | 3.5 | 298 | 20 | 0 | Invention |
| 125 | 54m | $3.5 \times 10^{-3}$ | D-33 | 3.5 | 320 | 20 | 0 | Invention |
| 126 | 54m | $3.5 \times 10^{-3}$ | D-57 | 3.5 | 258 | 20 | 0 | Invention |
| 127 | 54m | $3.5 \times 10^{-3}$ | D-59 | 3.5 | 300 | 20 | 0 | Invention |
| 128 | 54m | $3.5 \times 10^{-3}$ | D-61 | 3.5 | 300 | 20 | 0 | Invention |
| 129 | 96-1 | $1.6 \times 10^{-3}$ | D-32 | 3.5 | 288 | 20 | 0 | Invention |
| 130 | 96-1 | $1.6 \times 10^{-3}$ | D-33 | 3.5 | 315 | 20 | 0 | Invention |
| 131 | 96-1 | $1.6 \times 10^{-3}$ | D-57 | 3.5 | 250 | 20 | 0 | Invention |
| 132 | 96-1 | $1.6 \times 10^{-3}$ | D-59 | 3.5 | 285 | 20 | 0 | Invention |
| 133 | 96-1 | $1.6 \times 10^{-3}$ | D-61 | 3.5 | 285 | 20 | 0 | Invention |

TABLE 2

| Sample No. | Hydrazine derivative Type | Hydrazine derivative Addition amount (mol/mol Ag) | Inventive compound Type | Inventive compound Addition amount (mol/mol Ag) | Sensitivity $S_{1.5}$ | Gradation G0300 | Storage stability $\Delta S_{1.5}$ | Remarks |
|---|---|---|---|---|---|---|---|---|
| 134 | None | None | D-34 | 3.5 | 95 | 4.5 | 0 | Invention |
| 135 | None | None | D-43 | 3.5 | 100 | 4.5 | 0 | Invention |
| 136 | None | None | D-45 | 3.5 | 95 | 4.5 | 0 | Invention |
| 137 | None | None | D-49 | 3.5 | 85 | 4.5 | 0 | Invention |
| 138 | None | None | D-55 | 3.5 | 90 | 4.5 | 0 | Invention |
| 139 | None | None | D-58 | 3.5 | 105 | 4.5 | 0 | Invention |
| 140 | None | None | D-60 | 3.5 | 105 | 4.5 | 0 | Invention |
| 141 | 54a | $4.2 \times 10^{-3}$ | D-34 | 3.5 | 299 | 20 | 0 | Invention |
| 142 | 54a | $4.2 \times 10^{-3}$ | D-43 | 3.5 | 315 | 20 | 0 | Invention |
| 143 | 54a | $4.2 \times 10^{-3}$ | D-45 | 3.5 | 295 | 20 | 0 | Invention |
| 144 | 54a | $4.2 \times 10^{-3}$ | D-49 | 3.5 | 265 | 20 | 0 | Invention |
| 145 | 54a | $4.2 \times 10^{-3}$ | D-55 | 3.5 | 285 | 20 | 0 | Invention |
| 146 | 54a | $4.2 \times 10^{-3}$ | D-58 | 3.5 | 330 | 20 | 0 | Invention |
| 147 | 54a | $4.2 \times 10^{-3}$ | D-60 | 3.5 | 330 | 20 | 0 | Invention |

It is evident that using the inventive compounds, photothermographic elements having a high sensitivity, high contrast and storage stability are obtained. Particularly when the inventive compounds are used in combination with hydrazine derivatives, the contrast of toe gradation is significantly improved (greater γ). For the comparative compounds, no compromise was found between sensitivity and gradation even when the addition amount was changed.

Example 2

Silver Halide Grains C

In 700 ml of water were dissolved 22 grams of phthalated gelatin and 30 mg of potassium bromide. The solution was adjusted to pH 5.0 at a temperature of 40° C. To the solution, 159 ml of an aqueous solution containing 18.6 grams of silver nitrate and an aqueous solution containing potassium bromide were added over 10 minutes by the controlled double jet method while maintaining the solution at pAg 7.7. Then, an aqueous solution containing $8\times10^{-6}$ mol/liter of $K_3[IrCl_6]$ and 1 mol/liter of potassium bromide was added over 30 minutes by the controlled double jet method while maintaining the solution at pAg 7.7. The emulsion was then adjusted to pH 5.9 and pAg 8.0. There were obtained cubic grains having a mean grain size of 0.07 μm, a coefficient of variation of the projected area diameter of 8%, and a (100) face proportion of 86%.

The thus obtained silver halide grains C were heated at 60° C., to which $8.5\times10^{-5}$ mol of sodium thiosulfate, $1.1\times10^{-5}$ mol of 2,3,4,5,6-pentafluorophenyldiphenylsulfin selenide, $2\times10^{-6}$ mol of Tellurium Compound 1, $3.3\times10^{-6}$ mol of chloroauric acid, and $2.3\times10^{-4}$ mol of thiocyanic acid were added per mol of silver. The emulsion was ripened for 120 minutes and then quenched to 50° C. With stirring, $8\times10^{-4}$ mol of Sensitizing Dye A was added, and $3.5\times10^{-2}$ mol of potassium iodide was added to the emulsion, which was stirred for 30 minutes and then quenched to 30° C., completing the preparation of silver halide grains C.

Some of the compounds used in the preparation of the sample are shown below.

Sensitizing dye A

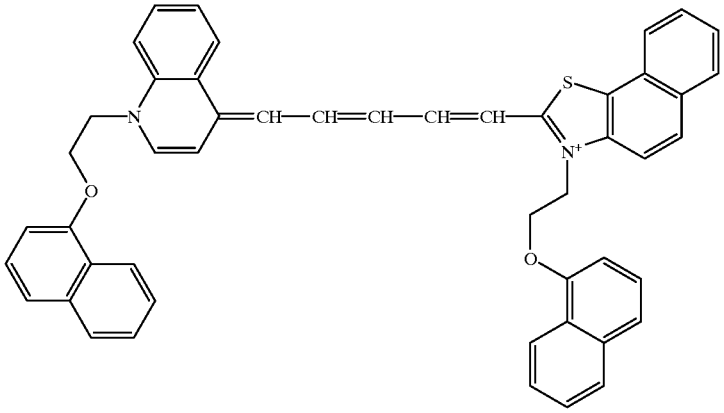

Tellurium Compound 1

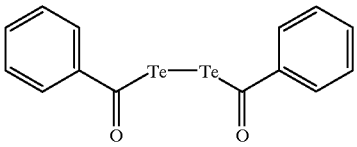

Organic Acid Silver Microcrystalline Dispersion

A mixture of 40 grams of behenic acid, 7.3 grams of stearic acid, and 500 ml of distilled water was stirred at 90° C. for 15 minutes. With vigorous stirring, 187 ml of 1N NaOH aqueous solution was added over 15 minutes, 61 ml of 1N nitric acid was added, and the solution was cooled to 50° C. Then, 124 ml of an aqueous solution of 1N silver nitrate was added and stirring was continued for 30 minutes. Thereafter, the solids were separated by suction filtration and washed with water until the water filtrate reached a conductivity of 30 $\mu$S/cm. The thus obtained solids were handled as a wet cake without drying. To 34.8 grams as dry solids of the wet cake were added 12 grams of polyvinyl alcohol and 150 ml of water. They were thoroughly mixed to form a slurry. A vessel was charged with the slurry together with 840 grams of zirconia beads having a mean diameter of 0.5 mm. A dispersing machine (1/4 G Sand Grinder Mill by Imex K.K.) was operated for 5 hours for dispersion, completing the preparation of a microcrystalline dispersion of organic acid silver grains having a volume weighed mean grain diameter of 1.5 $\mu$m as measured by Master Sizer X (Malvern Instruments Ltd.).

Solid Particle Dispersions of Chemical Addenda

Solid particle dispersions of tetrachlorophthalic acid (C-5), 4-methylphthalic acid (C-6), 1,1-bis(2-hydroxy-3,5-dimethylphenyl)-3,5,5-trimethylhexane (C-3), phthalazine (C-4), and tribromomethylphenylsulfonebenzene (C-10) were prepared.

To tetrachlorophthalic acid were added 0.81 gram of hydroxypropyl cellulose and 94.2 ml of water. They were thoroughly agitated to form a slurry, which was allowed to stand for 10 hours. A vessel was charged with the slurry together with 100 ml of zirconia beads having a mean diameter of 0.5 mm. A dispersing machine as above was operated for 5 hours for dispersion, obtaining a solid particle dispersion of tetrachlorophthalic acid in which particles with a diameter of up to 1.0 $\mu$m accounted for 70% by weight. Solid particle dispersions of the remaining chemical addenda were similarly prepared by properly changing the amount of dispersant and the dispersion time to achieve a desired mean particle size.

Some of the compounds used herein are shown below.

(C-5)

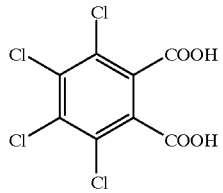

(C-6)

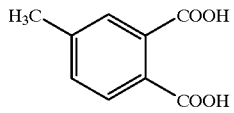

(C-3)

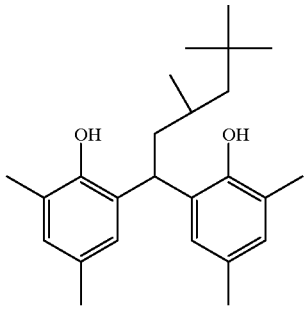

(C-4)

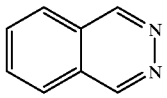

(C-10)

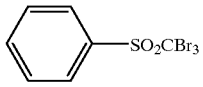

-continued

Surfactant A

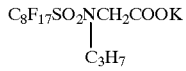

Surfactant B

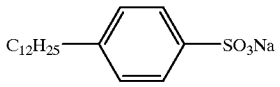

Emulsion Layer Coating Solution

An emulsion layer coating solution was prepared by adding the following components to the organic acid silver microcrystalline dispersion prepared above.

Organic acid silver particle dispersion 1 mol

Silver halide emulsion C 0.05 mol

Binder: LACSTAR 3307B SBR latex 430 g

Addenda for development:

Tetrachlorophthalic acid 5 g 1,1-bis(2-hydroxy-3,5-dimethylphenyl)-3,5,5-trimethylhexane 98 g Phthalazine 9.2 g Tribromomethylphenylsulfone 12 g 4-methylphthalic acid 7 g Hydrazine derivative (see Table 3)

Note that the type and amount of hydrazine derivative added are shown in Table 3, the amount being expressed by mol per mol of silver.

Emulsion Surface Protective Layer Coating Solution

An emulsion surface protective layer coating solution was prepared by adding 0.26 gram of Surfactant A, 0.09 gram of Surfactant B, 0.9 gram of silica microparticulates having a mean particle size of 2.5 μm, 0.3 gram of 1,2-bis(vinylsulfoneacetamide)ethane and 64 grams of water to 10 grams of inert gelatin.

Back Surface Coating Solution

It is the same as in Example 1.

Coated Sample

The emulsion layer coating solution was applied to a polyethylene terephthalate support so as to give a silver coverage of 1.6 g/m$^2$. The emulsion surface protective layer coating solution was coated thereto so as to give a gelatin coverage of 1.8 g/m$^2$. After drying, the back surface coating solution was applied to the back surface of the support opposite to the emulsion layer so as to give an optical density of 0.7 at 780 nm. A coated sample was prepared in this way.

Photoaraphic Property/Storage Tests

The samples were tested as in Example 1.

The results are shown in Table 3.

TABLE 3

| | Hydrazine derivative | | Inventive compound | | | | | |
|---|---|---|---|---|---|---|---|---|
| Sample No. | Type | Addition amount (mol/mol Ag) | Type | Addition amount (mol/mol Ag) | Sensitivity $S_{1.5}$ | Gradation G0300 | Storage stability $\Delta S_{1.5}$ | Remarks |
| 201 | None | None | None | None | 10 | 4 | ≧0.5 | Comparison |
| 202 | None | None | Comparison a | 7 | 15 | 4 | ≧0.5 | Comparison |
| 203 | None | None | Comparison b | 7 | 15 | 4 | 0.5 | Comparison |
| 204 | None | None | Comparison c | 7 | 20 | 4 | 0.2 | Comparison |
| 205 | None | None | Comparison c | 25 | 50 | 2.5 | 0.1 | Comparison |
| 206 | None | None | Comparison d | 3.5 | 11 | 4 | ≧0.5 | Comparison |
| 207 | None | None | D-38 | 3.5 | 62 | 5 | 0 | Invention |
| 208 | None | None | D-40 | 3.5 | 80 | 5 | 0 | Invention |
| 209 | None | None | D-41 | 3.5 | 100 | 5 | 0 | Invention |
| 210 | 54a | $1.6 \times 10^{-2}$ | None | None | 22 | 8 | ≧0.5 | Comparison |
| 211 | 54a | $1.6 \times 10^{-2}$ | Comparison a | 25 | 32 | 8 | ≧0.5 | Comparison |
| 212 | 54a | $1.6 \times 10^{-2}$ | Comparison b | 25 | 32 | 8 | 0.5 | Comparison |
| 213 | 54a | $1.6 \times 10^{-2}$ | Comparison c | 25 | 100 | 4 | 0.1 | Comparison |
| 214 | 54a | $1.6 \times 10^{-2}$ | Comparison c | 7 | 41 | 6 | 0.2 | Comparison |
| 215 | 54a | $1.6 \times 10^{-2}$ | Comparison c | 3.5 | 20 | 8 | 0.3 | Comparison |
| 216 | 54a | $1.6 \times 10^{-2}$ | Comparison d | 3.5 | 20 | 8 | ≧0.5 | Comparison |
| 217 | 54a | $1.6 \times 10^{-2}$ | D-38 | 3.5 | 195 | 18 | 0 | Invention |
| 218 | 54a | $1.6 \times 10^{-2}$ | D-40 | 3.5 | 253 | 18 | 0 | Invention |
| 219 | 54a | $1.6 \times 10^{-2}$ | D-41 | 3.5 | 315 | 18 | 0 | Invention |
| 220 | 54a | $1.6 \times 10^{-2}$ | D-3 | 3.5 | 220 | 18 | 0 | Invention |
| 221 | 54a | $1.6 \times 10^{-2}$ | D-11 | 3.5 | 200 | 18 | 0 | Invention |
| 222 | 54a | $1.6 \times 10^{-2}$ | D-18 | 3.5 | 250 | 18 | 0 | Invention |
| 223 | 54a | $1.6 \times 10^{-2}$ | D-31 | 3.5 | 280 | 18 | 0 | Invention |
| 224 | 54m | $1.4 \times 10^{-2}$ | D-38 | 3.5 | 200 | 18 | 0 | Invention |
| 225 | 54m | $1.4 \times 10^{-2}$ | D-40 | 3.5 | 260 | 18 | 0 | Invention |
| 226 | 54m | $1.4 \times 10^{-2}$ | D-41 | 3.5 | 320 | 18 | 0 | Invention |
| 227 | 96-1 | $6.4 \times 10^{-2}$ | D-38 | 3.5 | 198 | 18 | 0 | Invention |
| 228 | 96-1 | $6.4 \times 10^{-2}$ | D-40 | 3.5 | 260 | 18 | 0 | Invention |
| 229 | 96-1 | $6.4 \times 10^{-2}$ | D-41 | 3.5 | 318 | 18 | 0 | Invention |

It is evident that using the inventive compounds, photothermographic elements having a high sensitivity, high contrast and storage stability are obtained. Particularly when the inventive compounds are used in combination with hydrazine derivatives, the contrast of toe gradation is significantly improved (greater γ). For the comparative compounds, no compromise was found between sensitivity and gradation even when the addition amount was changed.

It is demonstrated that the invention provides thermographic photosensitive elements having a high sensitivity and storage stability.

Example 3
Structures of additives used in Example 3 are shown below.
Sensitizing dye A
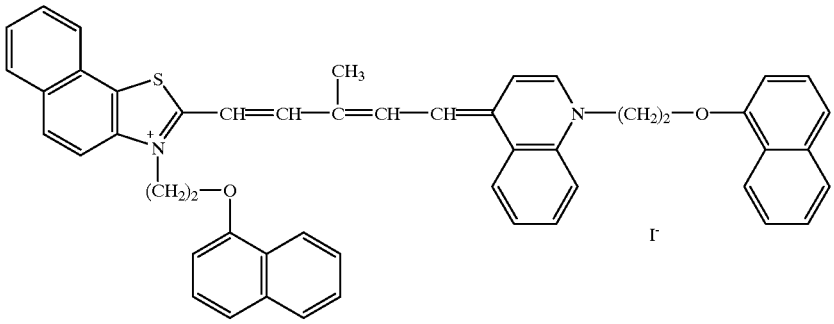
(C-1)
(C-2)
$CaBr_2 \cdot 2H_2O$
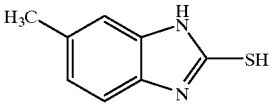
(C-3)
(C-4)
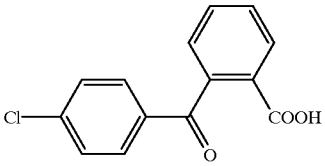
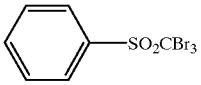
(C-5)
(C-6)
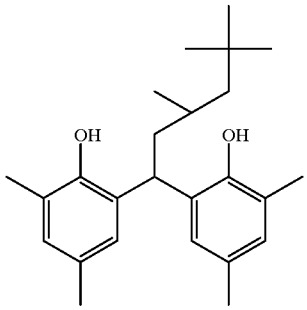
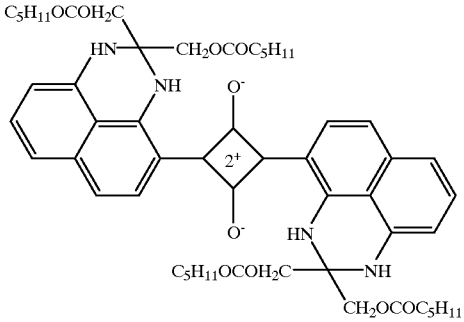
(C-7)
(C-8)
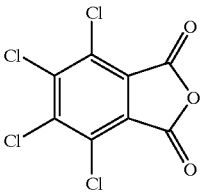
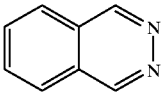
(C-9)
(C-10)
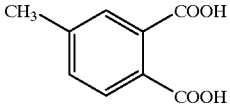
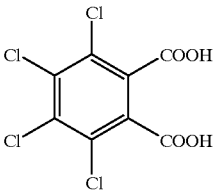
(C-11)
(C-12)
$(n\text{-}C_4H_9\text{—}S\text{—})_2$
$n\text{-}C_8H_{17}\text{—}S\text{—}S\text{—}CCl_3$ Silver Halide Grains A In 900 ml of water were dissolved 7.5 grams of inert gelatin and 10 mg of potassium bromide. The solution was adjusted to pH 3.0 at a temperature of 35° C. To the solution, 370 ml of an aqueous solution containing 74 grams of silver nitrate and an aqueous solution containing potassium bromide and potassium iodide in a molar ratio of 94:6 and $K_3[IrCl_6]$ were added over 10 minutes by the controlled double jet method while maintaining the solution at pAg 7.7. Note that $[IrCl_6]^{3-}$ was added in an amount of $3\times10^{-7}$ Mol/mol of silver. Thereafter, 0.3 gram of 4-hydroxy-6-methyl-1,3,3a,7-tetraazaindene was added to the solution, which was adjusted to pH 5 with NaOH. There were obtained cubic silver iodobromide grains A having a mean grain size of 0.06 μm, a coefficient of variation of projected area of 8%, and a {100} face ratio of 87%. The emulsion was desalted by adding a gelatin flocculant thereto to cause flocculation and sedimentation and then adjusted to pH 5.9 and pAg 7.5 by adding 0.1 gram of phenoxyethanol.

Organic Acid Silver Emulsion A

A mixture of 10.6 grams of behenic acid and 300 ml of distilled water was mixed for 15 minutes at 90° C. With vigorous stirring, 31.1 ml of 1N sodium hydroxide was added over 15 minutes to the solution, which was allowed to stand at the temperature for one hour. The solution was then cooled to 30° C., 7 ml of 1N phosphoric acid was added thereto, and with more vigorous stirring, 0.13 gram of N-bromosuccinimide was added. Thereafter, with stirring, the above-prepared silver halide grains A were added to the solution in such an amount as to give 1.25 mmol of silver halide. Further, 25 ml of 1N silver nitrate aqueous solution was continuously added over 2 minutes, with stirring continued for a further 90 minutes. With stirring, 37 grams of a 1.2 wt % butyl acetate solution of polyvinyl acetate was slowly added to the aqueous mixture to form flocs in the dispersion. Water was removed, and water washing and water removal were repeated twice. With stirring, 20 grams of a solution of 2.5% by weight polyvinyl butyral (Denka Butyral #3000-K) in a 1/2 solvent mixture of butyl acetate and isopropyl alcohol was added. To the thus obtained gel-like mixture of organic acid silver and silver halide, 7.8 grams of polyvinyl butyral (Denka Butyral #4000-2) and 57 grams of 2-butanone were added. The mixture was dispersed by a homogenizer, obtaining a silver behenate emulsion A of needle grains having a mean minor diameter of 0.06 μm, a mean major diameter of 1 μm and a coefficient of variation of 30%.

Emulsion Layer Coating Solution A

The following chemicals were added to the above-prepared organic acid silver salt emulsion A in amounts per mol of silver. With stirring at 25° C., 1.0 g of (C-1), 0.65 g of Sensitizing Dye A, 2.1 g of (C-2), 14.2 g of (C-3), 580 grams of 2-butanone, 220 grams of dimethylformamide, and 32 grams of methanol were added to the emulsion, which was allowed to stand for 3 hours. With stirring, 14.1 grams of (C-4), 125 grams of (C-5), 0.86 gram of a hydrazine derivative (Compound 54a exemplified above), 0.67 gram of (C-6), an amount (mol/mol Ag) of a compound of formula (1) or comparative compound (C-11) as shown in Table 4, 1.1 grams of fluorinated surfactant Megafax F-176P, and 3.7 grams of polyisocyanate Sumidur N3500 were added to the emulsion.

Emulsion Surface Protective Layer Coating Solution

A coating solution for an emulsion layer surface protective layer was prepared by mixing and dissolving 45 grams of CAB 171-15S, 1,520 grams of 2-butanone, 10 grams of ethyl acetate, 50 grams of dimethylformamide, 1.4 grams of (C-7), 11.6 grams of (C-8), 5.4 grams of (C-9), 4.0 grams of (C-10), an amount (mol/mol Ag) of a compound of formula (1) or comparative compound (C-12) as shown in Table 4, 0.43 gram of Megafax F-176P, 1.2 grams of spherical silica Sildex H31 (mean size 3 μm), and 0.42 gram of polyisocyanate Sumidur N3500 in 4.2 grams of ethyl acetate.

Coated Sample

A back layer coating solution was prepared by adding 6 grams of polyvinyl butyral Denka Butyral #4000-2, 0.2 gram of spherical silica Sildex H121 (mean size 12 μm), 0.2 gram of spherical silica Sildex H51 (mean size 5 μm), and 0.1 gram of Megafax F-176P to 64 grams of 2-propanol and mixing them into a solution. Further, a mixed solution of 420 mg of (C-6) in 10 grams of methanol and 20 grams of acetone and a solution of 0.8 gram of polyisocyanate Sumidur N3500 in 6 grams of ethyl acetate were added to the solution.

A polyethylene terephthalate film having a moisture-proof undercoat of vinylidene chloride on either surface was coated on one surface with the back surface coating solution so as to give an optical density of 0.7 at 780 nm.

On the thus prepared support, the emulsion layer coating solution was coated so as to give a coverage of 1.6 g/m$^2$ of silver and the emulsion layer protective layer coating solution was then coated on the emulsion layer so as to give a dry thickness of 1.8 μm.

Photographic Property Test

The samples prepared above were exposed to xenon flash light for an emission time of $10^{-4}$ sec through an interference filter having a peak at 780 nm and a step wedge and heated for development on a heat drum at 115° C., 117° C. or 120° C. for 25 seconds. The resulting images were determined by a densitometer. The following factors were measured.

(1) minimum density (Dmin) or fog (2) sensitivity ($S_{1.5}$): $-\log(1/E)$ wherein E is the exposure necessary to provide a density of 1.5. Expressed in relative value.

(3) ΔS1.5: a difference in sensitivity between development at 115° C. and 120° C., ΔlogE (4) G0330: gradation (γ), G0330 is (3.0−0.3) divided by ($S_{3.0}-S_{0.3}$) wherein $S_{3.0}$ is $-\log(1/E_{3.0})$ wherein $E_{3.0}$ is the exposure necessary to provide a density of 3.0 and $S_{0.3}$ is $-\log(1/E_{0.3})$ wherein $E_{0.3}$ is the exposure necessary to provide a density of 0.3.

The results are shown in Table 4 together with the heat development temperature.

TABLE 4

| Sample No. | Compound of formula (1) Added layer | Type | Addition amount (mol/mol Ag) | Dmin @ 120° C. | $S_{1.5}$ @ 117° C. | G0330 @ 117° C. | $\Delta S_{1.5}$ (120–115) | Remarks |
|---|---|---|---|---|---|---|---|---|
| 301 | — | — | — | 0.76 | 100 | 14 | 1.29 | Comparison |
| 302 | Emulsion layer | D-1 | $1.5 \times 10^{-2}$ | 0.12 | 98 | 17 | 0.31 | Invention |
| 303 | Emulsion layer | D-9 | $1.5 \times 10^{-2}$ | 0.10 | 100 | 16 | 0.30 | Invention |
| 304 | Emulsion layer | D-13 | $1.5 \times 10^{-2}$ | 0.13 | 100 | 16 | 0.35 | Invention |
| 365 | Emulsion layer | D-17 | $1.5 \times 10^{-2}$ | 0.14 | 95 | 18 | 0.30 | Invention |
| 306 | Emulsion layer | D-18 | $1.5 \times 10^{-2}$ | 0.16 | 91 | 21 | 0.33 | Invention |
| 307 | Emulsion layer | D-21 | $1.5 \times 10^{-2}$ | 0.12 | 98 | 17 | 0.30 | Invention |
| 308 | Emulsion layer | D-23 | $1.5 \times 10^{-2}$ | 0.10 | 89 | 22 | 0.35 | Invention |
| 309 | Emulsion layer | D-33 | $1.5 \times 10^{-2}$ | 0.11 | 95 | 18 | 0.32 | Invention |
| 310 | Emulsion layer | C-11* | $1.5 \times 10^{-2}$ | 0.55 | 107 | 15 | 0.99 | Comparison |
| 311 | Protective layer | D-1 | $2.0 \times 10^{-2}$ | 0.19 | 100 | 16 | 0.30 | Invention |
| 312 | Protective layer | D-3 | $2.0 \times 10^{-2}$ | 0.20 | 98 | 16 | 0.32 | Invention |
| 313 | Protective layer | D-7 | $2.0 \times 10^{-2}$ | 0.15 | 95 | 17 | 0.29 | Invention |
| 314 | Protective layer | D-14 | $2.0 \times 10^{-2}$ | 0.13 | 93 | 17 | 0.37 | Invention |
| 315 | Protective layer | D-19 | $2.0 \times 10^{-2}$ | 0.14 | 98 | 17 | 0.39 | Invention |
| 316 | Protective layer | D-21 | $2.0 \times 10^{-2}$ | 0.10 | 93 | 20 | 0.30 | Invention |
| 317 | Protective layer | D-23 | $2.0 \times 10^{-2}$ | 0.12 | 91 | 22 | 0.31 | Invention |
| 318 | Protective layer | D-29 | $2.0 \times 10^{-2}$ | 0.15 | 95 | 18 | 0.29 | Invention |
| 319 | Protective layer | D-31 | $2.0 \times 10^{-2}$ | 0.10 | 95 | 21 | 0.31 | Invention |
| 320 | Protective layer | C-12* | $2.0 \times 10^{-2}$ | 0.56 | 105 | 15 | 1.10 | Comparison |

*C-11, C-12: comparative compound

It is evident that comparative sample No. 301 shows a high fog, low γ, and a very large change of sensitivity with a change of development temperature. Comparative sample Nos. 310 and 320 are not fully reduced in fog and experience a substantial change of sensitivity. All the inventive samples show a low fog and a minimal change of sensitivity with a change of development temperature.

Example 4

Samples were prepared as in Example 3 except that the hydrazine derivative used in Example 3 was replaced by Compounds 54r, 56a, 96-1 and 37p exemplified previously. The inventive samples were similarly examined, finding equivalent results.

Example 5

Silver Halide Grains B

In 700 ml of water were dissolved 22 grams of phthalated gelatin and 30 mg of potassium bromide. The solution was adjusted to pH 5.0 at a temperature of 40° C. To the solution, 159 ml of an aqueous solution containing 18.6 grams of silver nitrate and an aqueous solution containing potassium bromide were added over 10 minutes by the controlled double jet method while maintaining the solution at pAg 7.7. Then, an aqueous solution containing $8\times10^{-6}$ mol/liter of $K_3[IrCl_6]$ and 1 mol/liter of potassium bromide was added over 30 minutes by the controlled double jet method while maintaining the solution at pAg 7.7. The emulsion was then adjusted to pH 5.9 and pAg 8.0. There were obtained cubic grains having a mean grain size of 0.07 μm, a coefficient of variation of the projected area diameter of 8%, and a (100) face proportion of 86%.

The thus obtained silver halide grains B were heated at 60° C., to which $8.5\times10^{-5}$ mol of sodium thiosulfate, $1.1\times10^{-5}$ mol of 2,3,4,5,6-pentafluorophenyldiphenylsulfin selenide, $2\times10^{-6}$ mol of Tellurium Compound 1, $3.3\times10^{-6}$ mol of chloroauric acid, and $2.3\times10^{-4}$ mol of thiocyanic acid were added per mol of silver. The emulsion was ripened for 120 minutes and then quenched to 50° C. With stirring, $8\times10^{-4}$ mol of Sensitizing Dye B was added, and $3.5\times10^{-2}$ mol of potassium iodide was added to the emulsion, which was stirred for 30 minutes and then quenched to 30° C., completing the preparation of silver halide grains B.

Some of the compounds used in the preparation of the sample are shown below.

Sensitizing Dye B

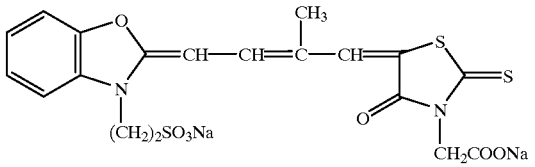

Tellurium Compound 1

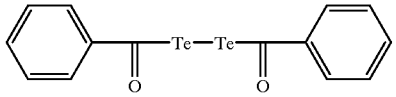

Organic Acid Silver Microcrystalline Dispersion

A mixture of 40 grams of behenic acid, 7.3 grams of stearic acid, and 500 ml of distilled water was stirred at 90° C. for 15 minutes. With vigorous stirring, 187 ml of 1N NaOH aqueous solution was added over 15 minutes, 61 ml of 1N nitric acid was added, and the solution was cooled to 50° C. Then, 124 ml of an aqueous solution of 1N silver nitrate was added and stirring was continued for 30 minutes. Thereafter, the solids were separated by suction filtration and washed with water until the water filtrate reached a conductivity of 30 μS/cm. The thus obtained solids were handled as a wet cake without drying. To 34.8 grams as dry solids of the wet cake were added 12 grams of polyvinyl alcohol and 150 ml of water. They were thoroughly mixed to form a slurry. A vessel was charged with the slurry together with 840 grams of zirconia beads having a mean diameter of 0.5 mm. A dispersing machine (1/4G Sand Grinder Mill by Imex K.K.) was operated for 5 hours for dispersion, completing the preparation of a microcrystalline dispersion of organic acid silver grains having a volume weighed mean grain diameter of 1.5 μm as measured by Master Sizer X (Malvern Instruments Ltd.).

Solid Particle Dispersions of Chemical Addenda

Solid particle dispersions of tetrachlorophthalic acid, 4-methylphthalic acid, 1,1-bis(2-hydroxy-3,5-dimethylphenyl)-3,5,5-trimethylhexane, phthalazine, and tribromomethylphenylsulfone were prepared.

To tetrachlorophthalic acid were added 0.81 gram of hydroxypropyl cellulose and 94.2 ml of water. They were thoroughly agitated to form a slurry, which was allowed to stand for 10 hours. A vessel was charged with the slurry together with 100 ml of zirconia beads having a mean diameter of 0.5 mm. A dispersing machine as above was operated for 5 hours for dispersion, obtaining a solid particle dispersion of tetrachlorophthalic acid in which particles with a diameter of up to 1.0μm accounted for 70% by weight. Solid particle dispersions of the remaining chemical addenda were similarly prepared by properly changing the amount of dispersant and the dispersion time to achieve a desired mean particle size.

Emulsion Layer Coating Solution

An emulsion layer coating solution was prepared by adding the following components to the organic acid silver microcrystalline dispersion prepared above.

Organic acid silver particle dispersion 0.95 mol

Silver halide grains B 0.05 mol

Binder: LACSTAR 3307B SBR latex 430 g

Addenda for development:

Tetrachlorophthalic acid 5 g 1,1-bis(2-hydroxy-3,5-dimethylphenyl)-3,5,5-trimethylhexane 98 g Phthalazine 9.2 g Tribromomethylphenylsulfone 12 g 4-methylphthalic acid 7 g Hydrazine derivative (Compound 54a) 1.5 g Compound of formula (1) (see Table 5)

(C-11) $(n—C_4H_9—S—)_2—$ (see Table 5)

Note that the type and amount of the compound of formula (1) and the amount of Compound (C-11) added are shown in Table 5, the amount being expressed by mol per mol of silver.

Emulsion Surface Protective Layer Coating Solution

An emulsion surface protective layer coating solution was prepared by adding the following chemicals to inert gelatin.

Inert gelatin 10 g

Surfactant A 0.26 g

Surfactant B 0.09 g

Silica microparticulates 0.9 g (mean particle size of 2.5 μm)

1,2-bis(vinylsulfoneacetamide)ethane 0.3 g

Water 64 g

Compound of formula (1) (see Table 5)

(C-12) $n—C_8H_{17}—S—S—CCl_3$ (see Table 5)

Note that the type and amount of the compound of formula (1) and the amount of Compound (C-12) added are shown in Table 5, the amount being expressed by mol per mol of silver.

Color Developing Agent Dispersion A

To 35 grams of ethyl acetate were added 2.5 grams of Compound 1 and 7.5 grams of Compound 2. The mixture was agitated for dissolution. The solution was combined with 50 grams of a 10 wt % polyvinyl alcohol solution and agitated for 5 minutes by means of a homogenizer. Thereafter, the ethyl acetate was removed. Dilution with water yielded a color developing agent dispersion.

Surfactant A

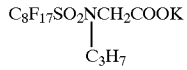

Surfactant B

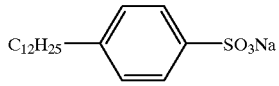

Compound 1

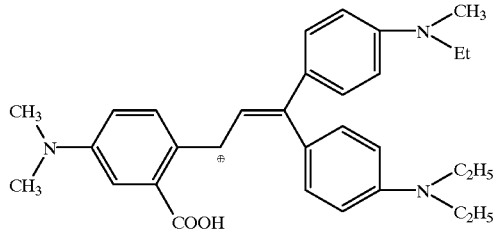

Compound 2

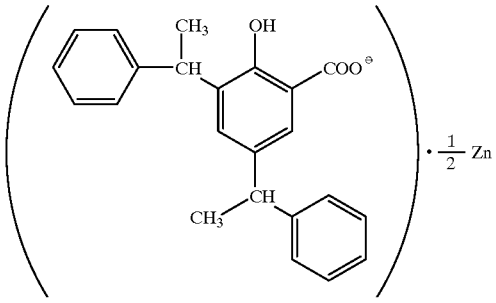

Back Surface Coating Solution

A back surface coating solution was prepared by adding the following components to polyvinyl alcohol.

Polyvinyl alcohol 30 g

Color developing agent dispersion A 50 g

Additive A 20 g

Water 250 g

Spherical silica Sildex H121 1.8 g (mean size 12 μm)

Additive A:

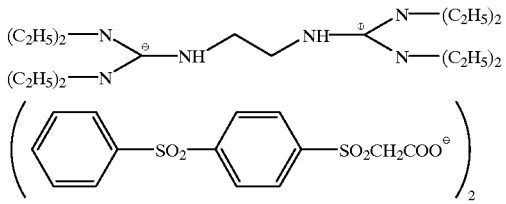

Coated Sample

The emulsion layer coating solution was applied to a polyethylene terephthalate support so as to give a silver coverage of 1.6 g/m$^2$. The emulsion surface protective layer coating solution was coated thereto so as to give a gelatin coverage of 1.8 g/m$^2$. After drying, the back surface coating solution was applied to the back surface of the support opposite to the emulsion layer so as to give an optical density of 0.7 at 660 nm. A coated sample was prepared in this way.

Photographic Property Test

The samples prepared above were exposed to xenon flash light for an emission time of $10^{-4}$ sec through an interference filter having a peak at 656 nm and a step wedge and then processed and examined as in Example 3.

The results are shown in Table 5 together with the heat development temperature.

TABLE 5

| Sample No. | Compound of formula (1) Added layer | Type | Addition amount (mol/mol Ag) | Dmin @ 120° C. | $S_{1.5}$ @ 117° C. | G0330 @ 117° C. | $\Delta S_{1.5}$ (120–115) | Remarks |
|---|---|---|---|---|---|---|---|---|
| 401 | — | — | — | 0.80 | 100 | 11 | 1.30 | Comparison |
| 402 | Emulsion layer | D-1 | $1.5 \times 10^{-2}$ | 0.13 | 91 | 18 | 0.30 | Invention |
| 403 | Emulsion layer | D-3 | $1.5 \times 10^{-2}$ | 0.15 | 95 | 18 | 0.31 | Invention |
| 404 | Emulsion layer | D-7 | $1.5 \times 10^{-2}$ | 0.12 | 95 | 16 | 0.35 | Invention |
| 405 | Emulsion layer | D-13 | $1.5 \times 10^{-2}$ | 0.19 | 98 | 14 | 0.30 | Invention |
| 406 | Emulsion layer | D-17 | $1.5 \times 10^{-2}$ | 0.13 | 91 | 17 | 0.29 | Invention |
| 407 | Emulsion layer | D-22 | $1.5 \times 10^{-2}$ | 0.10 | 85 | 21 | 0.31 | Invention |
| 408 | Emulsion layer | D-24 | $1.5 \times 10^{-2}$ | 0.20 | 93 | 15 | 0.35 | Invention |
| 409 | Emulsion layer | D-26 | $1.5 \times 10^{-2}$ | 0.18 | 95 | 14 | 0.30 | Invention |
| 410 | Emulsion layer | C-11* | $1.5 \times 10^{-2}$ | 0.69 | 98 | 12 | 1.12 | Comparison |
| 411 | Protective layer | D-1 | $2.0 \times 10^{-2}$ | 0.18 | 95 | 14 | 0.29 | Invention |
| 412 | Protective layer | D-2 | $2.0 \times 10^{-2}$ | 0.13 | 93 | 16 | 0.33 | Invention |
| 413 | Protective layer | D-6 | $2.0 \times 10^{-2}$ | 0.11 | 91 | 19 | 0.35 | Invention |
| 414 | Protective layer | D-15 | $2.0 \times 10^{-2}$ | 0.15 | 95 | 18 | 0.36 | Invention |
| 415 | Protective layer | D-19 | $2.0 \times 10^{-2}$ | 0.19 | 98 | 16 | 0.30 | Invention |
| 416 | Protective layer | D-21 | $2.0 \times 10^{-2}$ | 0.10 | 93 | 21 | 0.29 | Invention |
| 417 | Protective layer | D-22 | $2.0 \times 10^{-2}$ | 0.11 | 91 | 20 | 0.31 | Invention |
| 418 | Protective layer | D-29 | $2.0 \times 10^{-2}$ | 0.15 | 93 | 17 | 0.33 | Invention |
| 419 | Protective layer | D-33 | $2.0 \times 10^{-2}$ | 0.10 | 93 | 18 | 0.33 | Invention |
| 420 | Protective layer | C-12* | $2.0 \times 10^{-2}$ | 0.72 | 100 | 12 | 1.09 | Comparison |

*C-11, C-12: comparative compound

All the inventive samples showed excellent photographic properties as in Example 3.

Example 6

Samples were prepared as in Example 5 except that the hydrazine derivative used in Example 5 was replaced by Compounds 54r, 56a, 96-1 and 37p exemplified previously. The inventive samples were similarly examined, finding equivalent results.

It is thus evident that thermographic photographic elements exert a ultrahigh contrast, experience a minimized change of photographic properties with a change of development temperature, and produce consistent images of quality. They are thus suitable as graphic printing photosensitive elements.

Example 7

Samples as shown in Table 6 were prepared and examined as in Example 3. The type and amount of the compound of formula (1) used and the layer to which the compound of formula (1) is added are shown in Table 6. The test results are shown in Table 6.

TABLE 6

| Sample No. | Compound of formula (1) Added layer | Type | Addition amount | Dmin @ 120° C. | $S_{1.5}$ @ 117° C. | G0330 @ 117° C. | $\Delta S_{1.5}$ (120–115) | Remarks |
|---|---|---|---|---|---|---|---|---|
| 501 | — | — | — | 0.18 | 59 | 7 | 1.15 | Comparison |
| 502 | — | — | — | 1.88 | 100 | 16 | — | Comparison |
| 503 | Emulsion layer | S-1 | $5.0 \times 10^{-3}$ | 0.25 | 103 | 18 | 0.45 | Invention |
| 504 | Emulsion layer | S-1 | $1.0 \times 10^{-2}$ | 0.12 | 93 | 16 | 0.36 | Invention |
| 505 | Emulsion layer | S-30 | $5.0 \times 10^{-3}$ | 0.30 | 107 | 17 | 0.53 | Invention |
| 506 | Emulsion layer | S-30 | $1.0 \times 10^{-2}$ | 0.15 | 103 | 18 | 0.41 | Invention |
| 507 | Emulsion layer | S-31 | $5.0 \times 10^{-3}$ | 0.33 | 100 | 12 | 0.59 | Invention |
| 508 | Emulsion layer | S-31 | $1.0 \times 10^{-2}$ | 0.19 | 98 | 15 | 0.46 | Invention |
| 509 | Emulsion protective layer | S-1 | $5.0 \times 10^{-3}$ | 0.31 | 100 | 20 | 0.48 | Invention |

TABLE 6-continued

| Sample | Compound of formula (1) | | | Dmin | $S_{1.5}$ | G0330 | $\Delta S_{1.5}$ | |
|---|---|---|---|---|---|---|---|---|
| No. | Added layer | Type | Addition amount | @ 120° C. | @ 117° C. | @ 117° C. | (120–115) | Remarks |
| 510 | Emulsion protective layer | S-1 | $1.0 \times 10^{-2}$ | 0.12 | 95 | 18 | 0.39 | Invention |
| 511 | Emulsion protective layer | S-30 | $5.0 \times 10^{-3}$ | 0.33 | 100 | 19 | 0.57 | Invention |
| 512 | Emulsion protective layer | S-30 | $1.0 \times 10^{-2}$ | 0.15 | 98 | 16 | 0.44 | Invention |
| 513 | Emulsion protective layer | S-31 | $5.0 \times 10^{-3}$ | 0.38 | 100 | 19 | 0.62 | Invention |
| 514 | Emulsion protective layer | S-31 | $1.0 \times 10^{-2}$ | 0.18 | 98 | 18 | 0.46 | Invention |
| 515 | Emulsion layer | C-11 | $5.0 \times 10^{-3}$ | 1.21 | 99 | 16 | 0.92 | Comparison |
| 516 | Emulsion layer | C-11 | $1.0 \times 10^{-2}$ | 0.76 | 97 | 15 | 0.81 | Comparison |
| 517 | Emulsion protective layer | C-11 | $5.0 \times 10^{-3}$ | 1.32 | 100 | 16 | 1.02 | Comparison |
| 518 | Emulsion protective layer | C-11 | $1.0 \times 10^{-2}$ | 0.82 | 98 | 15 | 0.90 | Comparison |

Addition amount: mol/mol of Ag
In sample No. 501, the amount of the hydrazine derivative coated is one half of the previously described amount.
C-11: comparative compound It is seen that comparative sample No. 501 is not fully high contrast. Sample Nos. 502, 515, 516, 517, and 518 show a high fog and a very large change of sensitivity with a change of development temperature. All the inventive samples show a low fog and a minimal change of sensitivity with a change of development temperature.

Example 8

Samples were prepared as in Example 7 except that the hydrazine derivative used in Example 7 was replaced by Compounds 54r, 56a, 96-1 and 37p exemplified previously. The inventive samples were similarly examined, finding equivalent results.

Example 9

Samples as shown in Table 7 were prepared and examined as in Example 5. The test results are shown in Table 7.

The inventive samples show excellent photographic properties as in Example 7.

Example 10

Samples were prepared as in Example 9 except that the hydrazine derivative used in Example 9 was replaced by Compounds 54r, 56a, 96-1 and 37p exemplified previously. The inventive samples were similarly examined, finding equivalent results.

It is thus evident that thermographic photographic elements exert a ultrahigh contrast, experience a minimized change of photographic properties with a change of development temperature, and produce consistent images of quality. They are thus suitable as graphic printing photosensitive elements.

Japanese Patent Application Nos. 150107/1997, 150108/1997, and 207235/1997 are incorporated herein by reference.

TABLE 7

| Sample | Compound of formula (1) | | | Dmin | $S_{1.5}$ | G0330 | $\Delta S_{1.5}$ | |
|---|---|---|---|---|---|---|---|---|
| No. | Added layer | Type | Addition amount | @ 120° C. | @ 117° C. | @ 117° C. | (120–115) | Remarks |
| 601 | — | — | — | 1.17 | 100 | 10 | 1.26 | Comparison |
| 602 | Emulsion layer | S-14 | $5.0 \times 10^{-3}$ | 0.28 | 103 | 18 | 0.45 | Invention |
| 603 | Emulsion layer | S-14 | $1.0 \times 10^{-2}$ | 0.15 | 100 | 18 | 0.35 | Invention |
| 604 | Emulsion layer | S-14 | $2.0 \times 10^{-2}$ | 0.12 | 89 | 16 | 0.33 | Invention |
| 605 | Emulsion layer | S-18 | $5.0 \times 10^{-3}$ | 0.33 | 100 | 18 | 0.51 | Invention |
| 606 | Emulsion layer | S-18 | $1.0 \times 10^{-2}$ | 0.20 | 100 | 19 | 0.39 | Invention |
| 607 | Emulsion layer | S-18 | $2.0 \times 10^{-2}$ | 0.15 | 95 | 17 | 0.34 | Invention |
| 608 | Emulsion layer | S-7 | $5.0 \times 10^{-3}$ | 0.38 | 100 | 18 | 0.55 | Invention |
| 609 | Emulsion layer | S-7 | $1.0 \times 10^{-2}$ | 0.25 | 100 | 16 | 0.44 | Invention |
| 610 | Fmulsion layer | S-7 | $2.0 \times 10^{-2}$ | 0.17 | 95 | 19 | 0.38 | Invention |
| 611 | Fmulsion protective layer | S-14 | $1.0 \times 10^{-2}$ | 0.25 | 103 | 18 | 0.37 | Invention |
| 612 | Emulsion protective layer | S-14 | $2.0 \times 10^{-2}$ | 0.15 | 100 | 20 | 0.34 | Invention |
| 613 | Emulsion protective layer | S-14 | $3.0 \times 10^{-2}$ | 0.11 | 93 | 16 | 0.32 | Invention |
| 614 | Emulsion protective layer | S-18 | $1.0 \times 10^{-2}$ | 0.30 | 100 | 15 | 0.43 | Invention |
| 615 | Emulsion protective layer | S-18 | $2.0 \times 10^{-2}$ | 0.17 | 100 | 16 | 0.36 | Invention |
| 616 | Emulsion protective layer | S-18 | $3.0 \times 10^{-2}$ | 0.13 | 95 | 18 | 0.35 | Invention |
| 617 | Emulsion protective layer | S-7 | $1.0 \times 10^{-2}$ | 0.35 | 103 | 14 | 0.51 | Invention |
| 618 | Emulsion protective layer | S-7 | $2.0 \times 10^{-2}$ | 0.20 | 103 | 15 | 0.45 | Invention |
| 619 | Emulsion protective layer | S-7 | $3.0 \times 10^{-2}$ | 0.15 | 100 | 16 | 0.38 | Invention |
| 620 | Emulsion layer | C-11 | $5.0 \times 10^{-3}$ | 0.92 | 100 | 13 | 0.99 | Comparison |
| 621 | Emulsion layer | C-11 | $1.0 \times 10^{-2}$ | 0.81 | 103 | 12 | 0.92 | Comparison |
| 622 | Emulsion layer | C-11 | $2.0 \times 10^{-2}$ | 0.75 | 99 | 12 | 0.89 | Comparison |
| 623 | Emulsion protective layer | C-11 | $1.0 \times 10^{-2}$ | 0.80 | 103 | 13 | 1.01 | Comparison |
| 624 | Emulsion protective layer | C-11 | $2.0 \times 10^{-2}$ | 0.75 | 100 | 10 | 0.92 | Comparison |
| 625 | Emulsion protective layer | C-11 | $3.0 \times 10^{-2}$ | 0.72 | 101 | 12 | 0.90 | Comparison |

Addition amount: mol/mol of Ag
C-11: comparative compound

Reasonable modifications and variations are possible from the foregoing disclosure without departing from either the spirit or scope of the present invention as defined by the claims.

We claim:

1. A photothermographic element comprising on a support a photosensitive silver halide, an organic silver salt, a reducing agent, and at least one compound of the formula (I):

$$Z^1—(W^1)_{m1}—L^1—S—S—L^2—(W^2)_{m2}—Z^2 \quad (I)$$

wherein each of $L^1$ and $L^2$ is a divalent linking group composed of an aliphatic hydrocarbon group, each of $W^1$ and $W^2$ is a divalent linking group containing at least one of oxygen, sulfur and nitrogen atoms, $Z^1$ is a hydrogen, halogen, aliphatic hydrocarbon, aromatic or heterocyclic group, $Z^2$ is an aromatic or heterocyclic group, letter $m_1$ is equal to 0, 1, 2 or 3, and m is equal to 0, 1, 2 or 3.

2. The photothermographic element of claim 1 further comprising at least one contrast enhancer.

3. The photothermographic element of claim 1 or 2 wherein the silver halide has been spectrally sensitized in the wavelength range of 750 to 1400 nm.

4. The photothermographic element of claim 1 wherein $L^1$ and $L^2$ are each selected from the group consisting of normal, branched or cyclic alkylene groups having 1–20 carbon atoms, alkenylene groups having 2–20 carbon atoms, and alkynylene groups having 2 to 20 carbon atoms.

5. The photothermographic element of claim 1 wherein $L^1$ and $L^2$ together form a 4- to 7-membered ring selected from the group consisting of

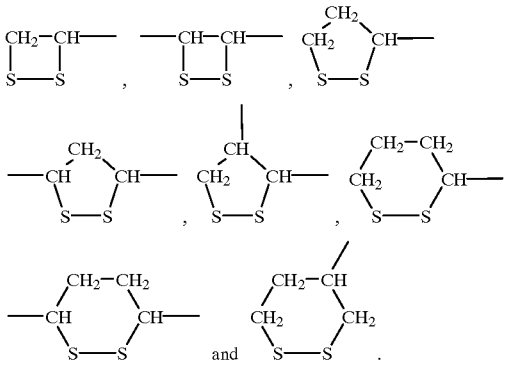

6. The photothermographic element of claim 1 wherein $W^1$ and $W^2$ are each selected from the group consisting of

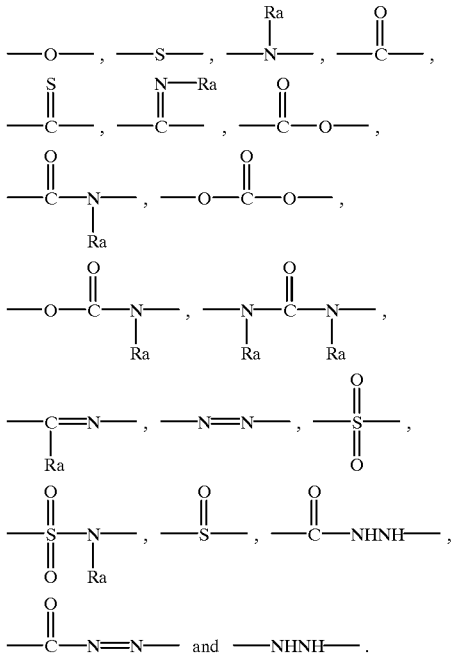

7. The photothermographic element of claim 1 wherein $Z^1$ is selected from the group consisting of fluorine, bromine, iodine, a normal, branched or cyclic alkyl group having 1 to 20 carbon atoms, an alkenyl group having 2 to 20 carbon atoms, an alkynyl group having 2 to 20 carbon atoms, an aromatic group having 6 to 30 carbon atoms, and a 3- to 10-membered, saturated or unsaturated heterocyclic group having at least one atom of nitrogen, oxygen or sulfur.

8. The photothermographic element of claim 1 wherein $Z^2$ is selected from the group consisting of an aromatic group having 6 to 30 carbon atoms, and a 3- to 10-membered, saturated or unsaturated heterocyclic group having at least one atom of nitrogen, oxygen or sulfur.

9. The photothermographic element of claim 1 wherein the compound of formula (I) is a compound selected from the group consisting of

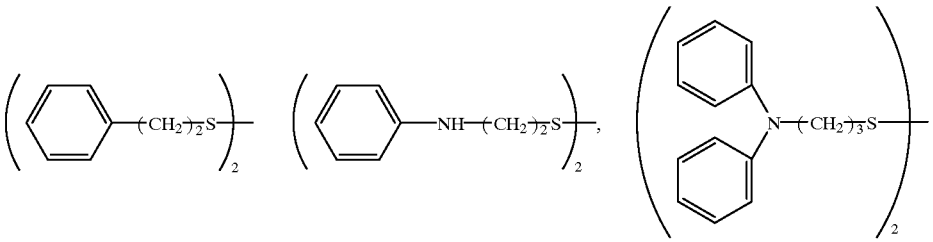

-continued
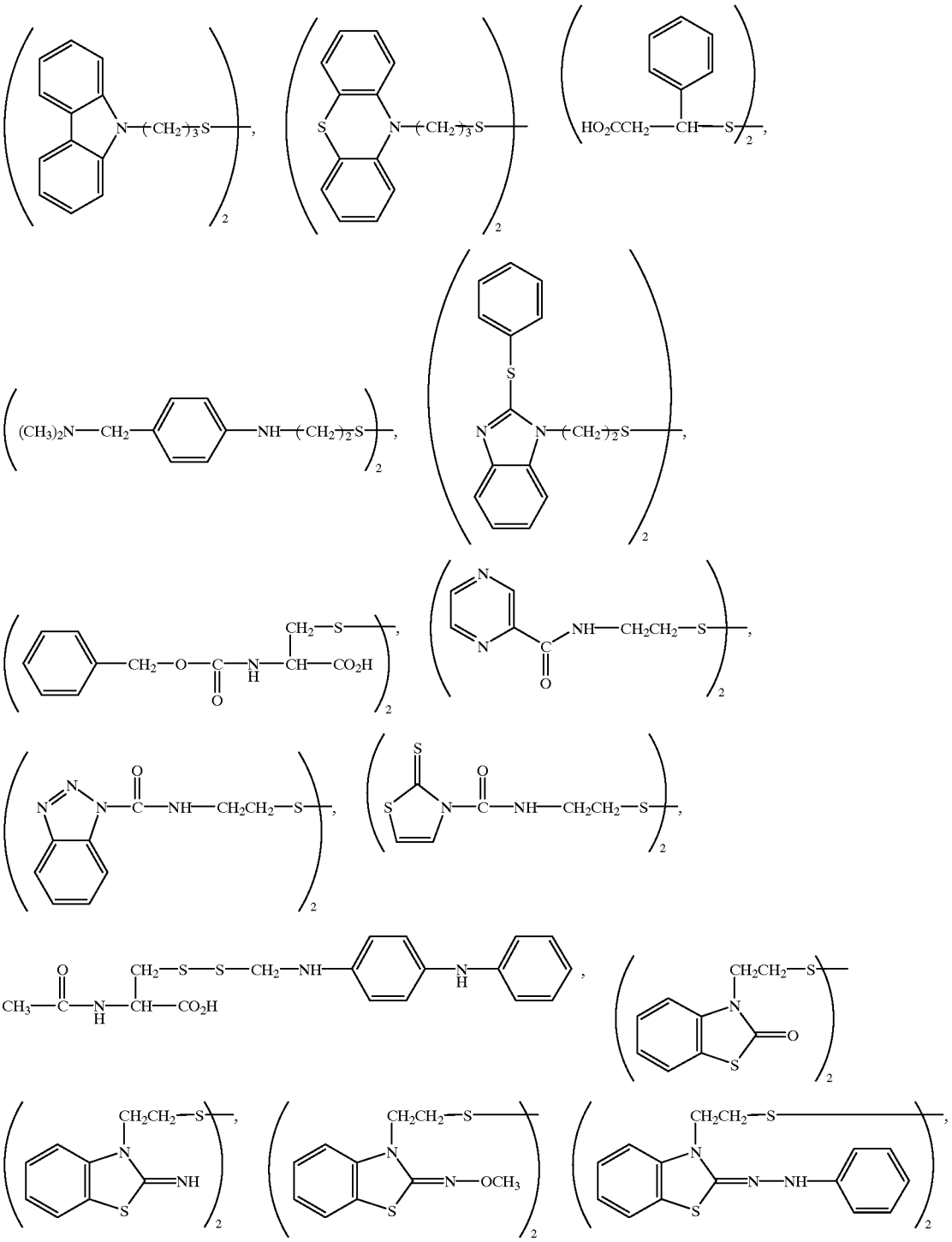

-continued
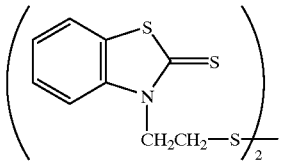
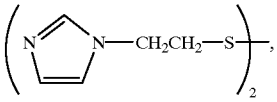
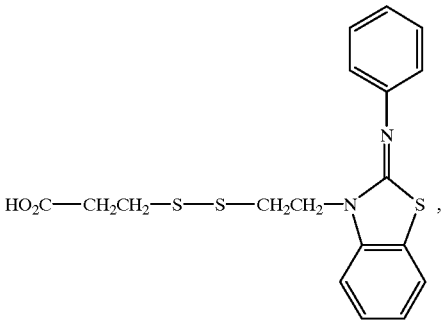
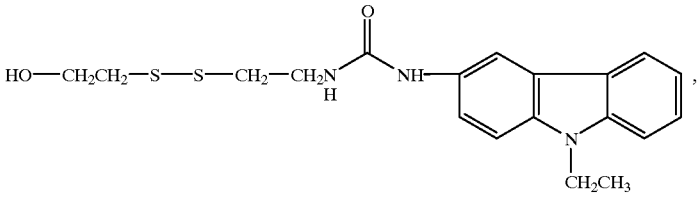
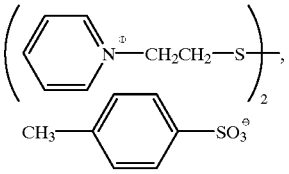
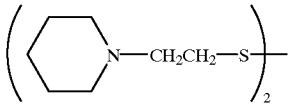
2HCl
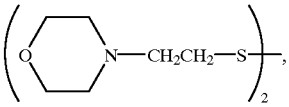
2HCl
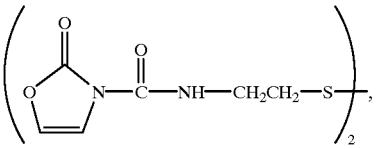
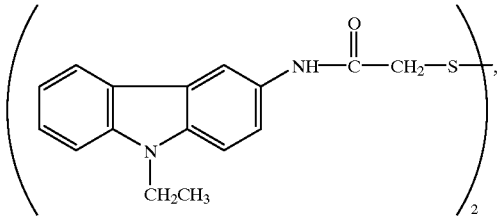
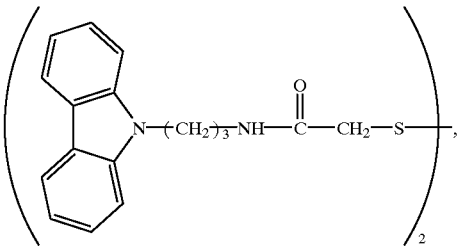
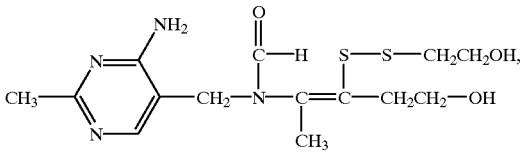
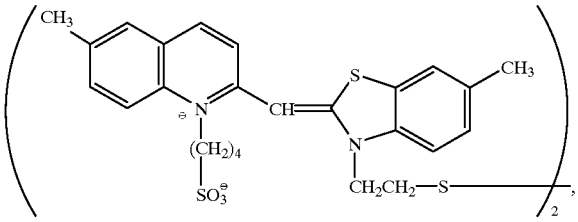
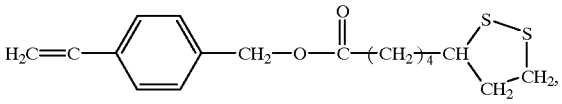
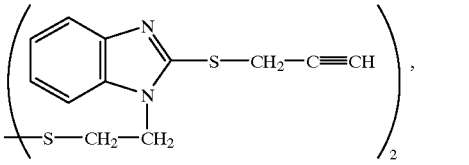

-continued
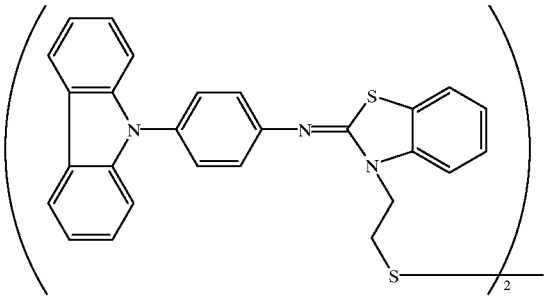
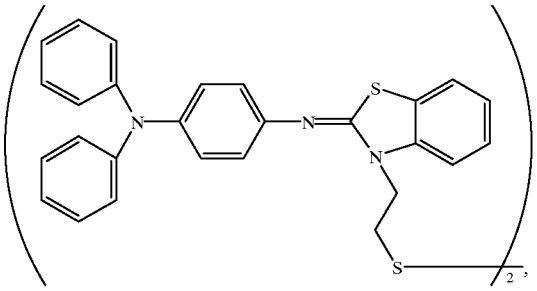
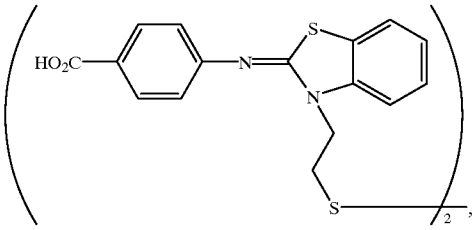
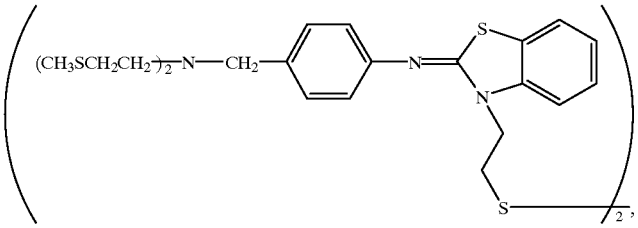
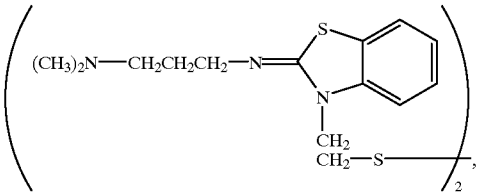
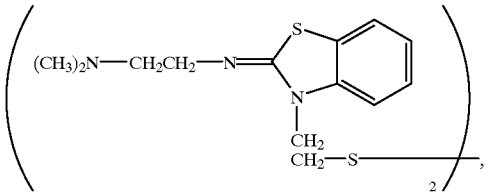
2HBr
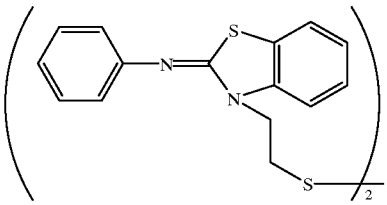
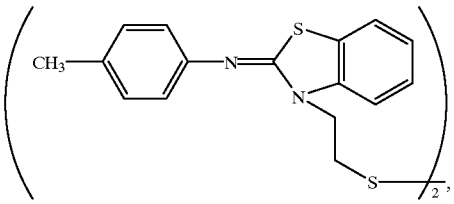
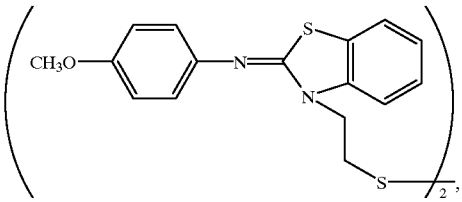
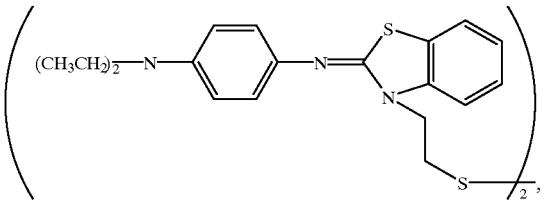
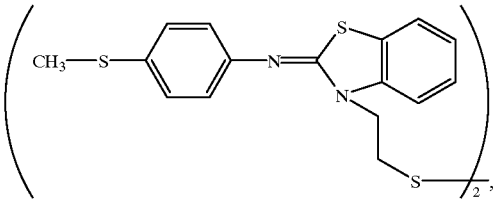
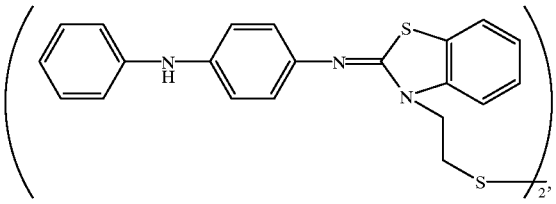
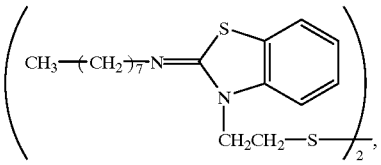

-continued
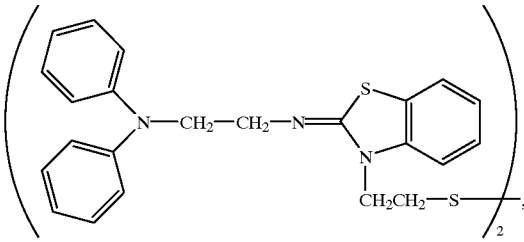
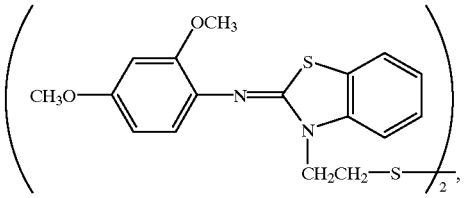
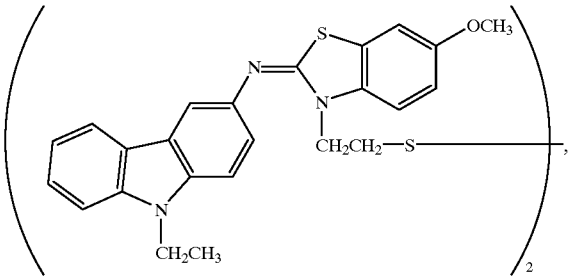
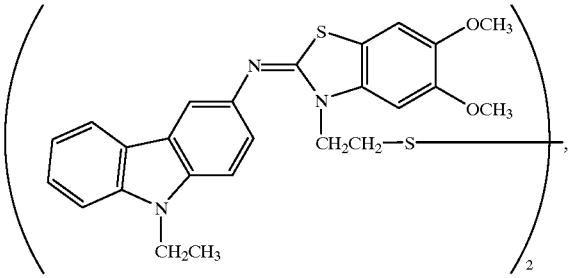
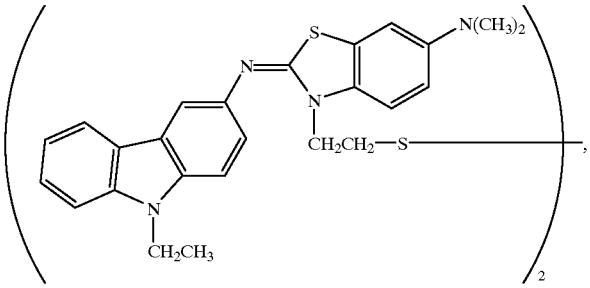
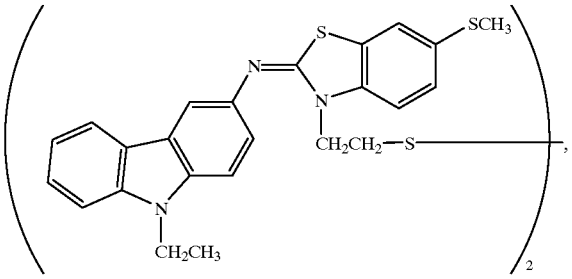
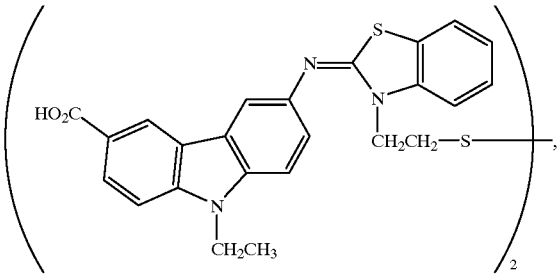

-continued
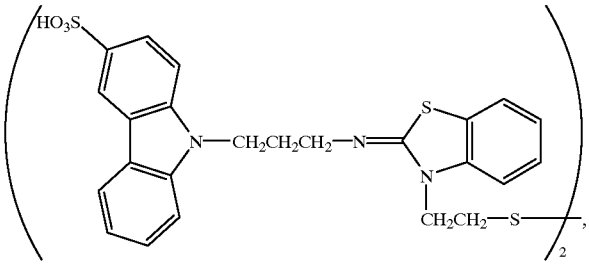
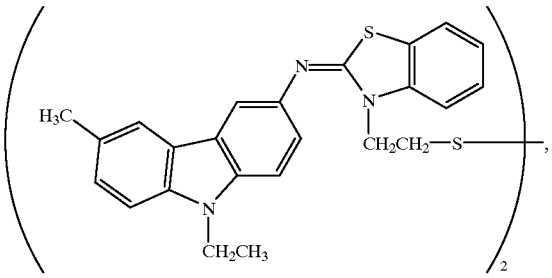
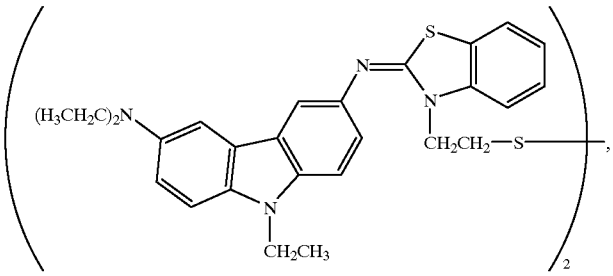
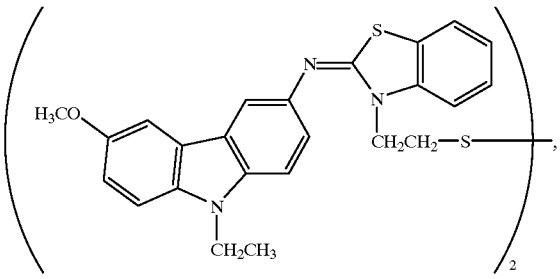
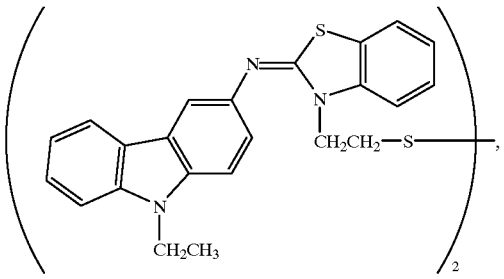
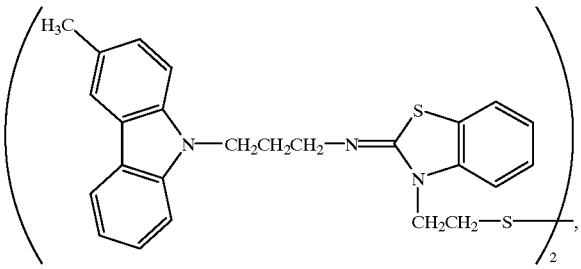
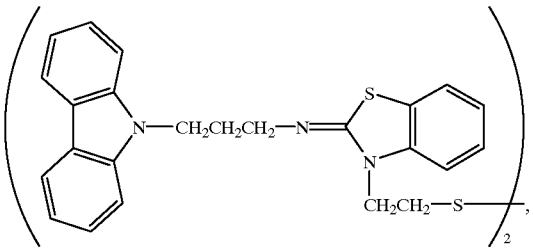
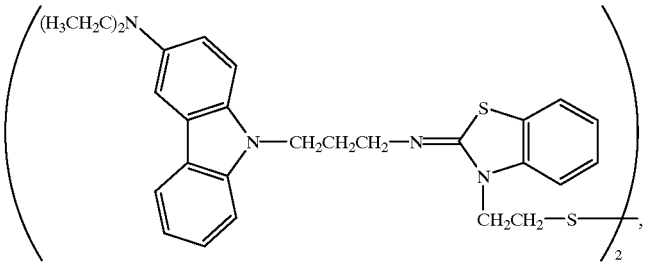

-continued

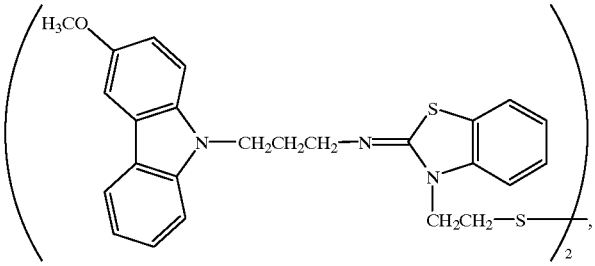

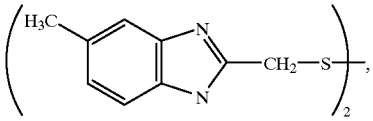

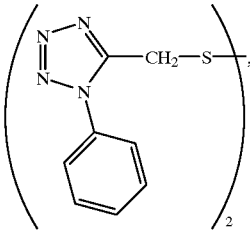

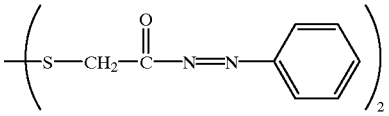

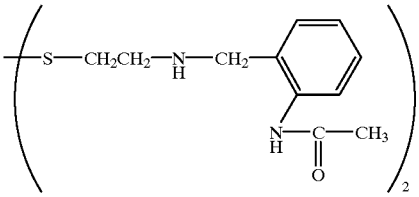

and

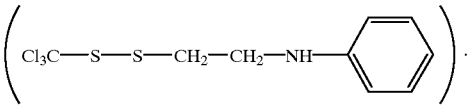

10. A thermographic photographic element comprising (a) a reducible silver salt, (b) a reducing agent, (c) a contrast enhancer, (d) a binder, and (e) at least one compound of the formula (1):

$$Z_1—S—S—Z_2 \quad (1)$$

wherein $Z_1$ is an aliphatic hydrocarbon or aryl group and $Z_2$ is an aryl group.

11. The thermographic photographic element of claim 10 further comprising (f) a photosensitive silver halide as a photocatalyst.

12. The photothermographic element of claim 10 wherein the compound of formula (1) is a compound selected from the group consisting of

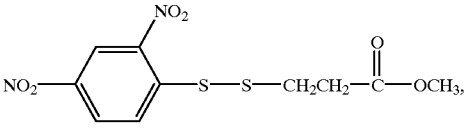

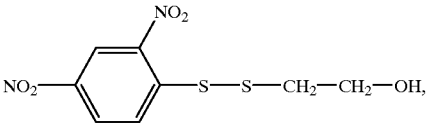

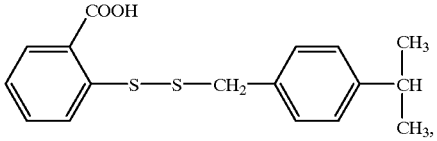

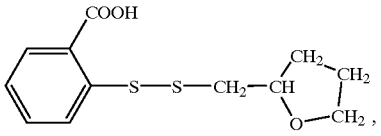

-continued

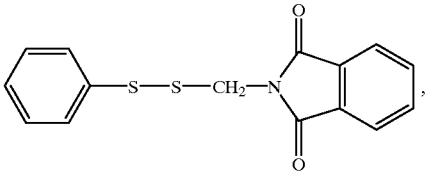

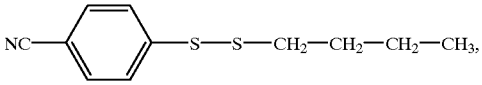

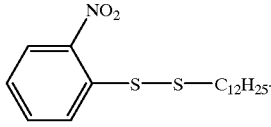

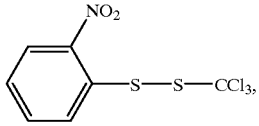

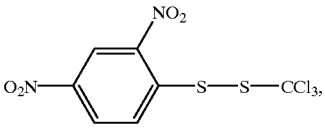

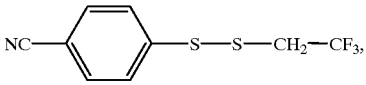

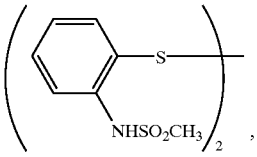

-continued
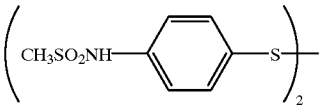
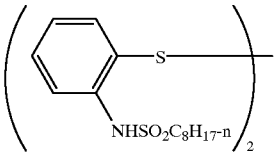
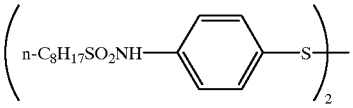
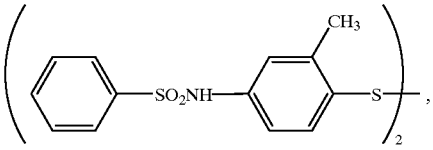
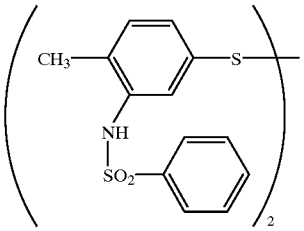
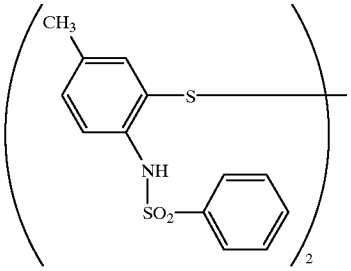
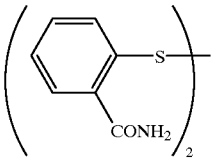
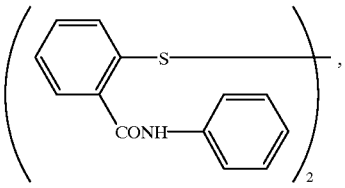
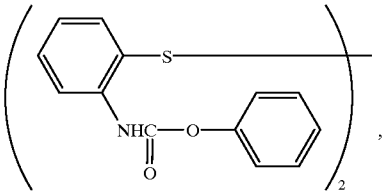
-continued
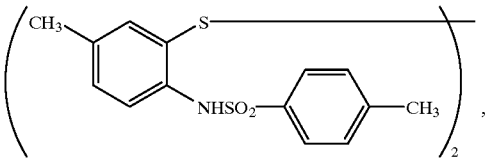
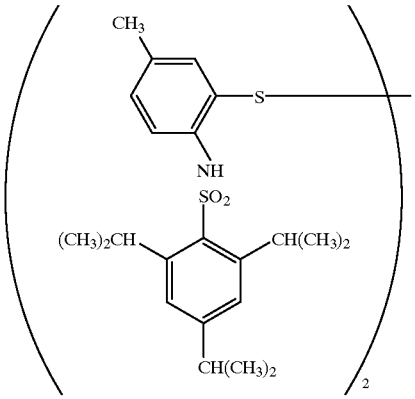
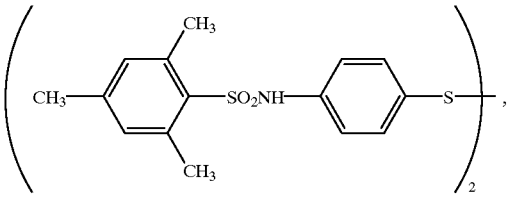
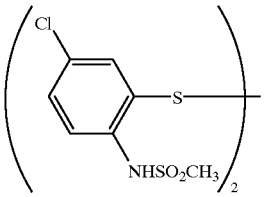
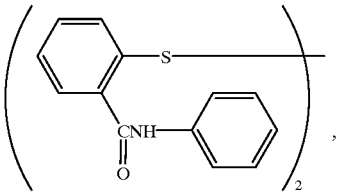
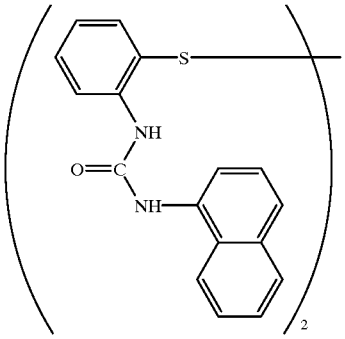

-continued

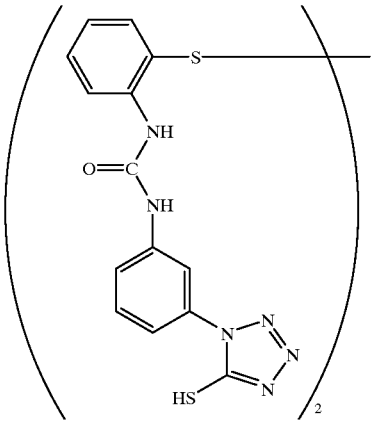

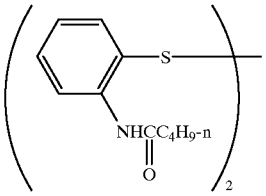

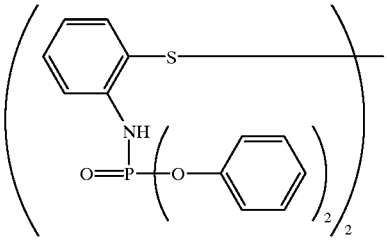

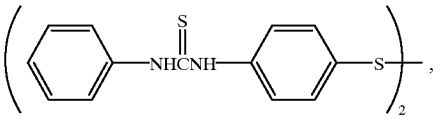

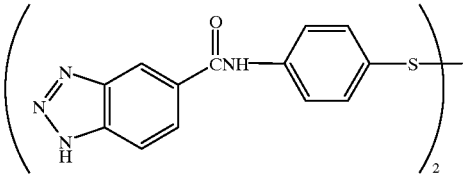

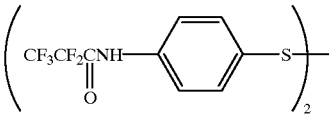

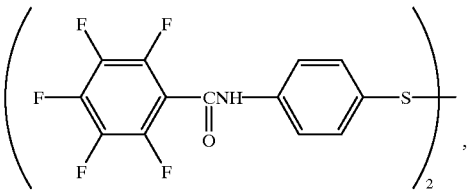

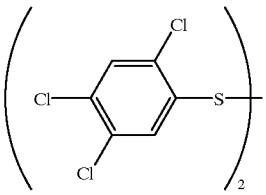

-continued

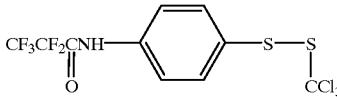

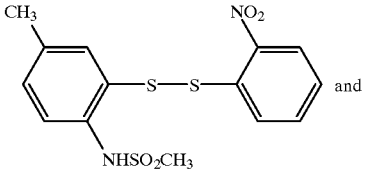

and

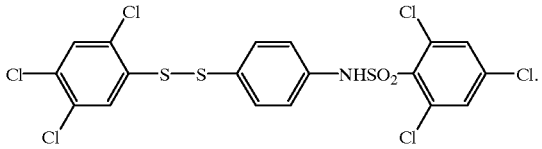

13. A thermographic photographic element comprising (a) a reducible silver salt, (b) a reducing agent, (c) a contrast enhancer, (d) a binder, and (e) at least one compound of the formula (2):

$$Z_1—S—S—Z_2 \quad (2)$$

wherein $Z_1$ is an aliphatic hydrocarbon, aryl or heterocyclic group and $Z_2$ is a heterocyclic group.

14. The thermographic photographic element of claim 13 further comprising (f) a photosensitive silver halide as a photocatalyst.

15. The photothermographic element of claim 13 wherein the compound of formula (2) is a compound selected from the group consisting of

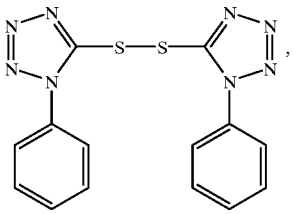

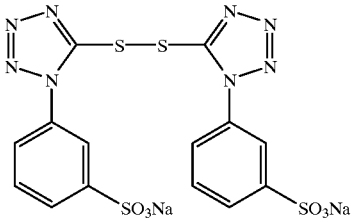

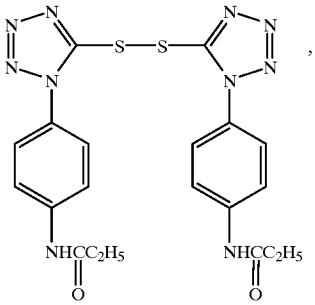

-continued
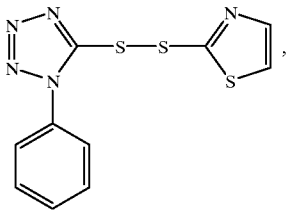
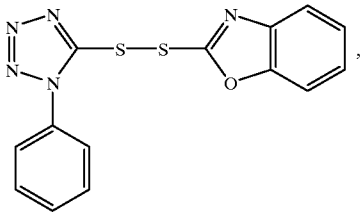
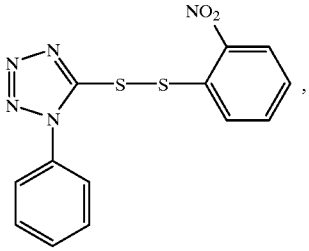
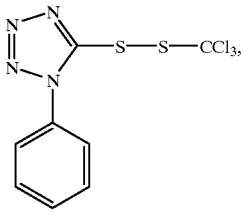
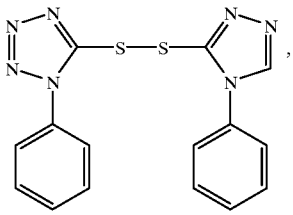
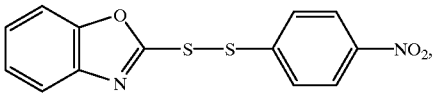
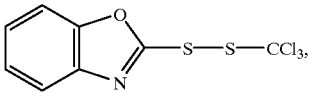
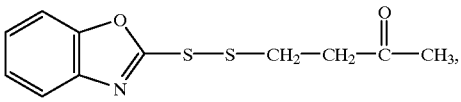
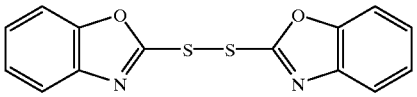
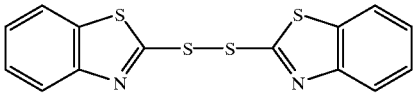
-continued
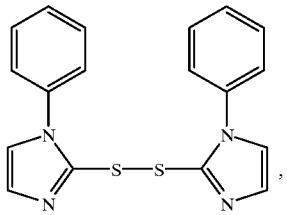
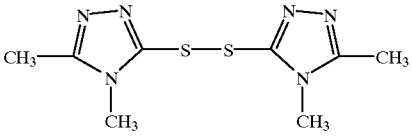
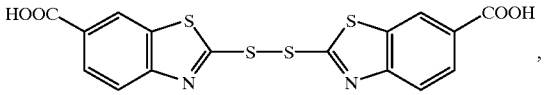
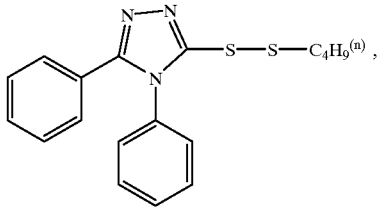
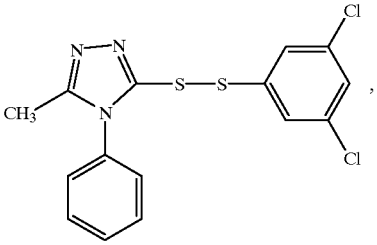
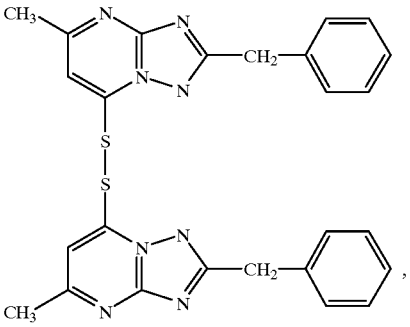
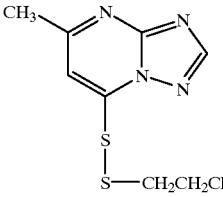
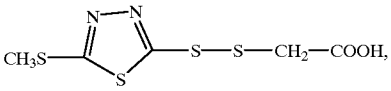
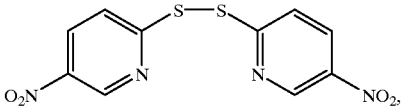

-continued
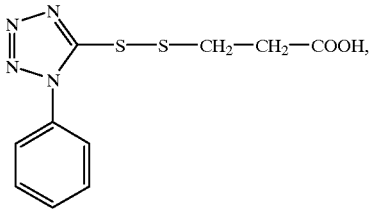
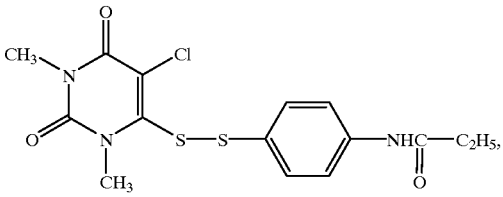
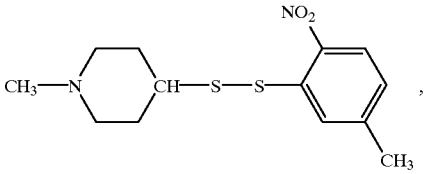
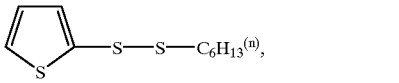
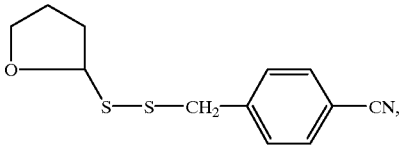
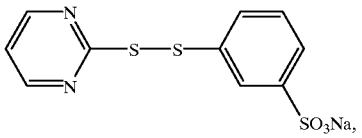
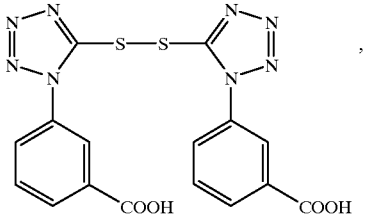
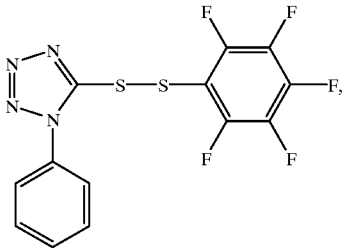
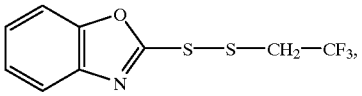
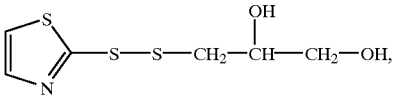
-continued
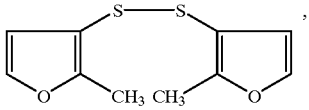
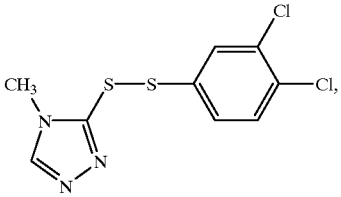
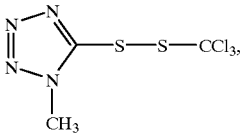
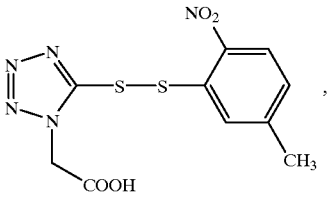
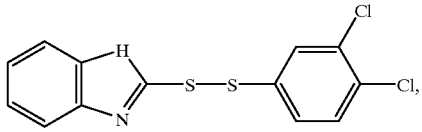
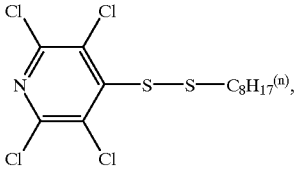
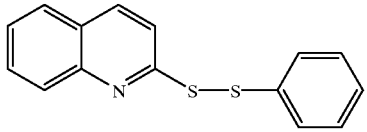
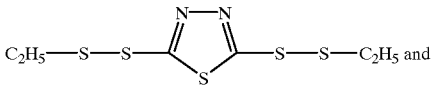
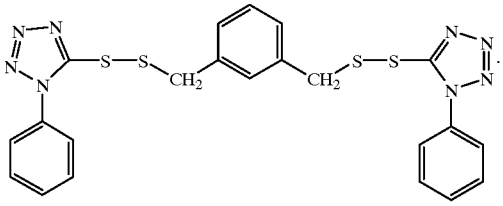
* * * * *